US009856644B2

(12) United States Patent
Gosling et al.

(10) Patent No.: US 9,856,644 B2
(45) Date of Patent: Jan. 2, 2018

(54) STRAIGHT AND CURVED RECONFIGURABLE PARTITION SYSTEMS

(71) Applicant: DIRTT Environmental Solutions, LTD., Calgary (CA)

(72) Inventors: Geoff Gosling, Calgary (CA); Mogens F. Smed, DeWinton (CA); Patrick John Harris, Calgary (CA)

(73) Assignee: DIRTT Environmental Solutions, LTD, Calgary (CA)

( * ) Notice: Subject to any disclaimer, the term of this patent is extended or adjusted under 35 U.S.C. 154(b) by 0 days.

(21) Appl. No.: 15/028,000

(22) PCT Filed: Jun. 5, 2015

(86) PCT No.: PCT/US2015/034491

§ 371 (c)(1),
(2) Date: Apr. 7, 2016

(87) PCT Pub. No.: WO2015/188105

PCT Pub. Date: Dec. 10, 2015

(65) Prior Publication Data

US 2017/0089066 A1 Mar. 30, 2017

Related U.S. Application Data

(60) Provisional application No. 62/009,061, filed on Jun. 6, 2014, provisional application No. 62/009,557, filed on Jun. 9, 2014.

(51) Int. Cl.
*E04B 2/00* (2006.01)
*E04B 2/74* (2006.01)
(Continued)

(52) U.S. Cl.
CPC ..... *E04B 2/7457* (2013.01); *E04B 2/7818* (2013.01); *E04B 2/7854* (2013.01);
(Continued)

(58) Field of Classification Search
CPC ..... E04B 2/764; E04B 2/7455; E04B 2/7457; E04B 2/7818; E04B 2/7845; E04B 2/7854; E04B 2002/7462
(Continued)

(56) References Cited

U.S. PATENT DOCUMENTS 3,295,283 A 1/1967 Griffith
3,371,454 A 3/1968 Anderson
(Continued)

FOREIGN PATENT DOCUMENTS

CA 2248428 3/2000
EP 0657595 6/1995
(Continued)

OTHER PUBLICATIONS

Non-Final Office Action in U.S. Appl. No. 14/903,035 dated Feb. 16, 2017.
(Continued)

*Primary Examiner* — Charles A Fox
*Assistant Examiner* — James Buckle, Jr.
(74) *Attorney, Agent, or Firm* — Workman Nydegger

(57) ABSTRACT

A reconfigurable modular partition system having a plurality of different types of interchangeable (wall or ceiling) modules with different types of compatible connection components, each connection component being configured to align with another connection component at an interface to form an interface connection (e.g., channel) for securing the connection components together with one or more universal connection interface members. The interface is configured for on-demand reconfiguration without laborious alteration to aspects of the partition system, modules, and components thereof. Reconfiguration of modules is facilitated by removing the universal connection interface member from the channel, thereby releasing the attachment mechanism and
(Continued)

allowing rearrangement of the module(s). Replacement of the universal connection interface member secures the reconfigured modules in place in the rearranged partition system.

23 Claims, 42 Drawing Sheets

(51) Int. Cl.
*E04B 2/78* (2006.01)
*E04B 2/76* (2006.01)

(52) U.S. Cl.
CPC ..... *E04B 2/7455* (2013.01); *E04B 2/764* (2013.01); *E04B 2/7845* (2013.01); *E04B 2002/7462* (2013.01)

(58) Field of Classification Search
USPC ..... 52/483.1
See application file for complete search history.

(56) References Cited

U.S. PATENT DOCUMENTS

| | | | |
|---|---|---|---|
| 3,486,287 | A | 12/1969 | Guillon |
| 3,866,364 | A | 2/1975 | Pollard |
| 4,031,680 | A | 6/1977 | Stoakes |
| 4,065,904 | A | 1/1978 | Taylor |
| 4,101,231 | A | 7/1978 | Streib |
| 4,356,672 | A | 11/1982 | Beckman |
| 4,535,577 | A | 8/1985 | Tenser |
| 4,648,231 | A | 3/1987 | Laroche |
| 4,652,170 | A | 3/1987 | Lew |
| 4,830,080 | A | 5/1989 | Densen |
| 5,125,201 | A | 6/1992 | Pieters |
| 5,592,794 | A | 1/1997 | Tundaun |
| 5,685,113 | A | 11/1997 | Reuter |
| 5,803,146 | A | 9/1998 | Boon |
| 5,806,261 | A | 9/1998 | Huebner |
| 6,260,321 | B1 | 7/2001 | Ruddock |
| 6,536,175 | B2 | 3/2003 | Conterno |
| 6,615,556 | B2 | 9/2003 | Cates |
| 6,761,004 | B2 | 7/2004 | Anglin |
| 9,003,731 | B2 | 4/2015 | Gosling |
| 2003/0163967 | A1 | 9/2003 | Sims |
| 2004/0139677 | A1 | 7/2004 | Mulas |
| 2006/0059806 | A1 | 3/2006 | Gosling |
| 2007/0077387 | A1 | 4/2007 | Riccobene |
| 2008/0069632 | A1 | 3/2008 | Gosling |
| 2008/0302054 | A1 | 12/2008 | Gosling |
| 2009/0272056 | A1 | 11/2009 | Koupal |
| 2010/0050548 | A1 | 3/2010 | Krieger |
| 2010/0067969 | A1 | 3/2010 | Kang |
| 2010/0102960 | A1 | 4/2010 | Simon |
| 2010/0192511 | A1 | 8/2010 | Gosling |
| 2010/0287858 | A1 | 11/2010 | Israeli |
| 2013/0025220 | A1 | 1/2013 | Yu |
| 2014/0137495 | A1 | 5/2014 | Ariza |
| 2016/0168863 | A1 | 6/2016 | Kwan |

FOREIGN PATENT DOCUMENTS

| | | |
|---|---|---|
| FR | 2218447 | 9/1974 |
| GB | 1013451 | 12/1965 |
| GB | 2374612 | 10/2002 |
| KR | 101311065 | 9/2013 |
| WO | 2011150467 | 12/2011 |

OTHER PUBLICATIONS

Non-Final Office Action for U.S. Appl. No. 15/023,990 dated Mar. 6, 2017.
International Search Report for application No. PCT/US15/15920 dated May 22, 2015.
International Search Report for application No. PCT/US15/015931 dated Apr. 30, 2015.
International Search Report for application No. PCT/US15/015943 dated May 14, 2015.
International Search Report for application No. PCT/US15/34491 dated Sep. 15, 2015.
European Search Report for application No. PCT/US2015015943 dated Sep. 27, 2017.
Final Office Action for U.S. Appl. No. 15/023,990 dated Oct. 3, 2017.
Non-Final Office Action for U.S. Appl. No. 15/026,566 dated Sep. 21, 2017.

STRAIGHT AND CURVED RECONFIGURABLE PARTITION SYSTEMS

CROSS-REFERENCE TO RELATED APPLICATIONS

The present invention is a 35 U.S.C. §371 U.S. National Stage of PCT Application No. PCT/US2015/34491, filed Jun. 5, 2015, which claims the benefit of priority to U.S. to U.S. Provisional Application No. 62/009,061, filed Jun. 6, 2014, and to U.S. Provisional Application No. 62/009,557, filed Jun. 9, 2014. The entire content of each of the foregoing patent applications is incorporated herein by reference.

BACKGROUND

Technical Field

The present disclosure relates generally to reconfigurable partition systems, and more particularly, to reconfigurable modular wall and ceiling systems comprising reconfigurable modules, components, and/or design elements, and to methods of assembling, (re)configuring, and/or using the same.

Background and Relevant Art

Modular wall systems, or dividers as they are sometimes called, are used most commonly in an office environment to separate work areas and to give people privacy or aesthetics where permanent walls are lacking, undesirable, or impractical. Some previous wall systems are difficult to (re)configure or move without significant amounts of labor and dislocation. For instance, most systems lack the flexibility to quickly and simply change the ordering, orientation, height, or relationship between adjacent or even distal modular wall components in order to change the aesthetics or functionality of an existing wall. Other systems lack the flexibility to use or substitute different types of modular units, tiles, or panels at a designated location or to replace a module in the middle of a wall without taking apart the entire wall. For instance, in some existing modular wall systems, the connection or relationship between a solid wall module and an adjacent glass wall module cannot be altered without removing and replacing both modules. This permanent relationship between adjacent modules may require every possible combination of adjacent relationship to be conceived and manufactured ahead of time.

Removing and replacing multiple modules to achieve a desired aesthetic can be cost and/or time prohibitive in some cases. Thus, existing wall systems may limit a user's ability to reconfigure, reorient, rearrange, and/or replace one or more modules of the wall system without laborious alterations such as, for example: (1) redesigning the entire wall system; (2) changing, altering, and/or swapping connection components; (3) disassembling the entire wall and/or large (sub)section(s) thereof; and/or (4) requiring additional adapters, components, and/or compatibility elements to ensure proper alignment and/or attachment of the modules.

There also is a need to be able to use the same wall system concepts, components, and connection interface(s) in commercial, residential, industrial and other applications without a system overhaul. Accordingly, there are a number of disadvantages in conventional wall systems that can be addressed.

BRIEF SUMMARY

Implementations of the present disclosure are generally related to and/or address one or more of the foregoing or other problems in the art with partition systems and apparatus, and methods for implementing the same. More specifically, implementations of the present disclosure are directed toward systems and apparatus for implementing a reconfigurable modular wall or ceiling assembly comprising reconfigurable modules, components, and/or design elements, and methods for assembling, (re)configuring, and/or using the same. Some implementations involve wall or ceiling systems having a plurality of interchangeable wall or ceiling modules, wherein different types of wall or ceiling modules have and/or are associated with connection details or components of different shapes and/or types. Certain implementations relate to systems, methods, and apparatus for connecting, securing, and/or attaching wall or ceiling modules in a plurality of configurations by means of compatible connection components and/or a common or universal connection interface component.

Additional features and advantages of exemplary implementations of the disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the disclosure briefly described above will be rendered by reference to specific implementations and/or embodiments thereof which are illustrated in the appended drawings. Understanding that these drawings depict only typical implementations and/or embodiments of the disclosure and are not therefore to be considered to be limiting of its scope, the invention will be described and explained with additional specificity and detail through the use of the accompanying drawings in which.

DETAILED DESCRIPTION

Figure 1:
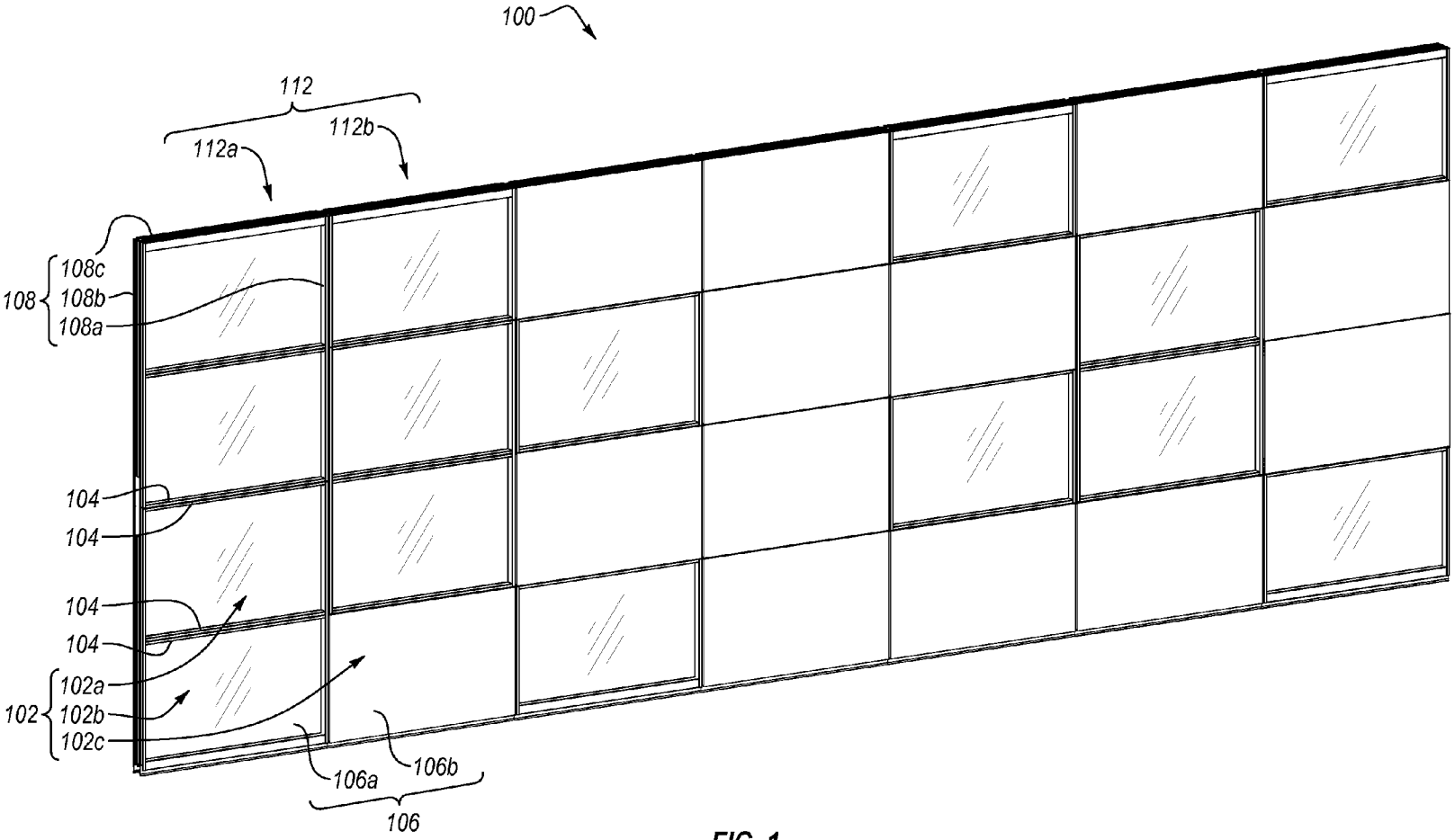
FIG. 1 illustrates a perspective view of an exemplary wall system according to one or more implementations of the present disclosure.

Before describing example implementations in detail, it is to be understood that this disclosure is not limited to parameters of the particularly exemplified systems, methods, apparatus, products, processes, compositions, and/or kits, which may, of course, vary. It is also to be understood that the terminology used herein is only for the purpose of describing particular implementations of the present disclosure, and is not necessarily intended to limit the scope of the disclosure and/or invention in any manner. Thus, while the present disclosure will be described in detail with reference to specific configurations, the descriptions are illustrative only and are not to be construed as limiting the scope of the claimed invention. For instance, certain implementations may include fewer or additional components than those illustrated in the accompanying drawings and/or described in the written description. Furthermore, various modifications can be made to the illustrated configurations without departing from the spirit and scope of the invention as defined by the claims. Thus, while various aspects, embodiments, and/or implementations of the invention are described and/or disclosed herein, other aspects, implementations, and embodiments are also contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary implementations. As used herein, the term "exemplary" means "serving as an example, instance, or illustration," and should not necessarily be construed as preferred or advantageous over other implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "tile" includes one, two, or more tiles. Similarly, reference to a plurality of referents should be interpreted as comprising a single referent and/or a plurality of referents unless the content and/or context clearly dictate otherwise. Thus, reference to "tiles" does not necessarily require a plurality of such tiles. Instead, it will be appreciated that independent of conjugation; one or more tiles are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements.

As used herein, directional and/or arbitrary terms, such as "top," "bottom," "left," "right," "up," "down," "upper," "lower," "inner," "outer," "internal," "external," "interior," "exterior," "proximal," "distal" and the like can be used solely to indicate relative directions and/or orientations and may not be otherwise intended to limit the scope of the disclosure, including the specification, invention, and/or claims.

Where possible, like numbering of elements have been used in various figures. Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and/or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular implementation(s) in which they are illustrated. In other words, reference to a specific feature in relation to one implementation and/or embodiment should not be construed as being limited to applications only within said implementation.

It will also be appreciated that where a range a values (e.g., less than, greater than, at least, between, and/or up to a certain value, and/or between two recited values) is disclosed or recited, any specific value or range of values falling within the disclosed range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

It will be appreciated that the features, components, member, and/or elements described herein can be equally applicable to modular walls and/or wall systems, ceiling and/or ceiling systems, and/or other partitions or dividers. In at least one implementation, features, components, member, and/or elements described herein can be applicable to floors and/or floor systems. For ease in presenting implementations of the present disclosure, reference may be made, illustratively, to a modular wall or modular ceiling, etc. However, it is understood that reference to a modular structure of a specific type does not exclude application of the described features, components, member, and/or elements to the specific modular structure. Thus, while some of the systems described herein refer to reconfigurable wall systems, it will be appreciated that such description is merely exemplary and that such systems can be used to form other types of partitions. For instance, the reconfigurable wall systems described herein in detail can be positioned horizontally to form a ceiling.

It is also understood that various implementations described herein can be utilized in combination with any other implementation described or disclosed, without departing from the scope of the present disclosure. Therefore, products, members, elements, devices, apparatus, systems, methods, processes, compositions, and/or kits according to certain implementations of the present disclosure can include, incorporate, or otherwise comprise properties, features, components, members, elements, steps, and/or the like described in other implementations (including systems, methods, apparatus, and/or the like) disclosed herein without departing from the scope of the present disclosure. Thus, reference to a specific feature in relation to one implementation should not be construed as being limited to applications only within said implementation.

All publications, patents, and patent applications cited herein, whether supra or infra, are hereby incorporated by reference in their entirety to the same extent as if each individual publication, patent, or patent application was specifically and individually indicated to be incorporated by reference.

The headings used herein are for organizational purposes only and are not meant to be used to limit the scope of the description or the claims. To facilitate understanding, like reference numerals have been used, where possible, to designate like elements common to the figures.

Accordingly, various implementations of the present disclosure include a reconfigurable modular partition system having a plurality of reconfigurable modules, components, and/or design elements configured for interchangeable attachment one to another. In particular, implementations include a reconfigurable modular wall or ceiling system having different connection details for common connection of adjacent sections. Certain implementations include differently shaped connection details or components and/or connection interface components (e.g., at a common interface). For instance, certain implementations include a plurality of different connection components respectively having one or more common, universal, and/or compatible connection interfaces and/or connection interface elements or members. Such connection components can allow a user to select a desired module or display element without regard to compatibility concerns as each module and/or connection component(s) thereof are formed, extruded, and/or manufactured so as to be compatible with any other module and/or connection component.

Certain implementations, therefore, can allow a user to reconfigure, reorient, rearrange, and/or replace one or more modules of a wall system without laborious alterations such as, for example: (1) redesigning the entire wall system; (2) changing, altering, and/or swapping connection components; (3) disassembling the entire wall and/or large (sub) section(s) thereof; and/or (4) requiring additional adapters, components, and/or compatibility elements to ensure proper alignment and/or attachment of the modules. For instance, some implementations include a "checker-board" or other style modular wall comprising a plurality of vertically and horizontally arranged modules, wherein any two modules, regardless of position on the checker-board or other design, can be swapped, rearranged, reoriented, or otherwise reconfigured without one or more of the aforementioned or other alterations or limitations.

Likewise, some implementations can allow for additional modules to be added to the wall system (e.g., in a vertical and/or horizontal direction) to increase the height or width of the wall system without the requirement of one or more of the aforementioned or other alterations. Similarly, implementations may allow for one or more modules to be removed from a wall system (e.g., in a vertical and/or horizontal direction) to decrease the height or width of the wall system without the requirement of one or more of the aforementioned or other alterations or limitations. Thus, implementations of the present disclosure can provide a universally compatible, reconfigurable modular wall system that does not require a pre-designed frame to be constructed prior to assembly of the wall and/or does not require a redesigned frame or subunit in order to change, alter, or otherwise reconfigure the wall or a portion thereof.

As will be discussed in further detail below, this universal compatibility can permit the removal, addition, replacement, etc. of any wall module or unit with another module or unit without necessarily replacing one or more of the connection components associated with adjacent module(s) or unit(s). Accordingly, the intermediate glass wall module in a solid wall—glass wall—solid wall configuration or relationship can be replaced with a solid wall module to form a solid wall—solid wall—solid wall configuration or relationship without changing or replacing one or more of the connection components associated with the peripheral solid wall modules. Instead, the connection components associated with the peripheral solid wall modules are universally compatible with the connection components associated with the replaced glass wall module, as well as the replacing solid wall module.

Implementations of the present disclosure can also include providing, applying, attaching, inserting, and/or otherwise implementing a common, universal, or multi-compatible connection interface component for securing a plurality of connection components together in a desired configuration, orientation, and/or arrangement. For instance, in some exemplary implementations, a universal connection interface component can have a substantially X-shaped, Y-shaped, V-shaped, U-shaped, T-shaped, I-shaped, H-shaped, or other cross-section and/or can be configured to secure two connection components together at an interface. Specifically, the connection interface component can be inserted, slid, clipped, snapped, or otherwise positioned into one or more aligned, corresponding, and/or compatible attachment interfaces and/or channels in or of the connection component(s) and/or formed at the interface therebetween. For instance, each connection component can include one, two, or more attachment interface channels extending longitudinally at least partially between one end of the connection component and another and/or opposite end of the connection component. Importantly, aligning such attachment interface channels in two or more connection components and/or positioning two or more connection components such that corresponding attachment interface channels are aligned can form a joint and/or shared channel in which a connection interface component can be inserted or otherwise positioned to reversibly and/or selectively secure the connection components together.

It will be appreciated that while exemplary X-shaped, Y-shaped, V-shaped, U-shaped, T-shaped, and I-shaped cross-sections are substantially symmetrical across at least one axis, that such a configuration is not necessary in every implementation of the present disclosure. For instance, as will be discussed in further detail below, an asymmetrical (universal) connection interface component can permit the angling and/or curvature of a modular wall in at least one direction in some implementations.

Reconfiguration of and/or methods of reconfiguring a modular wall system can, therefore, comprise, involve, and/or include: (1) disengaging (e.g., slidedly or otherwise removing) one or more connection interface components from the corresponding attachment interface channels of the connection component(s) (and/or joint or shared channel formed thereby) to release, disconnect, detach, unfasten, or otherwise enable movement of one or more modules from the wall system; (2) removing, reorienting, replacing, and/or reorganizing one or more unsecured modules; (3) aligning corresponding attachment interface channels of the connection component(s) of adjacent modules (to form a joint or shared channel); and/or (4) re-engaging (e.g., slidedly or otherwise positioning) one or more connection interface components into the corresponding attachment interface channels of the connection component(s) (and/or joint or shared channel formed thereby) to secure, attach, connect, or otherwise assemble one or more modules to the wall system.

Various implementations of the present disclosure will now be discussed in detail with reference to the appended drawings. It is appreciated that these drawings depict only typical implementations of the disclosure and are therefore not to be considered limiting of its scope.

Reconfigurable Wall Systems

FIG. 1 illustrates a perspective view of an exemplary system according to one or more implementations of the present disclosure. More specifically, FIG. 1 illustrates a reconfigurable wall system 100 that includes a plurality of wall modules 102 arranged and/or coordinated in relation one to another. For instance, a first module 102*a* can be positioned (vertically) above or atop a second module 102*b* within wall system 100. Similarly, a third module 102*c* can be positioned (horizontally) beside or next to the second module 102*b*.

In certain implementations, modules 102 can be about 30.5 cm tall and about 30.5 cm wide. However, modules 102 can be any suitable size. For instance, modules 102 can be greater than, less than, up to, between, equal to, or about 10 cm, 20 cm, 25 cm, 35 cm, 45 cm, 60 cm, or more in length and/or width. Modules 102 can also have a standard thickness greater than, less than, up to, between, equal to, or about 1 cm, 2.5 cm, 5 cm, 7.5 cm, 10 cm, 12.5 cm, 15 cm, 18 cm, 20 cm, 22 cm, 25 cm, 28 cm, 30 cm, or more. Other standard sizes, measurements, and/or standards can also or alternatively be applied and/or adhered to in some implementations.

In some implementations, each module 102 is substantially similar and/or identical in size, shape, and/or dimension(s). In other implementations, modules 102 can comprise different sizes, shapes, and/or dimensions. For instance, a first module 102 can be the size and/or shape of two smaller modules placed adjacent and/or connected to one another. Modules 102 can comprise and/or be a square, rectangle, and/or any other suitable (geometric or other) shape.

One will appreciate that a wall system 100 according to various implementations of the present disclosure can be oriented in any suitable orientation, including diagonal, vertical or substantially vertical, and/or horizontal or substantially horizontal, wherein the term "substantially" indicates allowable, acceptable, or other deviation(s) from a perfect or other precise orientation. For instance, a substantially vertical orientation can account for small imperfections or errors in the assembly, construction, and/or formation of an upright divider or other wall system 100, including assembling, mounting, constructing, or otherwise assembling the wall system 100. Where appropriate, "substantially" can imply less than 10%, less than 1%, less than 0.1%, or less than 0.01% variability or error relative to a perfect or precise orientation. For instance, a 1% error in vertical orientations (i.e., a 3.6°, 1.8°, or 0.9° deviation) can be substantially vertically oriented in certain implementations. Thus, diagonal orientations comprise those orientations that are neither vertical nor substantially vertical, nor horizontal nor substantially horizontal.

Furthermore, the plurality of wall modules 102 can be arrangeable and/or re-arrangeable into a plurality of configurations resulting in a wall 100 or other barrier, divide, structure or structural component. For instance, the relative positions of wall modules 102*b* and 102*c* can be switched to allow for versatility in aesthetic or other design properties. Indeed, the design and/or components of reconfigurable wall system 100 can allow for any module 102 to be placed, positioned, secured, and/or arranged in any position, orientation, and/or configuration available within system 100. For instance, a first module 102 can be interchangeable, re-arrangeable, and/or replaceable by or with any other module 102.

In some implementations, modules 102 can be shuffled, organized, ordered, and/or arranged in a plurality of vertical and/or horizontal relationships. In at least one implementation, such rearrangement can be made without disassembling the entire wall system 100 and/or certain component(s) thereof. For instance, the vertical relationship between two vertically adjacent modules 102 can be rearranged without changing, disassembling, or otherwise affecting the assembly of modules 102 horizontally or vertically adjacent thereto. For instance, as discussed in further detail below, a module 102 disposed in any position within system 100 can be exchanged for another module 102 without also exchanging one or more of the connection components associated with module(s) 102 adjacent to the position of the exchanged module 102.

In some implementations, modules 102 can be arranged, organized, and/or configured into subunits 112 of the reconfigurable wall system 100. For instance, vertical subunit 112*a* can include four modules 102 configured and/or arranged in a vertical relationship. One will appreciate, however, that subunits 112 and/or modules 102 thereof can comprise and/or be arranged horizontally, diagonally, and/or in any other suitable orientation, shape and/or design configuration. In addition, subunits 112 can include 1, 2, 3, 4, 5, 6, 7, 8, or more modules 102 arranged in any suitable orientation or relationship. For instance, in at least one implementation, subunit 112 can comprise two modules 102 disposed vertically or horizontally (side-by-side). Alternatively, subunit 112 can comprise two upper modules 102 disposed side-by-side and connected to two lower modules 102 disposed side-by-side (e.g., creating a 2×2 modular subunit 112).

As illustrated in FIG. 1, each module 102 of a subunit 112 can be connected and/or attached to another module 102 of the subunit 112 via one or more connection components 104. Thus, the reconfigurable wall system 100 can comprise a plurality of connection components 104. For instance, each module 102 can comprise at least one upper and/or lower connection component 104 spaced apart according to the desired size or dimension of the module 102. An illustrative connection component 104 can be designed to connect, attach, and/or mate with another, adjacent connection component 104 of the wall system 100 or a subunit 112 thereof. For instance, in some implementations, connection components 104 can be designed to connect, attach, and/or mate with (any other) adjacent connection component 104 (regardless of configuration, design, or structural features). Thus, connection components 104 can be universally compatible in some implementations.

In addition, as discussed further herein, connection components 104 may allow for one or more of the modules 102 to be selectively added or removed from the wall system 100 to adjust the height of the wall 100. In some implementations, connection components 104 may allow for one or more of the modules 102 in the middle of the wall 100 to be removed from the wall 100 without disassembling the surrounding portions of the wall 100 in order to replace the middle module(s) 102 or to adjust the height or width of the wall 100. Thus, the height of the wall can be altered by adding or removing modules from interior, central, and/or middle (e.g., non-edge) positions, as opposed to outer, exterior, and/or edge-positioned modules. The width and/or length of wall system 100 can be similarly altered and/or adjusted.

As indicated above, in certain implementations, modules 102 can be about 30.5 cm tall and about 30.5 cm wide. Thus, subunit(s) 112 can be about 30.5 cm wide and about 1.22 meters tall. However, because modules 102 can be any suitable size, subunits 112 can vary widely from one implementation to another. For instance, subunit(s) 112 can be greater than, less than, up to, between, equal to, or about 10 cm, 20 cm, 25 cm, 35 cm, 45 cm, 60 cm, or more and/or any multiple thereof in length and/or width.

Subunits 112 can also have a standard thickness greater than, less than, between, equal to, or about 1 cm, 2.5 cm, 5 cm, 7.5 cm, 10 cm, 12.5 cm, 15 cm, 18 cm, 20 cm, 22 cm, 25 cm, 28 cm, 30 cm, or more. Other standard sizes, measurements, and/or standards can also or alternatively be applied and/or adhered to in some implementations. In some implementations, each subunit 112 is substantially similar and/or identical in size, shape, and/or dimension(s). In other implementations, subunits 112 can comprise different sizes, shapes, and/or dimensions. For instance, a first subunit 112 can be the size and/or shape of two smaller modules placed adjacent and/or connected to one another. Subunits 112 can also comprise and/or be a square, rectangle, and/or any other suitable (geometric or other) shape.

Connection component(s) 104 can comprise an elongated, structurally rigid or semi-rigid component substantially similar in length to the edge length of module 102. Accordingly, connection component(s) 104 can also comprise any suitable size, shape, and/or other measurement or feature suitable to implementations thereof. For instance, connection component 104 can be greater than, less than, up to, between, equal to, or about 10 cm, 20 cm, 25 cm, 35 cm, 45 cm, 60 cm, 100 cm, 120 cm, 122 cm, or more in longitudinal length. By way of illustration, certain connection component(s) 104 can have a height and/or thickness of greater than, less than, up to, between, equal to, or about 1 cm, 2.5 cm, 5 cm, 7.5 cm, 10 cm, 12.5 cm, 15 cm, 18 cm, 20 cm, 22 cm, 25 cm, 28 cm, 30 cm, or more in a first and/or second direction. For instance, connection component(s) 104 can be approximately 2 cm in a first (e.g., vertical) direction and/or approximately 10 cm in a second (e.g., horizontal) direction. Other connection component(s) 104 can be oppositely and/or otherwise configured.

Connection component(s) 104 can comprise a rigid or semi-rigid, resilient material. For instance, connection component 104 (and/or other components of system 100) can comprise aluminum, steel, thermoplastic (e.g., reinforced thermoplastic). More specifically, connection component 104 (and/or other components of system 100) can comprise an extruded, die-cast, injection-molded, milled, manufactured, fabricated or otherwise formed structural component. A manufacturer can fabricate, for instance, an aluminum extrusion that has any desired profile, which can create attributes, functionality, utility, and structural properties unique to each connection component 104. Importantly, each connection component 104 can be fabricated so as to be universally connectable to and/or compatible with any other connection component 104. Other materials can also be used to form connection component 104 without departing from the scope of this disclosure. For instance, connection component 104 can comprise wood, stone, or any other natural or synthetic material suitable for use therein.

Modules 102 can also include and/or be clad with one or more tiles 106, such as a (solid) wall panel, glass pane, functional component, and/or display member. Tiles 106 can comprise and/or be made of wood, plastic, metal, fabric, textile, fiber, fiberglass, plaster, drywall, glass, resin, and/or other suitable material without departing from the scope of this disclosure. In some implementations, a tile can comprise a plurality of such materials. In addition, a plurality of different types of tiles can be arranged in a desired fashion to achieve a desired aesthetic or other purpose. For instance, reconfigurable wall system 100 and/or subunit(s) 112 thereof can include a plurality of modules 102 respectively having a combination of glass and wall tiles 106 arranged such that a consistent, random, alternating, and/or patterned (regular or irregular) configuration is displayed on a viewing surface or face thereof. As illustrated in FIG. 1, for instance, the modules 102 of wall system 100 have been configured such that various arrangements of adjacent glass tiles **106*a* and wall tiles 106*b* can be observed. Glass tiles 106*a* and/or wall tiles 106*b* can be translucent, transparent, or opaque in various implementations. Accordingly, a variety of functional and aesthetic combinations can be available by arranging a plurality of modules 102** in various relationships.

As indicated above, in at least one implementation, tile 106 can comprise and/or include a functional component or cassette configured to provide additional utility to the wall system 100. Exemplary functional components, including those known in the art, include but are not limited to video monitors, audio speakers, shelves, mounting elements, control panels, access ports, outlets, and other utility-providing members. Functional components can also provide (additional) aesthetic properties and/or qualities without departing from the scope of this disclosure. For instance, tile 106 can comprise artwork or a design feature having a particular color, pattern, texture, etc. thereon. In certain implementations, tile 106 can comprise a (picture) frame and/or matting configured to receive an insert.

A functional component can be at least partially housed within, mounted onto, attached to, or otherwise received by at least a portion of tile 106 and/or module 102 in some implementations. For instance, in at least one implementation, a functional component (e.g., video monitor) can be associated with a glass tile **106*a* such that the functional component can be viewed through the glass tile 106*a*. In an alternative implementation, the functional component can be received by a wall tile 106*b*. For instance, the functional component can be mounted, attached, or connected to, or otherwise associated with the exterior surface of a solid or other wall tile 106*b***.

The functional component can also (or alternatively) be placed and/or secured within an opening, aperture, void, hollow, recess, groove, channel, or other area or region of the tile 106 configured to receive the functional component therein. For instance, a wall tile **106*b* can comprise an opening or recess therein or area into which the functional component can be placed, mounted, and/or secured such that the functional component can be displayed and/or accessible on or within wall tile 106*b* of module 102*c*. Furthermore, a functional component can, in certain implementations, replace, provide, and/or behave as a tile 106. For instance, the functional component itself, or component(s) thereof, can be attached directly or indirectly to module 102, wall system 100, and/or component(s) thereof (e.g., by fitting such functional component with one or more connection component(s) 104**).

As discussed in further detail below, in some implementations, a tile 106 can be mounted, secured, and/or attached to an outer edge or component of a module 102 and/or connection component(s) 104 thereof. In some implementations, tiles 106 can be mounted, secured, and/or attached to both or opposing outer edges or components of a module 102 and/or connection component(s) 104 thereof. For instance, tiles 106 can be mounted, secured, and/or attached to both or opposing outer terminal edges of opposing connection components 104. Similarly, tiles 106 can be mounted, secured, and/or attached to both or opposing outer sides of a single connection component 104.

Alternatively and/or additionally, one or more tiles 106 can be mounted, secured, and/or attached to one or more inner or outer components and/or within one or more inner or outer mounting channels and/or tile receiving elements of a module 102 and/or connection component(s) 104 thereof. For instance, in at least one implementation, a glass tile 106*a* can be mounted within respective inner channels of upper and/or lower connection components 104 of (each) module 102*a* that includes a glass tile 106*a*. Wall tiles 106*b* can also be mounted within inner channels of upper and/or lower connection components 104. The inner and/or outer channel(s) can be positioned (centrally or peripherally) along connection component 104. Likewise, a wall tile 106*b* can be mounted to the respective outer edges of upper and/or lower connection components 104 of (each) module 102*c* that includes a wall tile 106*b*. Glass tiles 106*a* can also be mounted to outer edges in some implementations.

A module 102 can comprise a plurality of tiles 106. For instance, module 102*c* can comprise an outer or inner wall tile 106*b* and an inner or outer glass tile 106*a* (not shown). In some implementations, an outer glass tile 106*a* can transparently or translucently cover an inner wall tile 106*b* (or functional component thereof) to provide a desired aesthetic. Similarly, a module can comprise opposing tiles 106 in certain implementations. For instance, a module can comprise opposing wall tiles 106*b*, glass tiles 106*a*, or any suitable combination thereof, including stacked layers or multiple tiles on one or more sides or portions of module 102. Wall tiles 106*b* and glass tiles 106*a* can also comprise a texturing, finish, or other surface detail as necessary to create a desired aesthetic.

Figure 2:
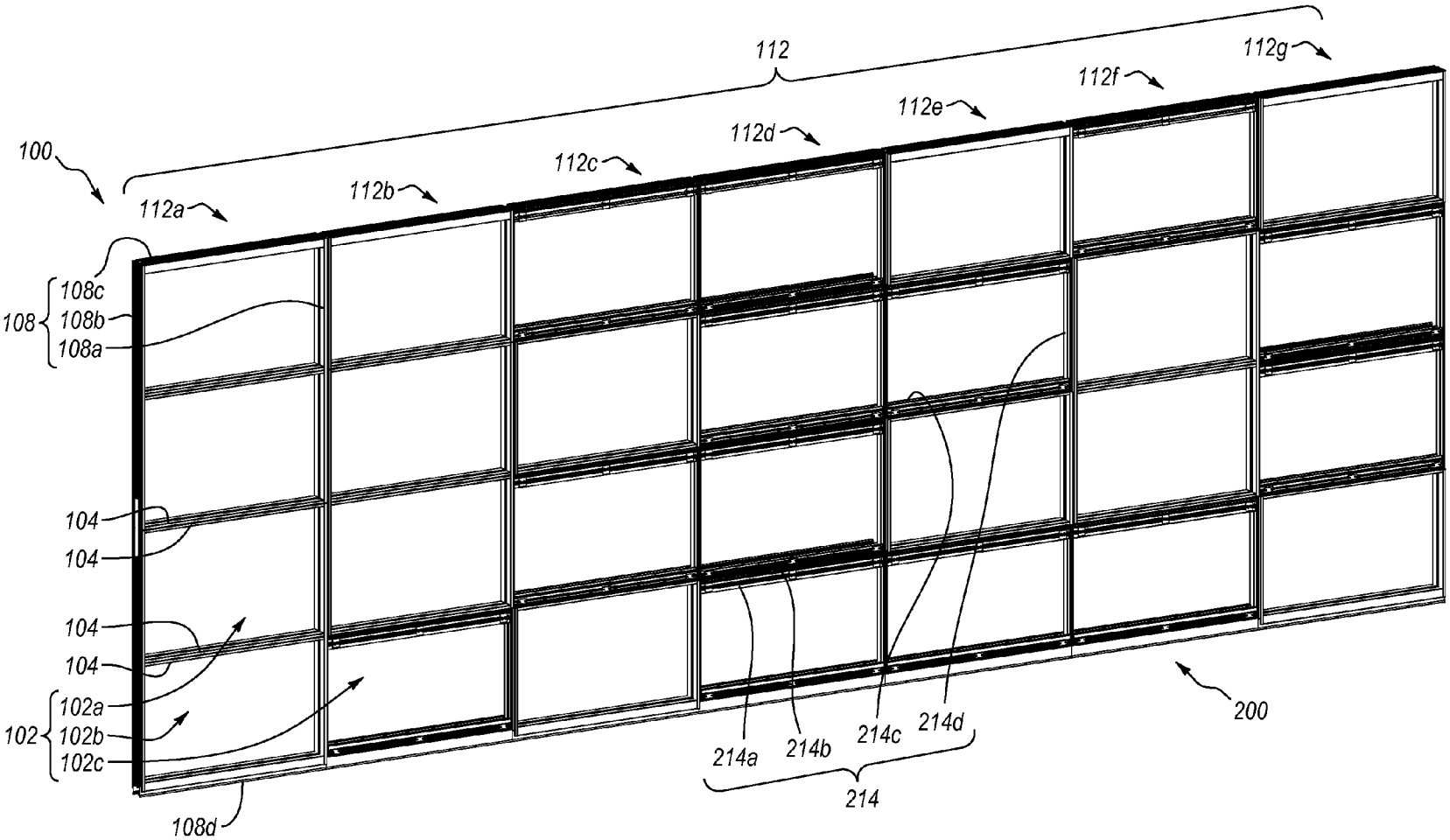
FIG. 2 illustrates a perspective view of a frame used to create the wall system shown in FIG. 1.
Figure 3A:
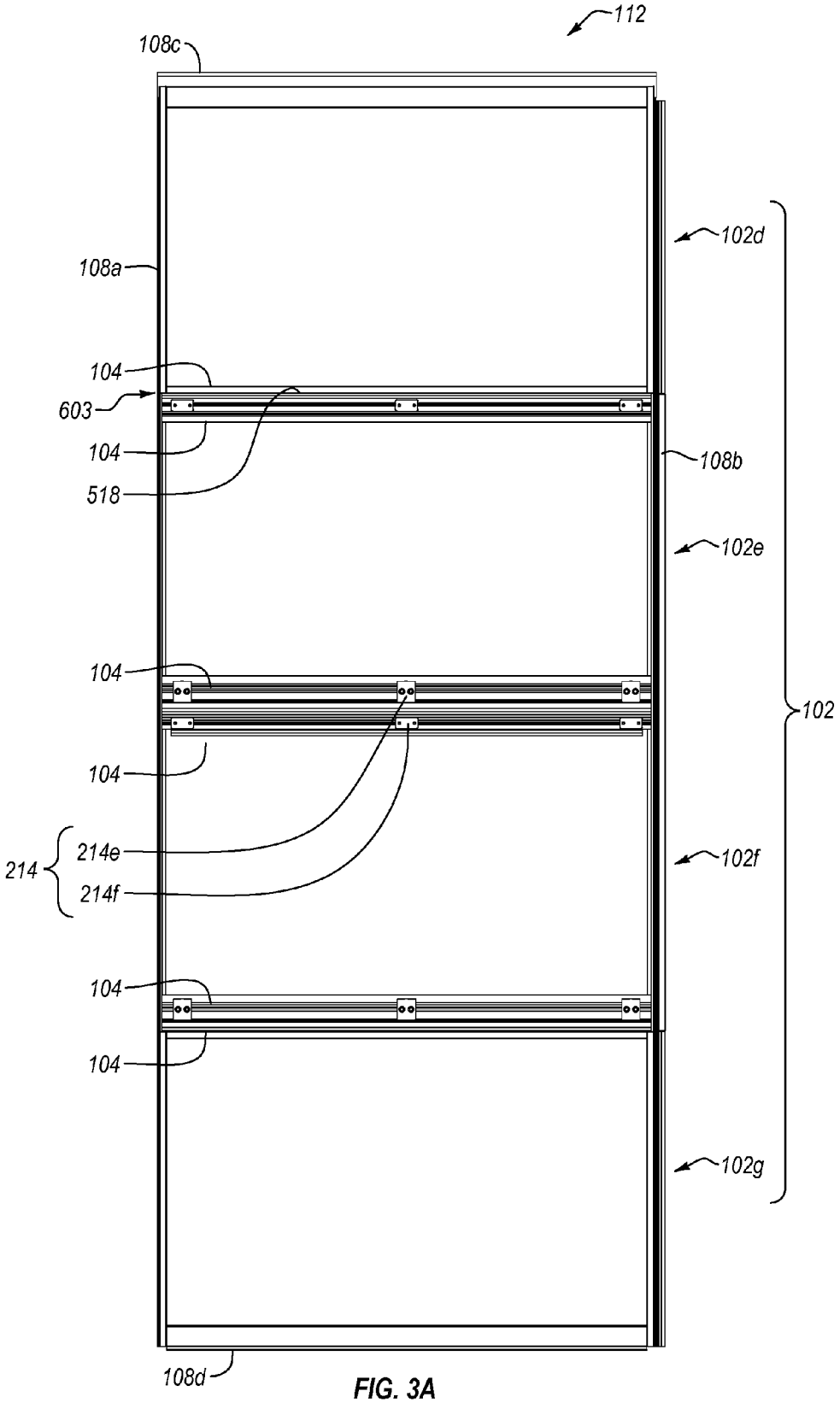
FIG. 3A illustrates a front facing view of a portion of the frame shown in FIG. 2.

In one or more implementations, reconfigurable wall system 100, or a module 102 or connection components 104 thereof configured to receive a wall tile 106*b* includes one or more tile attachment elements (see e.g., tile attachment element 214 of FIGS. 2 and 3A). Illustrative tile attachment elements can include one or more clips, fasteners, clamps, screws, and/or other attachment member capable of attaching a wall tile 106*b* to the connection component 104. Glass tiles 106*a* can also be attached to respective connection components 104 by means of one or more tile attachment elements. Tile attachment elements can also include one or more channel inserts or other channel-associated attachment members configured to receive one or more tiles 106 and/or to secure one or more tiles 106 within one or more channels.

Reconfigurable wall system 100 can also include one or more frame elements 108. In some implementations, frame elements 108 are configured to provide support, structure, connection, or other attribute(s) to the wall system 100 and/or modules 102 or multi-module subunits 112 thereof. For instance, a first frame element 108*a* can be configured to provide internal structure, support, and/or rigidity to the wall system 100 and/or module(s) 102 or subunit(s) 112 thereof and/or to connect adjacent modular subunits 112, such as subunits 112*a* and 112*b*. One or more additional frame elements 108, such as frame elements 108*b* and 108*c*, can be configured to surround, support, and/or define the outer perimeter of the wall system 100 and/or module(s) or subunit(s) thereof.

In at least one implementation, reconfigurable wall system 100 includes at least one vertical frame element 108*a* and/or at least one horizontal frame element 108*c*. Vertical frame element(s) 108*a* can divide, separate, support, and/or provide structure to or form one or more subunits 112 and/or module(s) 102 thereof. For instance, vertical frame element(s) 108*a* can span the height of wall system 100 and/or provide separation and/or support between subunits 112*a* and 112*b*. Vertical frame element(s) 108*b* can also or alternatively provide an end cap for reconfigurable wall system 100 or a subunit 108 and/or modules 102 thereof.

In an alternative implementation, one or more modules 102 can include at least one vertical frame element 108. For instance, one or more modules 102 can include a first vertical frame element 108*a* disposed on a first side thereof and a second vertical frame element 108*b* disposed on a second side thereof. First and/or second vertical frame elements 108 can extend the height of module 102 in some implementations. Module 102 can also include an upper connection component 104 and a lower connection component 104. Thus, module 102 can comprise a box-frame and/or structurally-independent unit configured to be connected and/or attached to one or more adjacent modules 102 (e.g., without any intervening frame component). In other implementations, however, a vertical frame element 108 can be disposed between subunits 112 and/or modules 102 (including optional vertical frame element(s) 108 thereof).

As illustrated in FIG. 1, subunit 112 can include a plurality of vertically arranged modules 102. Each module 102 can include an upper connection component 104 and/or a lower connection component 104. In at least one implementation, a lower connection component 104 of a first, upper module 102*a* can be connected with and/or to an upper connection component 104 of a second, lower module 102*b*.

Figure 6A:
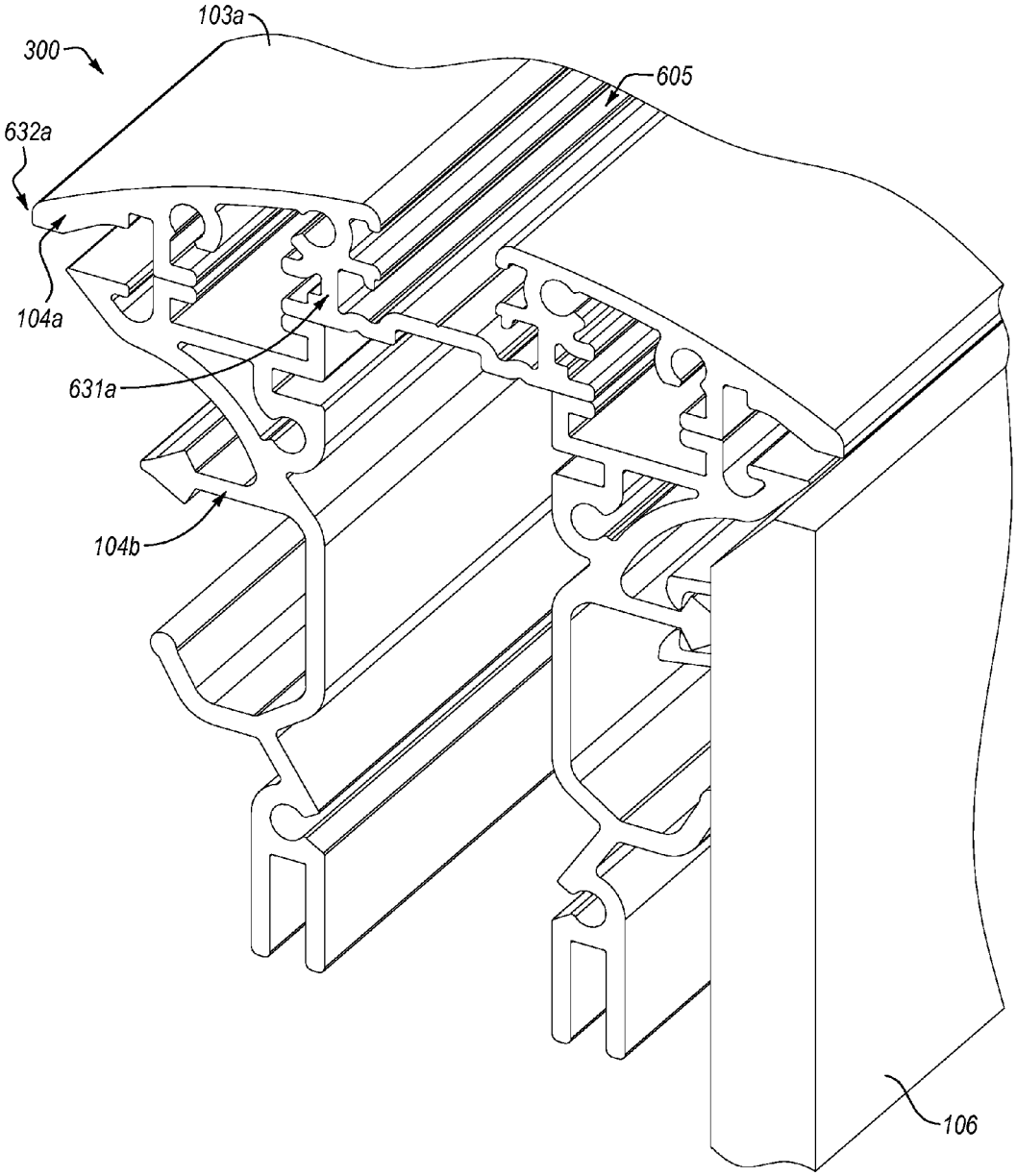
FIG. 6A illustrates a perspective view of an assembly of components of an exemplary wall system according to one or more implementations of the present disclosure.
Figure 6B:
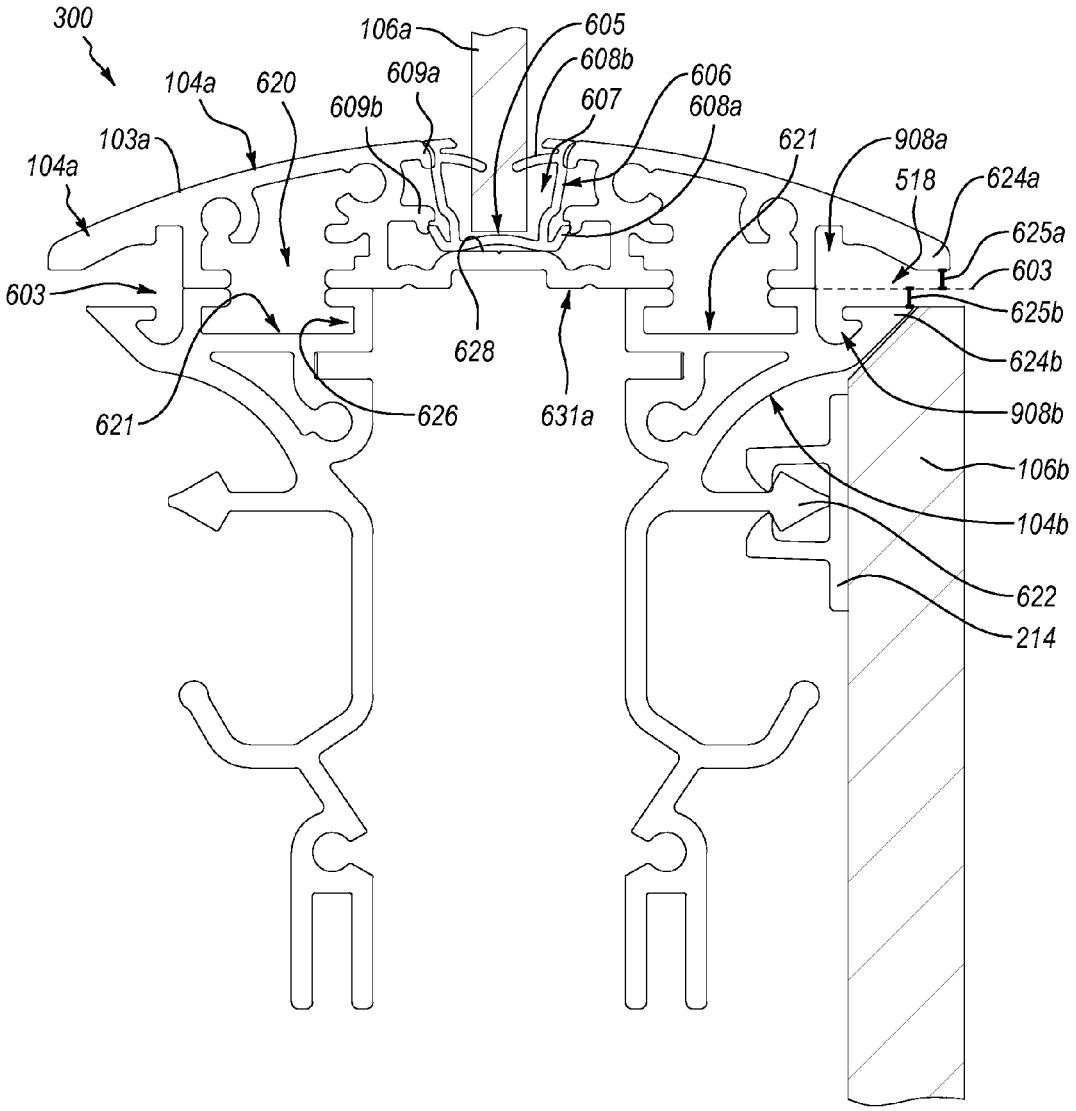
FIG. 6B illustrates a cross-sectional view of the assembly shown in FIG. 6A having additional components according to one or more implementations of the present disclosure.
Figure 6C:
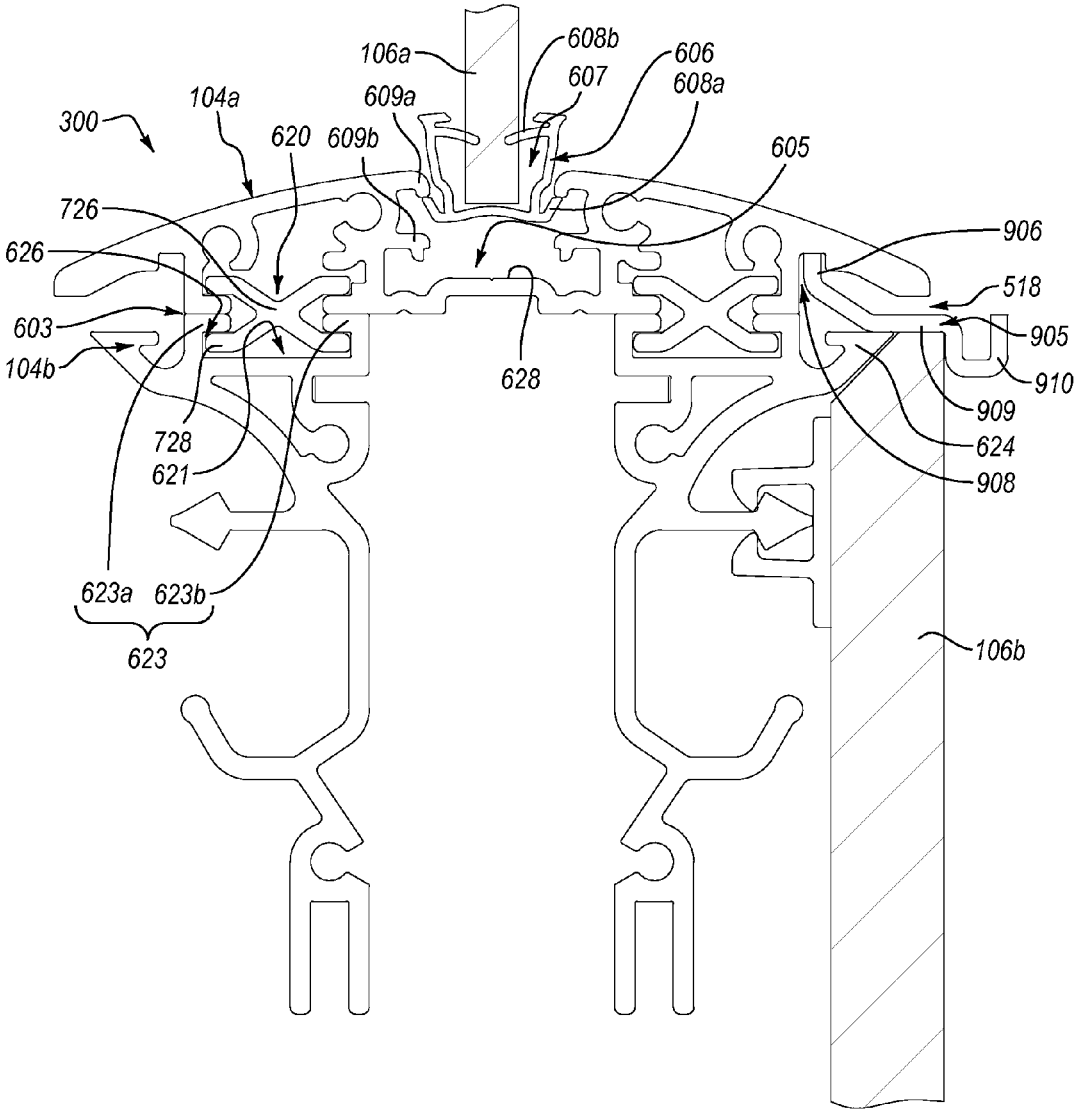
FIG. 6C illustrates a cross-sectional view of an alternative configuration of the assembly shown in FIG. 6B having additional components according to one or more implementations of the present disclosure.
Figure 6D:
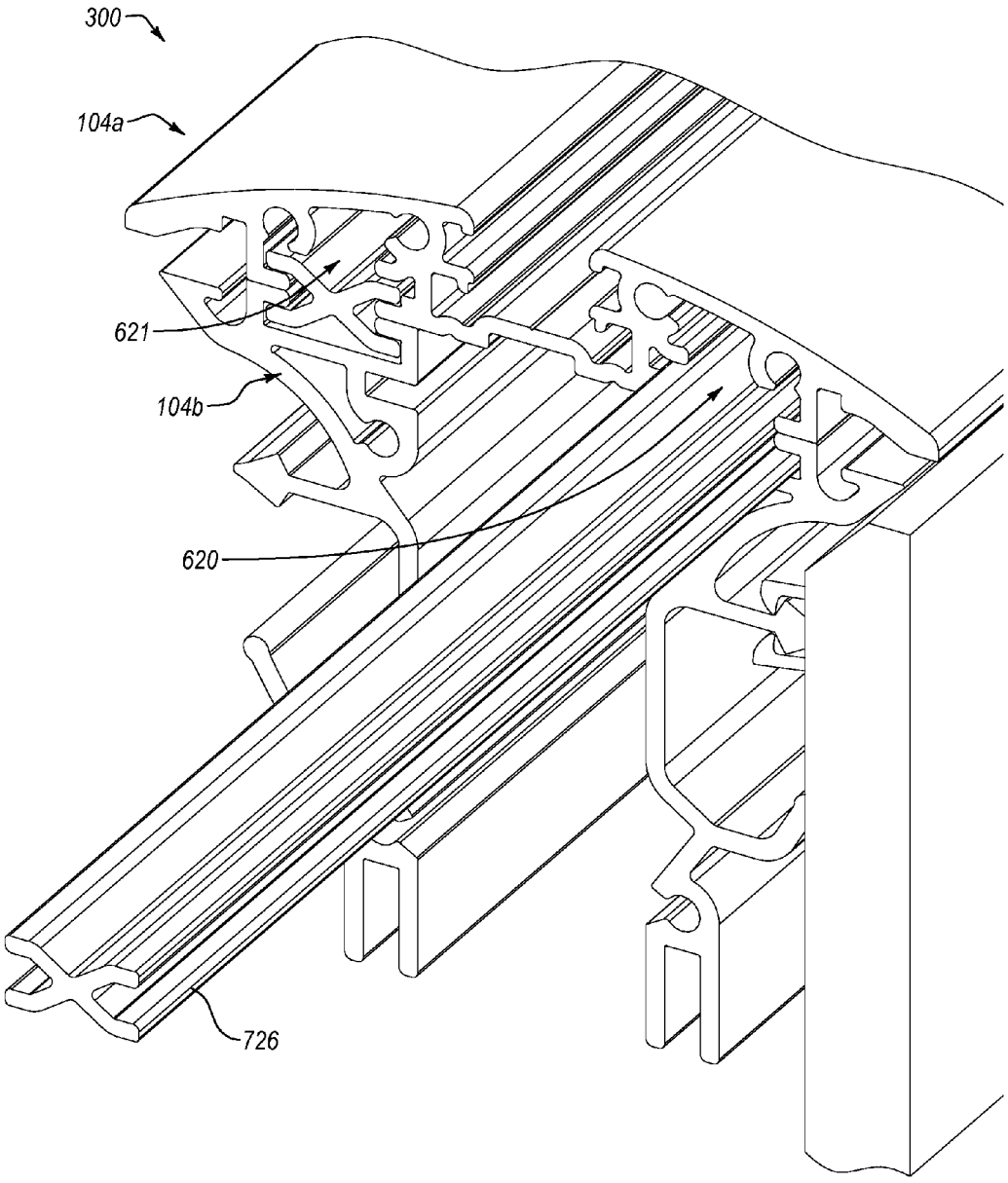
FIG. 6D illustrates a cross-sectional view of the assembly shown in FIG. 6A having additional components partially assembled according to one or more implementations of the present disclosure.
Figure 7:
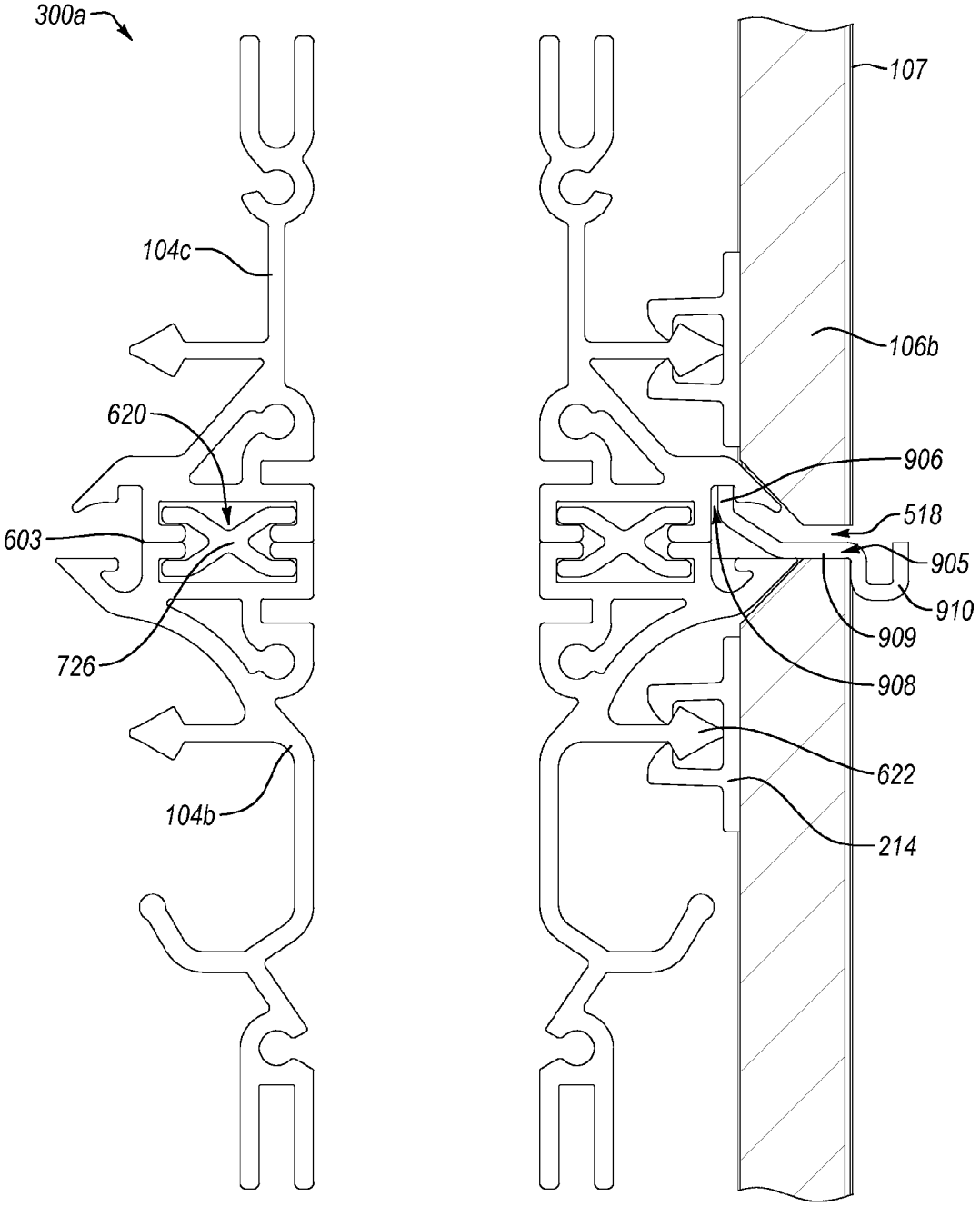
FIG. 7 illustrates a cross-sectional view of another assembly of components of an exemplary system according to one or more implementations of the present disclosure.

Adjacent connection components 104 can be selectively and/or reversibly secured one to another by means of one or more connection interface components (see e.g., connection interface component 726 of FIGS. 6C, 6D, and 7). Illustrative connection interface components can include or otherwise comprise an elongated and/or extruded attachment mechanism or member. In one implementation, a connection interface component fits securely within respective channels (see e.g., channel 621 of FIG. 6C) of adjacent connection components 104 such that the connection components 104 are held, secured, attached, connected, and/or mounted to each other.

In at least one implementation, frame element 108 can comprise or be a connection component 104. For instance, vertical frame component 108*a* and/or 108*b* can comprise vertically-oriented connection component(s) 104, having one or more attributes thereof (described above). Thus, frame elements 108 can be adapted for universal compatibility. Similarly, frame elements 108 can be adapted or configured with one or more compatible attachment interfaces and/or channels. Likewise, frame elements 108 can be adapted or configured to receive one or more connection interface components (e.g., for securing adjacent modules 102 or frame elements 108 thereof).

As will be appreciated, in at least one implementation, a reconfigurable wall system 100 includes two modules 102 placed adjacent and connected to one another via one or more connection components 104. For instance, a first module 102, which includes at least one tile having an upper connection component 104 and a lower connection component 104 attached thereto, can be connected to a second module 102 comprising at least one tile 106 having an upper connection component 104 and a lower connection component 104 attached thereto. The connected first and second modules 102 can be supported on one or more sides by at least one frame element 108. Frame element(s) 108 can surround the connected first and second modules 102 entirely or partially, or otherwise connect thereto. Alternative, each module 102 can comprise opposing vertical frame elements 108 connected to the at least one tile 106.

Thus, it will be appreciated that a module 102 according to implementations of the present disclosure can comprise a variety of configurations. For instance, as indicated above, a module 102 can include at least one tile 106 clad between upper and lower connection components 104. Thus, modules 102 can be stacked atop one another in a vertical relationship. Alternatively, a module 102 can include at least one tile 106 clad between left and right connection components 104. Thus, modules 102 can be placed beside each other in a horizontal relationship. Regardless, one or more frame elements 108*a* can be disposed between adjacent modules in certain implementations. Accordingly, wall system 100 can comprise a plurality of modules 102 that are universally interchangeable in their vertical and/or horizontal position, orientation, and/or relationship.

In an alternative implementation, a module 102 can comprise an arrangement of connection components 104 with or without a tile attached thereto. For instance, as illustrated in FIG. 2, wall system 100 can comprise a frame 200. Frame 200 can comprise a plurality of modules 102, each module comprising a connection component 104, optionally attached (vertically) to one or more adjacent connection component 104 of an adjacent module 102. Similarly, each connection component 104 can be attached and/or secured (horizontally) to one or more connection components of one or more adjacent modules 102 (e.g., via one or more frame elements 108).

Therefore, in at least one implementation, the connection and/or attachment of a plurality of connection components 104, together with one or more optional frame elements 108, forms a modular wall frame 200. Each module 102 of frame 200 can comprise at least one of an upper connection component 104 and/or a lower connection component 104. Thus, a module 102 can comprise two connection components 104 separated by a distance, in certain implementations. In addition, a module 102 can comprise upper and lower connection components 104 and opposing vertical frame elements 108, forming an independent module adapted and/or configured for attachment (or to be attached) vertically and/or horizontally to adjacent module(s) 102. Alternatively, a module 102 can comprise two connection components 104 attached at an interface.

As illustrated in FIG. 2, modular wall frame 200 comprises seven modular subunits 112*a* through 112*g* in a horizontally adjacent relationship, each of which comprises four modules 102 in a vertically adjacent relationship. Accordingly, wall system 100 can comprises seven modular subunits 112*a* through 112*g* in a horizontally adjacent relationship, each of which comprises four modules 102 in a vertically adjacent relationship. The inner boundary of each subunit 112 can be defined by one or more vertical frame elements 108*a* extending between upper and lower ends or portions thereof. Similarly, frame end element 108*b* can define the outer (left side) edge of modular subunit 112*a* and, therefore, modular wall frame 200 and/or wall system 100. A similar frame end element 108 can define the outer (right side) edge of modular subunit 112*g* and, therefore, modular wall frame 200 and/or wall system 100.

In some implementations, an upper and/or ceiling frame element 108*c* can define the upper edge of one or more modules 102, subunits 112, and/or modular wall frame 200. Likewise, a similar lower, floor, and/or sub-floor frame element 108 can define the lower edge of one or more modules 102, subunits 112, and/or modular wall frame 200. One will appreciate in light of the disclosure herein that modular wall frame 200 can adopt and/or comprise other configurations, including number, orientation, and arrangement of modules and/or subunits without departing from the scope of the disclosure.

In an alternative implementation, each module 102 can include one or more (e.g., opposing) frame elements 108. Thus, inner frame element 108*a*, outer frame end element 108*b*, upper frame element 108*c*, and/or lower frame element 108*d* of frame 200 can comprise a plurality of frame elements 108 (e.g., at least one for each module 102). In some implementations, wall system 100 and/or frame 200 thereof can comprise a plurality of modular frame elements 108 (e.g., for each module 102) and can also include one or more inner, outer, upper, and/or lower frame elements 108 (e.g., for each subunit 112, frame 200, and/or wall system 100). Thus, in at least one implementation, (i) module 102 can comprise one or more connection components 104 and/or one or more frame elements 108 (e.g., opposing upper and lower horizontal connection components 104 and opposing left and right vertical frame elements 108), (ii) subunit 112 can comprise one or more (e.g., a plurality of) modules 102, optionally having one or more inner frame element 108*a*, outer frame end element 108*b*, upper frame element 108*c*, and/or lower frame elements 108*d* connected or attached thereto (e.g., surrounding subunit 112), and/or (iii) frame 200 (or wall system 100) can comprise one or more (e.g., a plurality of) modules 102 (and/or subunits 112), optionally having one or more inner frame element 108*a*, outer frame end element 108*b*, upper frame element 108*c*, and/or lower frame elements 108*d* connected or attached thereto (e.g., surrounding frame 200 or wall system 100).

FIG. 2 also illustrates tile attachment elements 214 for securing a tile 106 (not shown) to frame 200 or one or more connection components 104 and/or one or more frame elements 108 thereof. In some implementations, a tile attachment element 214*a*, 214*b* can be configured for securing a glass, wall, and/or other tile, including a functional component, to an exterior region, element, and/or component of the wall system 100 or frame 200 thereof. In other implementations, interior mounting of such tiles can be achieved through the use of one or more tile attachment elements 214*c*, 214*d*. For instance, tile attachment elements 214*c* and/or 214*d* can include one or more channel inserts or other channel-associated attachment members configured to receive one or more tiles 106 and/or to secure one or more tiles 106 within one or more channels.

Figure 3B:
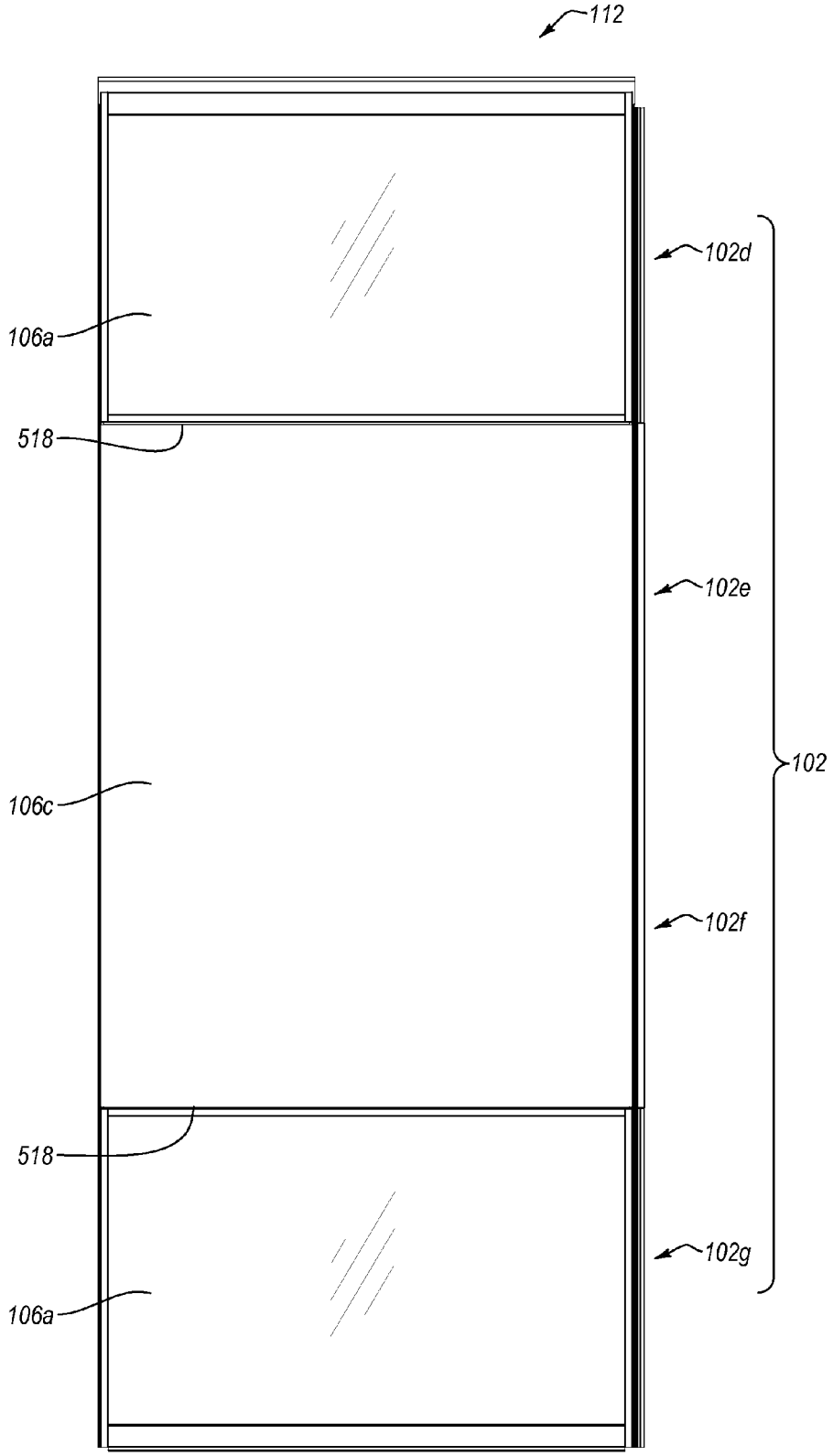
FIG. 3B illustrates a front facing view of a portion of the wall system shown in FIG. 1.

FIGS. 3A and 3B illustrate a (modular) subunit 112 comprising four connected modules 102*d*, 102*e*, 102*f*, 102*g* without (See FIG. 3A) and with (See FIG. 3B) tile(s) 106 attached to each of the modules 102. By way of illustration, FIG. 3A illustrates modules 102*d* and 102*e* (or connection components 104 thereof) are connected at interface 603 and form a channel 518. FIG. 3B illustrates a first glass tile 106*a* of module 102*d*, a wall tile 106*c* spanning modules 102*e* and 102*f*, and a second glass tile 106*a* of module 102*g*. In an alternative implementation, tile 106*c* can span a single module 102 that is the size of modules 102*e* and 102*f*, combined. Such a combined module 102 can similarly comprise an upper connection component 104 and a lower connection component 104, and can optionally include one or more intermediate connection components 104 (e.g., for securing an intermediate portion of tile 106*c*).

Thus, modular wall system 100 and/or subunit 112 thereof can comprise a plurality of modules 102 of identical, similar, and/or different sizes and/or shapes. Similarly, subunit 112 can comprise 1, 2, 3, 4, or more modules 102 in some implementations. Subunit 112 can be or comprise a single (vertical) column of modules 102, as illustrated in FIGS. 3A and 3B. Alternatively, subunit 112 can be or comprise a single (horizontal) row of modules 102, or a plurality of adjacent rows and/or columns of modules 102. In at least one implementation, subunit 112 can serve as, function as, be, and/or comprise a wall system 100, module 102, or other structural component.

It will be appreciated from FIG. 3A that a variety of differently configured or designed connection components 104 can be incorporated into modular wall system 100, subunit 112, and/or module 102 thereof. Thus, as noted above, modules 102 and/or connection components 104 thereof can be universally compatible and/or comprise universally compatible interfaces. Accordingly, in at least some implementations, connection components 104 can be reordered, reorganized, and/or rearranged without requiring a complete overhaul of the system or replacement of otherwise suitable connection components 104.

In addition, as illustrated in FIG. 3B, modules 102*d* and 102*e*, as well as modules 102*f* and 102*g*, can have a channel 518 disposed therebetween. In particular, as illustrated in FIG. 3A, connection components 104 can form channel 518 at a connection interface. FIG. 3A further illustrates tile attachment elements 214*e* and 214*f* (attached to connection components 104) for securing a tile 106*c* to (an exterior or outer portion of) connection components 104, module 102, and/or subunit 112.

Subunit 112 and/or modules 102 thereof can also comprise one or more frame elements 108. For instance, each module 102, subunit 112, or wall system 100 can have (opposing) vertical frame elements 108 extending between upper and lower connection components 104. Vertical frame elements 108 can comprise inner frame element(s) 108*a* and/or outer frame element(s) 108*b*. In addition, each module 102, subunit 112, or wall system 100 can have (opposing) horizontal frame elements 108 extending. Horizontal frame elements 108 can comprise upper frame element(s) 108*c* and/or lower frame element(s) 108*d*.

Figure 4:
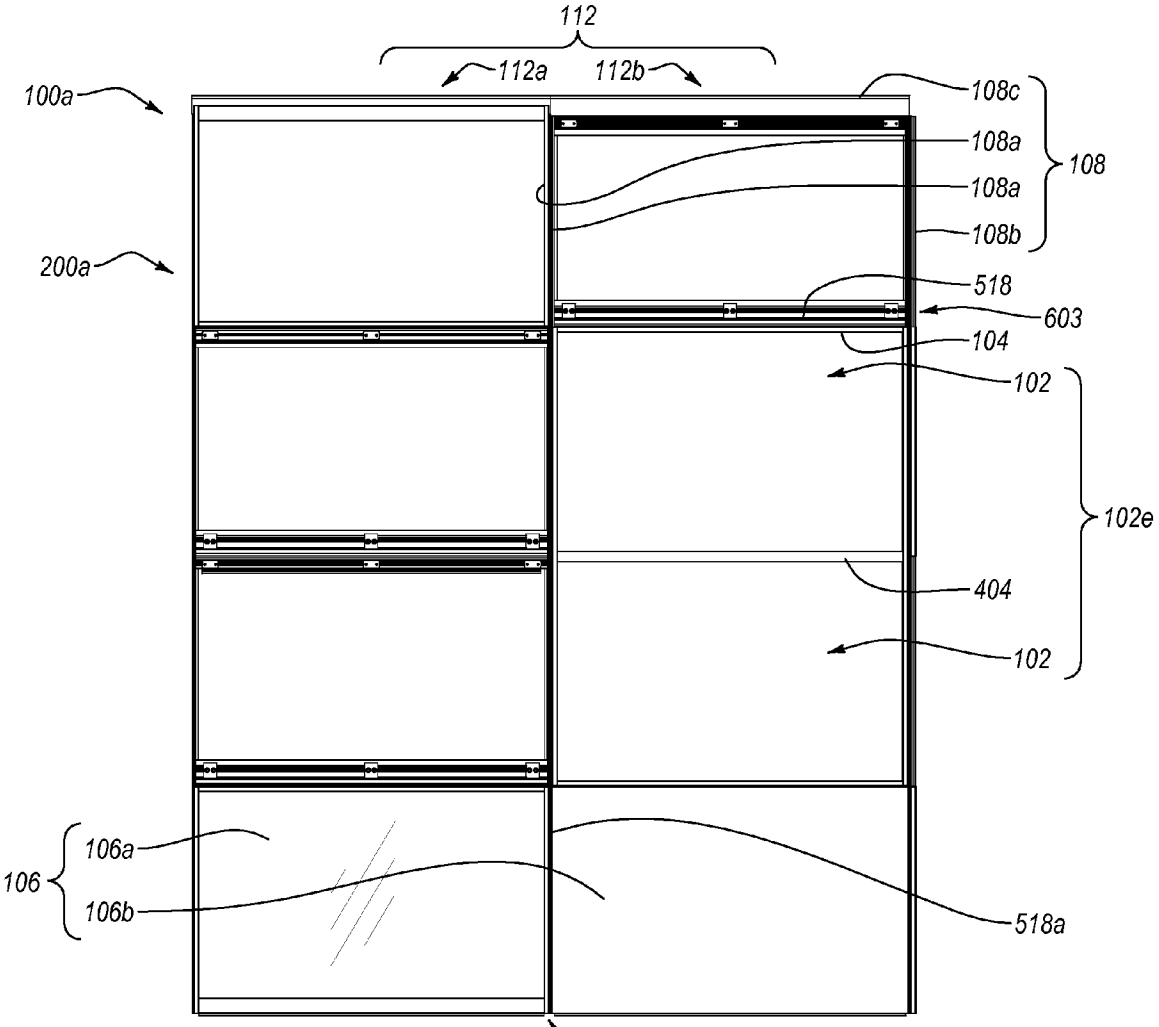
FIG. 4 illustrates a front facing view of a partial wall system according to one or more implementations of the present disclosure.

FIG. 4 illustrates a modular wall 100*a* comprising a frame 200*a* and including a first subunit 112*a* and a second subunit 112*b* connected at an interface 416 via inner frame elements 108*a*. One will appreciate, however, that a single intervening and/or supporting frame element 108*a* is also contemplated herein. Furthermore, frame element 108*c* can be configured to substantially span the (top) length of the connected subunits 112*a*, 112*b* in certain implementations. Similarly, frame element 108*b* can be configured to substantially span the (side) height of the connected subunits 112*a*, 112*b* in certain implementations.

Modular wall 100*a* can comprise one or more channels 518 (disposed between modules 102 or connection components 104 thereof) and/or one or more channels 518*a* (disposed between modules 102 or frame elements 108 thereof). In some implementations, two modules 102 can share a common connection component 104 or other structural member 404 without departing from the scope of this disclosure. Structural member 404 can also optionally include one or more channels 518. Such a structural member 404 can be extruded, die-cast, injection-molded, milled, fabricated, manufactured, or otherwise formed as a single, unitary piece, element, or member that does not require a connection interface component (e.g., a connection interface component 726, as illustrated in FIG. 6C, to secure a first connection component 104 to a second connection component 104). In an alternative implementation, structural member 404 can divide and/or is disposed at an intermediate position of a single, double-sized module 102*e* such that one, two, or more tiles 106 can be attached to the single module 102*e*. Module 102*e* can be the size of two or more smaller modules 102 in some implementations.

One will appreciate in light of the disclosure herein that a reconfigurable wall system 100, according to certain implementations, can comprise any suitable number of modules 102, arranged in any suitable number of subunits 112, including columns, rows, or other spatial, geometric, or other design. Thus, in some implementations, subunit(s) 112 can be arranged as horizontal row(s) or other grouping arrangement(s) configured to simplify installation, removal, and/or reconfiguration of the system 100. For instance, in at least one implementation, system 100*a* can comprise a 2-by-4 subunit of another reconfigurable wall system 100. In addition, modular subunits 112*a* and 112*b* can comprise a single subunit 112 in some implementations.

Modules 102 can each comprise one or more tiles 106. One or more tiles 106 can be centrally mounted about, between, and/or within one or more upper and/or lower connection components 104. For instance, a transparent or translucent glass, resin, and/or other tile 106*a*, for example, can be centrally and/or peripherally mounted about, between, and/or within an upper connection component 104 and/or a lower connection component 104. Alternatively and/or additionally, one or more wall tiles 106*b* can be mounted, attached, and/or secured to an exterior surface and/or region of the connection component(s) 104, module(s) 102, subunit(s) 112, and/or wall system 100. Wall tiles 106*b* can also be centrally and/or peripherally mounted, and glass tiles 106*a* can the exteriorly mounted.

In certain implementations, module(s) 102 can be one- or two-sided (e.g., in display properties). For instance, modules 102 can have an optional finished wall surface on both sides or a finished wall surface on one side only. Module(s) 102 can also comprise more than two (display) sides and/or elements, such as a protruding tile or other display element. In some implementations, each module 102 can comprise at least one tile 106. Tile(s) 106 (e.g., wall tiles 106*b*) can be covered or otherwise finished with a surface display element such as a wood veneer, vinyl or laminate overlay or coating, colored film, etc. (See e.g., surface finishing 107 of wall tile 106*b* of FIG. 7). In at least one implementation, each module 102 comprises at least one glass or other tile 106*a* and/or at least one solid or other wall tile 106*b*. One will appreciate that a module 102 comprising a plurality of glass or other tiles 106*a*, a plurality of wall tiles 106*b*, and/or a plurality of different tiles 106 is also contemplated herein.

Furthermore, at least one module 102 can comprise a first tile 106 on a display side of the wall system 100, and a second tile 106 on a non-display side of the wall system 100. Alternatively, at least one module 102 can comprise a first tile 106 on a display side of the wall system 100, and no tile 106 on a non-display side of the wall system 100. Other implementations can include a wall system 100 having two display sides. In such implementations, it can be appropriate to provide one or more modules 102 having one or more glass tiles 106*a* and/or first and/or second opposing wall tiles 106*b*, each of which includes a transparent, translucent, finished, and/or opaque surface and/or a display element. Display elements can include any type, style, and/or manner of color, design, decoration, image, or other desirable display property; including substantially colorless display property. Tiles 106 can be positioned, for instance, on a non-display side of wall system 100 and can optionally comprise a non-display finish.

Certain tiles 106 can be limited to the size, shape, dimensions, or other configuration of the module 102 to which it belongs and/or is secured. In some implementations, each module 102 of the modular wall system 100 comprises a uniform or substantially uniform (or similar) size. Thus, modules 102 can be congruent in shape, size, and/or compatibility. Other tiles 106, however, can be designed and/or configured to adorn, attach to, or otherwise be associated with a plurality of modules 102 and/or extend beyond the size and/or shape of a module 102. For instance, certain implementations can comprise a tile 106*c* (See FIG. 3B) spanning two or more modules 102 and/or subunits 112 of wall system 100. Similarly, glass tiles 106*a*, display and/or wall tiles 106*b*, and other tiles 106 can also be configured to span a plurality of modules 102, including two, three, four, and so forth. Indeed, in at least one implementation, a tile 106 can span the entire length, height, and/or other dimension or measurement of a wall system 100 or subunit 112 thereof.

In some implementations, module 102 can include a wall tile 106*b* mounted to the exterior surface, edge, and/or region of one or more connection components 104 and/or frame elements 108. Thus, in certain implementations, tile(s) 106 can be configured to hide, substantially conceal, and/or reduce the visibility of at least part(s) of one or more modules 102, connection components 104, and/or frame elements 108. Such exterior-mounted tiles 106 (e.g., tiles 106*b*) can comprise wood, plaster, and/or any other material disclosed herein or otherwise suitable. Transparent and/or translucent glass, resin, or other tile(s) 106*a* can also or alternatively be exterior-mounted.

Some implementations can include one or more tiles 106 mounted in, within, or otherwise about the interior region of one or more connection components 104 and/or frame elements 108. For instance, glass tile 106*a* can be centrally or peripherally mounted between connection components 104. Furthermore, a plurality of tiles 106 (e.g., 106*a* and/or 106*b*, or a combination thereof) can be centrally or peripherally mounted between connection components 104. Thus, in certain implementations, tile(s) 106 can be configured to display, reveal, and/or permit the visibility of at least part(s) of one or more modules 102, connection components 104, and/or frame elements 108. Such interior-mounted tiles 106 can comprise glass, resin, and/or any other material disclosed herein or otherwise suitable. Opaque tile(s) 106 (e.g., tiles 106*b*) can also or alternatively be interior-mounted.

Certain implementations can include a channel 518 (e.g., 518, 518*a*) or other space or opening between first and second modules 102 (See also, FIGS. 3A-3B). Channel 518 can be formed at the connection interface 603 between two connection components 104 and/or the interface 416 between two frame elements 108 (e.g., channel 518*a*). In some implementations, channel 518 can be exposed through the space between two installed tiles 106. Accordingly, channel 518 can be accessible from the exterior surface of a wall system 100.

In some implementations, channel 518 can comprise a receiving channel, and thus, can be configured to house, secure, and/or receive a functional, display, and/or other object, component, member, or element. Such components can include, for example, one or more: cantilevers or object mounting elements; LED or other lighting elements (e.g., lighting strips), which can be powered by elements internal to the wall structure in some implementations; magnetic elements or strips; tackable elements, comprised of wood, cork, or other material, and which can be used to attach or affix other objects thereto; tubing or other conduit or channel material, component, or element configured to permit passage of matter therethrough; and any other functional component (including decorative components), whether known in the art or otherwise available.

In some implementations in which channel 518 has one or more lighting elements disposed therein, the one or more lighting elements may be used to provide one or more functions. By way of example, the one or more lighting elements may be used to illuminate a space defined by the wall system 100. In at least one implementation, the illumination can provide enough light in the space to allow occupant(s) to be able to see. In some implementations, the illumination may provide a guide or directions through the space (e.g., when the space is a hallway). The one or more lighting elements may also be used to provide aesthetics to the space defined by the wall system 100. For instance, the color or level of lighting (e.g., dim, bright, etc.) provided by the one or more lighting elements may be altered or otherwise used to set or change the aesthetics of the space defined by the wall system 100.

In some implementations, the one or more lighting elements may be used for communication purposes. For instance, the one or more lighting elements may be used to identify the status of the space defined by the wall system 100. The status of the space defined by the wall system 100 may include whether the space is occupied or available. In one exemplary implementation, the color of the one or more lighting elements may be changed to indicate the status of the space defined by the wall system 100. The status of the space may be communicated by the lighting elements by having the lighting elements unlit or lit, or light with a specific color.

For example, if the space is occupied or otherwise unavailable, the lighting elements in the channel 518 on the exterior and/or interior of the wall system 100 (i.e., outside and/or inside of the defined space) may be lit and/or lit with a specific color (e.g., red). In contrast, if the space is not occupied or is otherwise available, the lighting elements in the channel 518 on the exterior and/or interior of the wall system 100 (i.e., outside and/or inside of the defined space) may be unlit and/or lit with a specific color (e.g., green). Similarly, the lighting elements may be used to communicate other messages. For instance, the lighting elements may be lit with a specific color (e.g., red) to indicate that there is an emergency. The one or more lighting elements may also be lit and/or unlit in certain patterns to communicate messages (e.g., emergency, occupied, available, etc.).

In addition, the lighting element can comprise an LED or other message board or strip in certain implementations. For instance, the lighting element can display advertisements, instructions, directions, news, updates, text, etc. Similarly, the lighting element can display arrows, characters, figures, or any other suitable images for a specific purpose or effect. Thus, the lighting element(s) within channel 518 can provide a variety of aesthetic, functional, informative, or other utilities. Additional uses will be apparent to those skilled in the art or by practice of the present disclosure.

As discussed in further detail below, in at least one implementation, channel 518 can receive a gap-sealing or other functional component or member configured to cover, close, block, seal, or prevent fluid or other access to at least a portion of the channel 518. Such a sealing member can prevent dust, water, debris, and/or other materials or substances from entering and/or being retained within channel 518. Where necessary and/or appropriate, such functional components can provide, comply with, and/or adhere to building or other code or regulation. For instance, functional components can comply with and/or adhere to hospital or other healthcare or other facility rules, regulations, and/or building codes. Thus, a receiving channel 518 (as well as any other channel or channel member, etc. described and/or disclosed herein) can be configured to receive one or more functional components of any suitable nature or variety.

As indicated above, channel and/or receiving channel 518 can also (or alternatively) comprise a cantilever or other channel configured to allow objects to be hung and/or supported therefrom. For instance, a cantilever channel 518 at the interface between two (e.g., upper and lower) modules 102 (and/or connection component(s) 104 or frame element(s) 108 thereof), or between tiles 106 of and/or attached to the same, can allow for various accessories or mill work to be supported by a wall system 100, 100*a* (and/or subunit(s) 112 and/or module(s) 102 thereof) on the outside thereof at convenient locations that can be adjusted as needed. Thus, as discussed in greater detail below, cantilever channel 518 can comprise a shared cantilever channel between two or more connection components 104, modules 102, subunits 112, walls, and/or systems 100, 100*a*.

It is noted that while reference can be made in this disclosure to a specific type of channel (e.g., receiving channel, cantilever channel, etc.), additional functions, purposes, configurations, and uses are contemplated herein. Thus, reference to a specific type of channel should not be construed as limiting application of said channel to the particular function expressed and/or implied by the channel type thereof.

Channel 518 can comprise an opening or gap into the channel portion or element of the channel 518. The channel opening or gap can comprise any height, width, length, radius, diameter, circumference, perimeter, and/or other dimensional measurement suitable for implementations thereof. In some implementations, the opening or gap can be relatively small compared to the size of the module (e.g., a fraction of the size of the length, width, height, etc. of the module). In some implementations, the opening or gap can be designed to reduce visibility thereof. For instance, the opening or gap can be greater than, less than, up to, between, equal to, or about or approximately 9 mm, 7 mm, 4 mm, 3 mm, 2 mm, or 1 mm. In other implementations, the opening or gap can be designed and/or configured to allow a certain size, gauge, etc. cantilever to pass therethrough, enter therein, and/or access the cantilever channel 518. For instance, openings or gaps can range in size from 1-100 mm or more, 10-100 cm or more, or 1-10 m or more without departing from the scope of this disclosure.

Thus, wall systems 100 described herein can also or alternatively include relatively large structures, buildings, pods, modules, and/or components and are not limited to conventional size, interior walls or wall modules customarily found in office, commercial, and/or industrial space, or other divided spaces known in the art. Such structures and/or structural components can be configured and/or reconfigured according to systems and methods described herein. For instance, portable classroom pods, storage containers, emergency or disaster relief housing, etc. can comprise modules and/or subunits of a modular system of connected modules or pods in one or more planes and/or directions. Thus, modules 102 of a wall system 100 can comprise 3-dimensional rooms, voids, spaces, etc. Such modules can include walls comprising connection components 104 and/or frame elements 108 and can be universally compatible, such that assembly and/or reconfiguration of a variety of such modular structures are possible. Other applications and implementations for systems, methods, and apparatus described and/or disclosed herein will be apparent to those skilled in the art in light of the subject matter, disclosure, and/or descriptions found herein.

Cantilever channel 518 can also be configured to support a substantial or other amount of weight without causing significant damage, disassembly, or other undesirable alteration to the wall system 100 and/or one or more subunits 112, modules 102, connection components 104, and/or frame elements 108. For instance, cantilever channel 518 and/or component(s), module(s), subunit(s), wall(s), and/or system(s) incorporating and/or implementing the same, can be configured to support between 1 pound and 2000 pounds or more of gravitational, lateral, and/or other weight and/or torque (e.g., without structural failure, dissociation, and/or disassembly of the same). In particular, certain implementations can be configured to support at least 700 pounds or more of such weight or torque. In at least one implementation, a specific number of pounds per linear-, square-, or cubic-foot or other measurement can be supported thereby. For instance, certain implementations can be configured to support at least 700 pounds or more of such weight (or torque) per (or every) 48 inches, illustratively. Thus, wall system 100 can support desktops, work surfaces, appliances, shelves, and/or any other suitable and/or desirable objects using cantilever channel(s) 518.

In at least one implementation, cantilever channel 518 comprise a substantially continuous channel across the length, width, height, and/or other distance or measurement of one or more modules 102 and/or subunits 112. In certain implementations, at least one cantilever channel 518 runs the entire length of wall system 100. Thus, one or more objects can be supported by and/or hung from wall system 100 at any desirable position along the length and/or height thereof. In other implementations, each module can optionally form a separate channel 518 at an interface with an adjacent module 102. Thus, a centrally-positioned module 102 can form an upper, lower, left side, and/or right side channel 518 at the interface(s) with adjacent module(s) 102.

Figure 5:
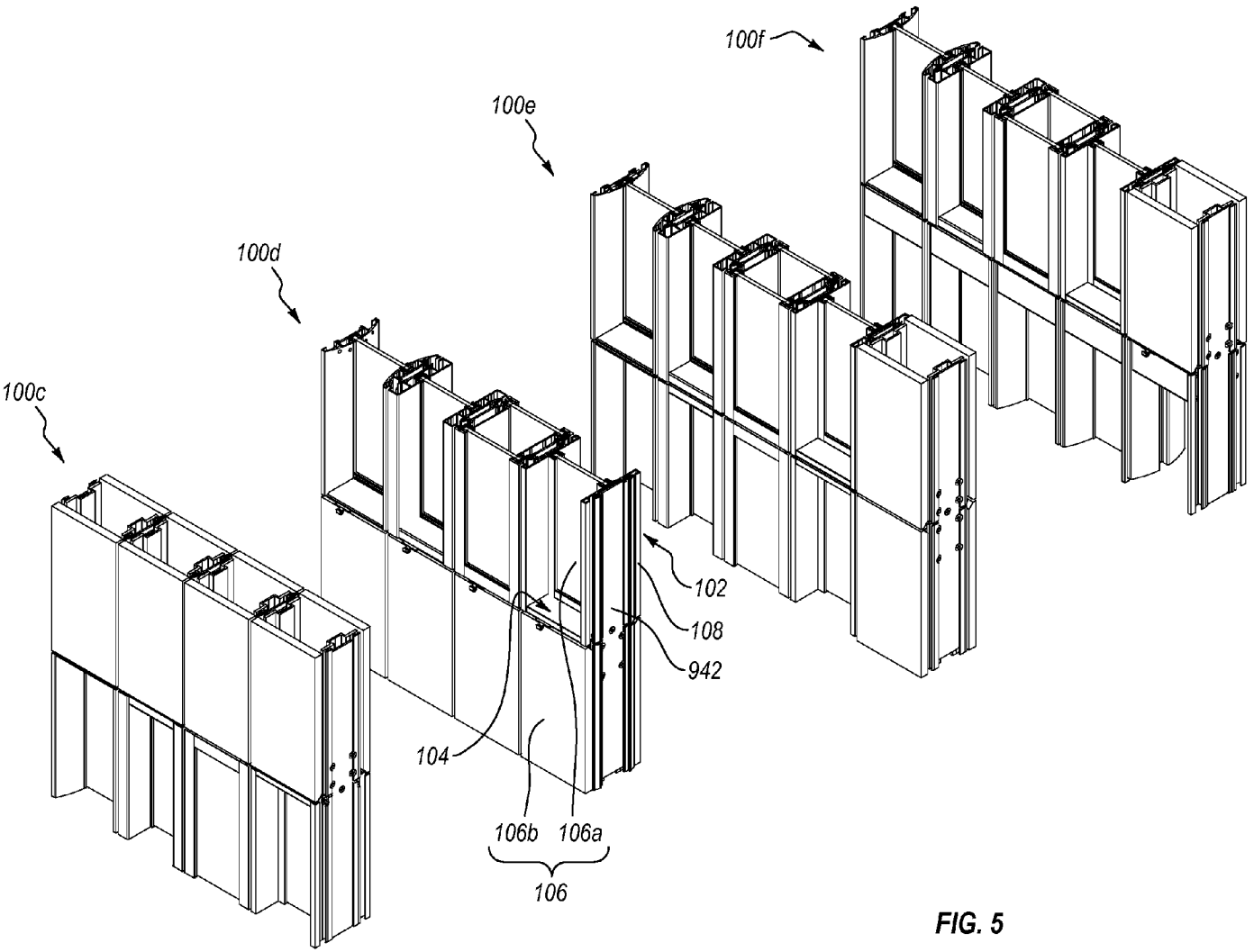
FIG. 5 illustrates a perspective view of an arrangement of four exemplary wall systems according to implementations of the present disclosure.

FIG. 5 illustrates an arrangement of four modular wall systems 100*c*, 100*d*, 100*e*, and 100*f*, respectively. Each modular wall system 100*c*, 100*d*, 100*e*, and 100*f* comprises a unique arrangement of upper and lower modules 102 having various configurations or implementations of connection component(s) 104, frame element(s) 108, and/or tile(s) 106. For instance, certain modules 102 include a central, channel-mounted glass tile 106*a*. Other modules 102 include opposing, channel-mounted glass tiles 106*a*. Some modules 102 include opposing, exterior-mounted wall tiles 106*b*. Another module 102 is void of or does not include a tile. In one or more implementations, each modular wall system 100*c*, 100*d*, 100*e*, and 100*f* can comprise a horizontal channel 518 (at the connection interface between upper and lower modules 102 or connection components 104 thereof) and/or a vertical channel 518*a* (at the connection interface between left and right modules 102 or frame elements 108 thereof).

It will be appreciated that modules 102 can include additional connection components 104 in some implementations. For instance, one or more of the upper modules 102 of modular wall systems 100*c*, 100*d*, 100*e*, and 100*f* can have an upper connection component 104 (not shown) similar, identical, or different in configuration and/or design to lower connection component 104. Similarly, one or more of the lower modules 102 of modular wall systems 100*c*, 100*d*, 100*e*, and 100*f* can have a lower connection component 104 (not shown) similar, identical, or different in configuration and/or design to upper connection component 104. In addition, or alternatively, modular wall systems 100*c*, 100*d*, 100*e*, and 100*f*, or one or more modules 102 thereof, can include upper, lower, and/or outer side frame elements (not shown). Modules 102 can also be structurally supported by one or more splines 942 or other reinforcing members that can be attached to, between, and/or about one or more frame elements 108.

Connection components 104 and/or frame elements 108 can be specifically adapted for receiving tile(s) 106 and/or accommodating a specific configuration. For instance, certain connection components 104 and/or frame elements 108 can be configured to receive a single tile 106. Other connection components 104 and/or frame elements 108 can be configured to receive a plurality of (e.g., a pair or opposing) tiles 106. In addition, some connection components 104 and/or frame elements 108 can present or comprise a specific design feature or configuration. For instance, some connection components 104 and/or frame elements 108 can present or comprise a curvilinear, rectilinear, or some other design feature or configuration.

It will be appreciated, however, that regardless of specific configuration, each of the modules 102 illustrated in FIG. 5 can be universally and interchangeably compatible one with at least one other module 102, in some implementations. For instance, each connection component 104 can comprise a common or universal interface such that the lower connection component 104 of each upper module 102 is compatible with the upper connection component 104 of each lower module 102 across modular wall systems 100*c*, 100*d*, 100*e*, and 100*f*. Similarly, each frame element 108 can comprise a common or universal interface such that each module 102 is interchangeably horizontally positionable. Specifically, the frame element(s) 108 of each module 102 can be compatible with the frame element(s) 108 of each of the other modules 102 across modular wall systems 100*c*, 100*d*, 100*e*, and 100*f*. Accordingly, any of the upper modules 102 illustrated in FIG. 5 can be removed and replaced by another similarly or differently configured upper modules 102 and/or any of the lower modules 102 illustrated in FIG. 5 can be removed and replaced by another similarly or differently configured lower modules 102.

Moreover, each of the modules 102 illustrated in FIG. 5 can be reoriented (or adapted for being reoriented) in place by removing the module 102, changing the orientation thereof, and reinstalling or reattaching the module 102 in place (such that the left side of module 102 becomes the right side of module 102 when reattached or reinstalled). In at least one implementation, modules 102 can be reoriented such that the top of the module 102 becomes the bottom of the module 102 when reattached or reinstalled.

A variety or designs and/or implementations of various features, elements, members, and/or components of wall systems 100 (or modules 102 thereof) will now be described in further detail. Those skilled in the art will appreciate, however, that the availability of specific designs and/or implementations is not limited by the exemplary embodiments disclosed herein.

FIGS. 6A-6D illustrate an assembly 300 of components of an exemplary system according to implementations of the present disclosure. As illustrated in FIG. 6A, assembly 300 can comprise an upper connection component 104*a* having a tile (or panel) receiving member or element 605. Tile receiving member or element 605 can comprise a channel that is recessed into (curved and/or curvilinear) upper surface 103*a* of connection component 104*a*. As will be discussed in further detail below, the channel can also extend (upwardly) from the surface 103*a* of connection component 104*a*. In other implementations, tile receiving member or element 605 can be otherwise situated, positioned, and/or configured on and/or in connection component 104*a*. For instance, tile receiving member or element 605 need not include a channel and/or need not be associated with upper surface 103*a* in certain implementations. Assembly 300 further comprises lower connection components 104*b* attached to opposite sides of upper connection component 104*a*, and a wall panel 106*b* attached to one of the lower connection components 104*b*.

As illustrated in FIG. 6B, tile receiving member or element 605 can be formed as a channel having one or more tile securing members 609. For instance, tile receiving member or element 605 can have (opposing) tile securing members 609*a* and/or 609*b*. Tile securing members 609 can comprise protrusions extending into channel 605. The protrusions can be substantially linear and/or include hook shaped and portion(s) in some implementations. In addition, assembly 300 can include one or more tile securing or attachment elements 606 (e.g., inserted at least partially into channel 605). For instance, title securing element 606 can be inserted entirely into channel 605 such that one or more channel securing members 608*a* thereof interact with, interlock with, associate with, and/or become (reversibly) secured to tile securing member(s) 609 and/or at least a portion of tile securing or attachment elements 606 contacts end wall 628 of channel 605. In addition, tile securing element 606 can include one or more tile securing members 608*b* adapted for retaining tile 106*a*. For instance, tile securing member(s) 608*b* can extend (inwardly) into a channel 607 of title securing element 606. Accordingly, tile securing member(s) 608*b* can retain tile 106*a* within channel 607 and/or channel securing member(s) 608*a* can retain tile securing element 606 within channel 605.

As illustrated in FIG. 6C, tile securing element 606 need not be inserted entirely into channel 605 (e.g., thereby contacting end wall 628 of channel 605) in some implementations. For instance, title securing element 606 can be inserted partially into channel 605 such that one or more channel securing members 608*a* thereof interact with, interlock with, associate with, and/or become (reversibly) secured to tile securing member(s) 609*a* of upper connection component 104*a*. Importantly, tile securing element 606 can still retain tile 106*a* with channel 607 thereof by means of one or more tile securing members 608*b* (e.g., extend (inwardly) into a channel 607).

Returning to FIG. 6B, (lower) connection components 104*b* can comprise one or more tile or panel attachment members 622. Tile attachment member 622 can comprise a protrusion or other detail configured to receive and/or attach to a tile 106. For instance, tile attachment members 622 can have one or more tile attachment elements 214, such as, for example, a clip, a fastener, a gripper, a hanger, a clamp, a screw, and/or any other suitable attachment member or attachment means capable of attaching a wall tile 106*b* to the connection component 104*b* attached thereto. Glass tiles 106*a* can also be attached to respective connection components 104*b* by means of one or more tile attachment elements 214 connected to one or more tile attachment members 622.

In addition, each of lower connection components 104*b* can be connected to upper connection component 104*a* at an interface 603. Thus, upper connection component 104*a* can be attached to lower connection component 104*b* at interface 603, and vice versa. Connection components 104 (e.g.,

104*a*, 104*b*) can also be connected at a plurality of interfaces (e.g., comprising a connection and/or attachment interface). Upper connection component 104*a* can also be attached to lower connection component 104*b* at a second, similar, same, or different interface 603.

Connection components 104 can also form one or more cantilever or other channels 518 (e.g., at interface 603). Accordingly, assembly 300 can comprise one or more cantilever or other channels 518. For instance, assembly 300 includes opposing first and second cantilever channels 518 (e.g., on opposite sides of assembly 300 or connection components 104 thereof). Cantilever channel 518 can comprise, be comprised of, and/or be formed from one or more channel walls and/or channel members 624 of connection component(s) 104. As illustrated in FIG. 6B, upper connection component 104*a* comprises a first cantilever channel member 624*a*, and the lower connection component 104*b* comprises a second cantilever channel member 624*b*. Thus, the alignment and/or attachment of a plurality of connection components 104 at an interface 603 can form cantilever channel 518 from or of cantilever channel members 624*a*, 624*b*.

It is noted that the terms "align," "alignment," and the like refer to placing two or more objects, features, elements, members, components, etc. in and/or into a position configured to allow for a desired event and/or outcome, and does not necessarily require the congruent, exact, or other perfect matching of such objects in a single or plurality of planes. Thus, two objects can be aligned in separate planes by adjusting the position of one or more of said objects such that they are placed in proximity, interlock, cooperate, and/or correspond one to another. In addition, wherein appropriate, such objects can be placed in a distal configuration without departing from the scope of this disclosure when such distal configuration allows, permits, causes, promotes, and/or leads to a desired event and/or outcome.

In at least one implementation, (proper) alignment, connection, and/or attachment of connection components 104 (e.g., at or by means of alignment or formation of an attachment interface channel 620, as discussed below) results in a properly aligned and/or formed channel 518 and/or other components or features described herein. Furthermore, properly aligned connection components 104 can have, comprise, display, and/or present a number of characteristics. For instance, properly aligned connection components 104 can respect and/or conform to interface 603 such that no part or portion of connection components 104 crosses the interface. In addition, opposing channel members 624*a* and 624*b* can be withdrawn or recessed relative to interface 603. For instance, first channel members 624*a* can be set back a first distance 625*a* relative to interface 603 and/or second channel members 624*b* can be set back a second distance 625*b* relative to interface 603. First distance 625*a* and second distance 625*b* can be (substantially) equal, similar, or different in various implementations. First distance 625*a*, second distance 625*b*, and/or the sum total distance thereof can be less than, greater, up to, at least, equal to, between, or about 1 mm, 2 mm, 3 mm, 4 mm, 5 mm, 6 mm, 7 mm, 8 mm, 9 mm, 10 mm, 12 mm, 15 mm, 20 mm, or more in some implementations. Alternatively, such distances can be on the order of centimeters in certain implementations.

Upper connection component 104*a* can also comprise a (first) cantilever channel recess 908*a* and/or lower connection component 104*b* can comprise a (second) cantilever channel recess 908*b*. Cantilever channel recesses 908 and be adapted to receive a portion of a cantilever or other insert therein. For instance, as illustrated in FIG. 6C, a terminal or tail end 906 of cantilever 905 can be secured into cantilever channel recess 908 when the cantilever 905 is properly inserted into cantilever channel 518. Cantilever 905 can also include a body portion 909. When cantilever 905 is properly inserted into cantilever channel 518, body portion 909 can be secured against and/or rest upon at least a portion of lower connection component 104*b* (e.g., channel member 624) and/or tile 106*b*. Cantilever 905 can also include an outer and/or functional end 910. Functional end 910 can comprise a hook or other attachment mechanism for securing one or more items thereto.

As shown in FIGS. 6B and 6C, connection components 104 can also include one or more interface channels 621. In at least one implementation, channel 621 can include one or more recessed portions 626. In some implementations, two or more interface channels 621 can align and/or come together to form an attachment (or attachment interface) channel 620. In an alternative implementation, a first interface channel 621 can align with an attachment element and/or member (not shown) to form an attachment interface element and/or channel 620. Thus, attachment interface channel 620 can comprise and/or be comprised of or formed from one or more interface channels 621 and/or attachment elements (not shown), or combination thereof. Likewise, a plurality of such attachment elements can align and/or cooperate to form an attachment mechanism configured to secure at least a first connection component 104 to at least a second connection component 104 at an attachment interface 603. Thus, a plurality of interface and/or connection interface elements and/or members can align and/or cooperate to provide and/or form an attachment mechanism configured to secure at least a first connection component 104 to at least a second connection component 104 at an attachment interface 603.

As illustrated in FIG. 6C, upper connection component 104*a* can be attached and/or connected to lower connection components 104*b* (at interface 603) via a connection interface component 726. For instance, connection interface component 726 can be received within attachment interface channel 620 (or interface channels 621 thereof) and thereby secure upper connection component 104*a* to lower connection component 104*b*. In at least one implementation, connection interface component 726 comprises a universal connection interface component having a substantially X-shaped cross-section. Suitable alternative configurations for connection interface component 726 will be apparent to those skilled in the art and can depend at least partially on the design of attachment elements or interface channels 621. Thus, connection interface component 726 can be configured to secure two connection components 104 together at interface 603.

Connection interface component 726 can comprise one or more arms or channel engagement elements 728 configured to secure a plurality of connection components 104 together. For instance, one or more arms or channel engagement elements 728 can be adapted for insertion into one or more recessed portions 626 of channel 621. Connection interface component 726 can comprise an X-shaped body having four arms or channel engagement elements 728 extending therefrom. One will appreciate, however, that connection interface component 726 can comprise other shapes and features or elements (e.g., a T-shaped body having three arms, a star-shaped body having five or more arms, an I-shaped body having two arms, etc.) without departing from the scope of this disclosure. Furthermore, connection interface component 726 and/or arms or channel engagement elements 728 can further comprise sub-arms and/or elements extending therefrom. Such features can enhance the effectiveness of connection interface component 726 and/or arms or channel engagement element 728 in some implementations.

Connection interface component 726 and/or arms or channel engagement elements 728 can secure a plurality of connection components 104 together by aligning and securing together one or more channels 621 of the plurality of connection components 104. For instance, connection interface component 726 can be inserted and/or otherwise positioned within attachment interface channel 620, channel(s) 621 thereof, and/or recessed portion(s) 626 thereof. In particular, a first channel engagement element 728 (or portion thereof) of connection interface component 726 can engage a first interface channel 621 (or portion thereof) of lower connection component 104*b*. For instance, lower connection component 104*b* and/or first interface channels 621 thereof can include one or more (inwardly extending) interface component attachment members 623 adapted for receiving channel engagement element 728. In certain implementations, interface component attachment member(s) 623 can form and/or define recessed portion(s) 626.

In at least one implementation, interface component attachment members 623 can substantially prevent movement of connection interface component 726 in at least one direction. For instance, interface component attachment member 623 of lower connection component 104*b* can substantially prevent movement of connection interface component 726 towards upper connection component 104*a*. In addition, upper connection component 104*a* can likewise include one or more interface component attachment members 623. Accordingly, interface component attachment members 623 of upper and lower connection components 104 can substantially prevent separation of properly aligned connection components 104 from their connection at interface 603. Likewise, a second channel engagement element 728 (or portion thereof, or second portion of first channel engagement element 728) of connection interface component 726 can engage a second interface channel 621 (or portion thereof) of upper connection component 104*a*, thereby securing, coupling, connecting, attaching, and/or aligning connection components 104 (or channel(s) thereof).

As illustrated in FIG. 6D, connection interface component 726 can be slideably insertable into and/or removable from the attachment interface channel 620 (or channel(s) 621 thereof). Thus, assembly 300 can be assembled by aligning connection components 104 at interface channels 621 to form an attachment interface channel 620 and inserting a connection interface component 726 therein. Connection interface component 726 can thereby ensure proper alignment of two or more connection components 104 at interface 603.

FIG. 7 illustrates an alternative assembly 300*a* of components of an exemplary system according to one or more implementations of the present disclosure. In particular, opposing upper connection components 104*c* are each attached to respective (opposing) lower connection components 104*b* at an interface 603 via connection interface component 726. One or more tiles 106*b* can be attached or attachable to upper and/or lower connection component(s) 104*b*, 104*c* on one, both, or more sides of assembly 300*a* (e.g., via tile attachment elements/members 214, 622).

Furthermore, in at least one implementation, a cantilever 905 can be provided for securing one or more objects to assembly 300*a*. Cantilever 905 can be positioned within cantilever channel 518 such that an object can be supported therefrom. Cantilever 905 can include a foot or locking element 906 configured to fit securely within a slot or recessed channel 908 of connection component 104*c* or channel 518, such that cantilever 905 is selectively and/or reversibly retained within channel 518.

Connection interface components 726 can also be configured to secure and/or connect connection components 104*b*, 104*c* such that the connection components 104*b*, 104*c* remain attached, connected, and/or secured when a force or weight from the cantilever 905 is applied. For instance, cantilever 905 can induce torsion and/or other force(s) within channel 518. Such a force can bias connection components 104*b*, 104*c* to separate and/or detach. Connection interface components 726 can, therefore, overcome or counter such force and retain connection components 104*b*, 104*c* in a secure, aligned, attached, and/or associated configuration.

Cantilever 905 can have a variety of configurations, lengths, heights, and/or other characteristics. For instance, cantilever 905 can extend longitudinally between opposing (horizontal) ends of a connection component 104. Accordingly, cantilever 905 can extend across a module 102, subunit 112, and/or wall system 100 of the present disclosure. As will be discussed in further detail below, in some implementations, cantilever 905 can extend latitudinally between opposing (vertical) ends of a frame element 108. Cantilever 905 can also have a variety of shapes and/or designs, including shelves, platforms, hooks, and/or other design features as known in the art and described herein. In addition, cantilever 905 can, at least partially, contact and/or rest upon tile 106*b* and/or be supported thereby. Tile 106*b* can, therefore, be configured to at least partially support the weight and/or force applied by the cantilever 905 and/or object(s) attached thereto.

Figure 8:
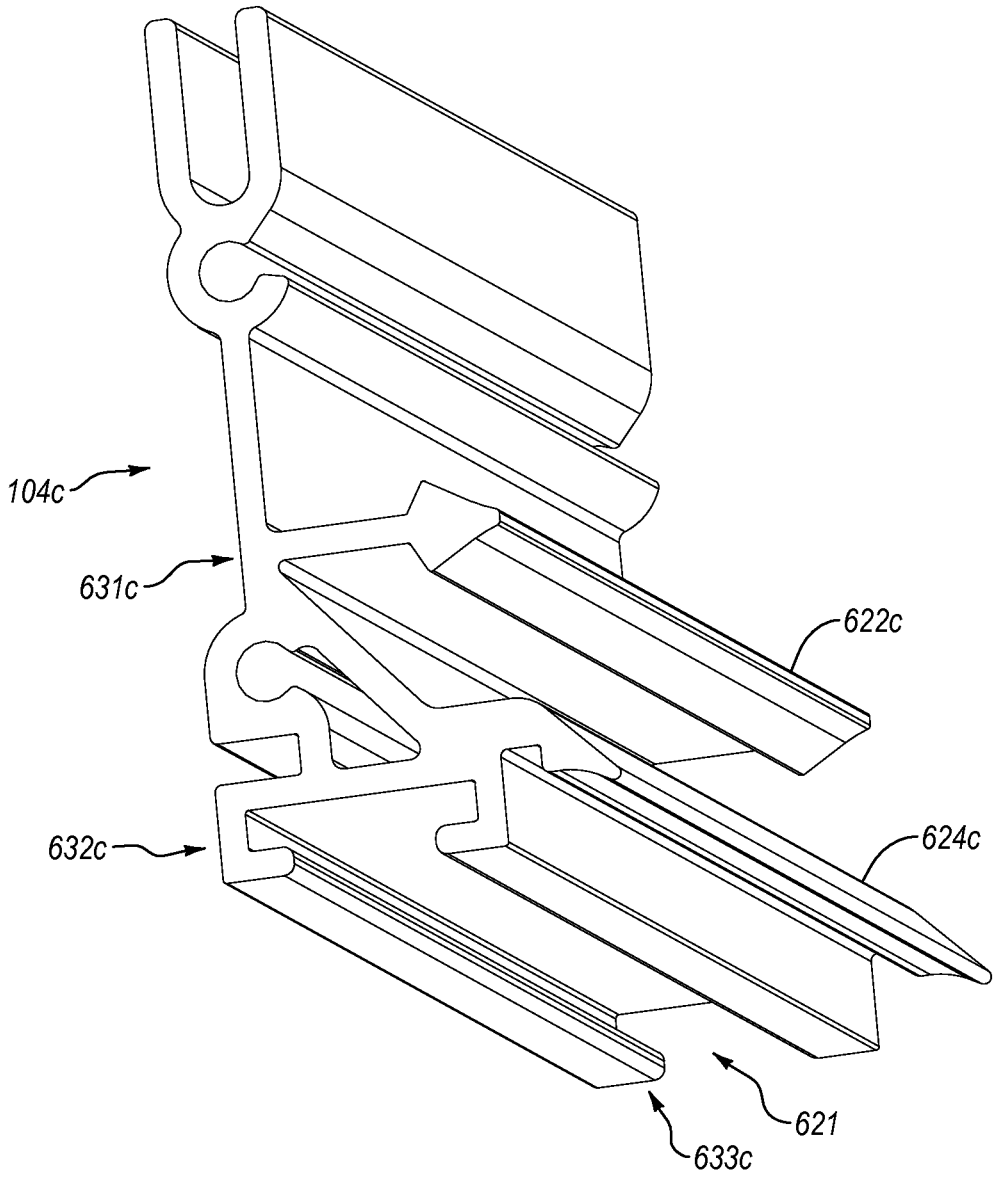
FIG. 8 illustrates a perspective view of one component shown in FIG. 7.
Figure 9:
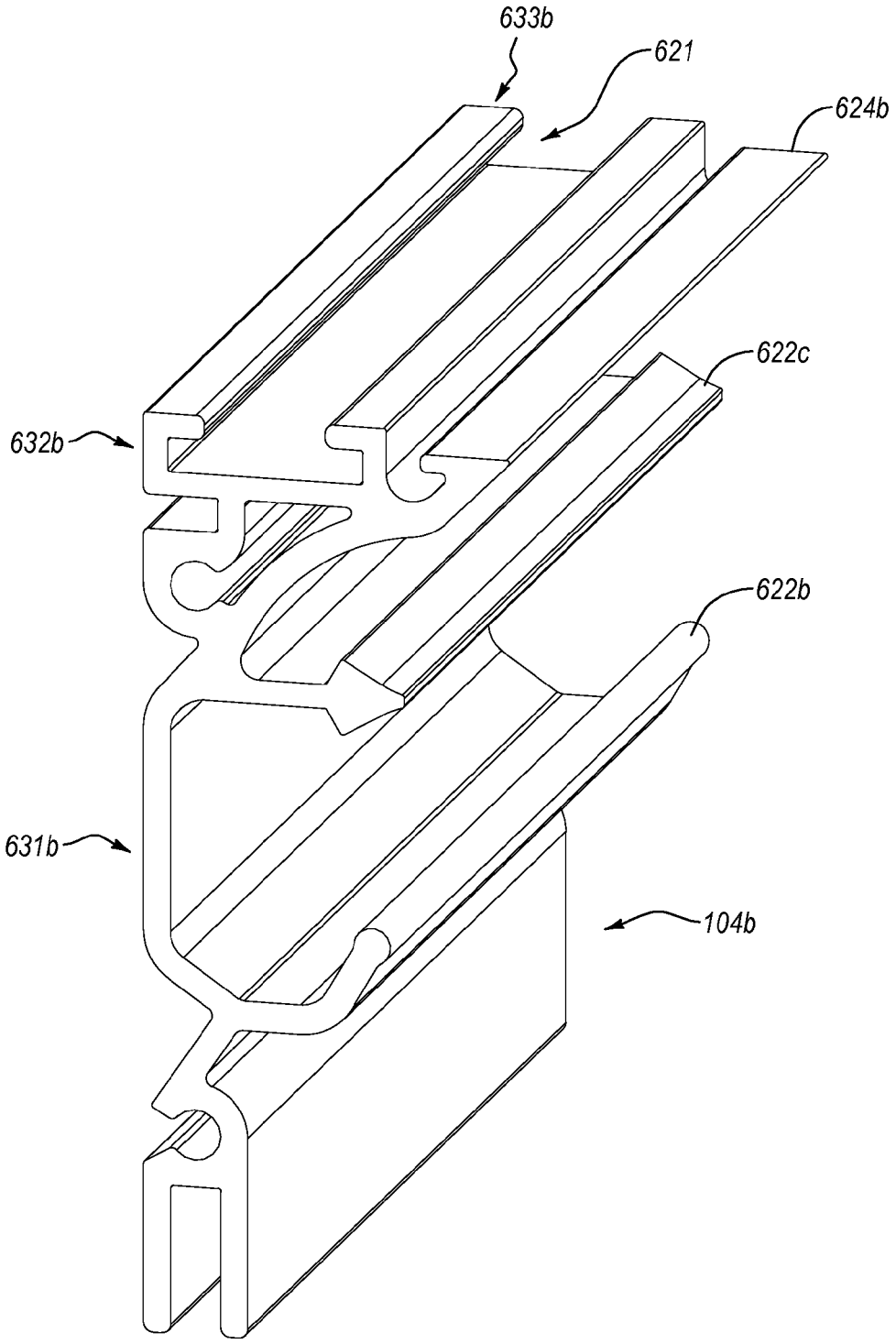
FIG. 9 illustrates a perspective view of another component shown in FIG. 7.

FIGS. 8 and 9 illustrate connection components 104*c* and 104*b*, respectively, as illustrated in assembly 300*a* of FIG. 7. In particular, FIG. 8 illustrates a solid, uniform, unitary, seamless, and/or extruded connection component 104*c* configured and/or oriented as an upper connection component 104*c*, with channel 621 thereof oriented downward. FIG. 9 illustrates a solid, uniform, unitary, seamless, and/or extruded connection component 104*b* configured and/or oriented as a lower connection component 104*b*, with channel 621 thereof oriented upward. However, connection components 104 can be oriented in any direction without departing from the scope of this disclosure. Connection component(s) 104 can also be fabricated, manufactured, formed, extruded, and/or comprised of any suitable material, including aluminum, steel, and/or other types of metal and/or metal alloy, as well as any other suitable synthetic and/or natural material, or any suitable combination thereof. Furthermore, multi-component connection component(s) 104 are also contemplated herein.

In at least one implementation, connection components 104 can be similar or identical in some or all features and/or elements thereof. For instance, the respective connection components 104 of FIGS. 8 and 9 have substantially similar configurations in certain features thereof. However, there are some differences between the respective connection components 104 of FIGS. 8 and 9. For instance, the cantilever channel member 624*b* of connection component 104*b* can be configured to provide a "hooked" end or opening to cantilever channel 518, while the cantilever channel member 624*c* of can be configured to provide a "straight" end or opening to cantilever channel 518. In addition, while both connection components 104*b* and 104*c* can comprise a straight protruding and arrowhead barbed tile attachment member 622*c*, connection component 104*b* can also comprise an angled and round headed tile attachment or support member 622*b*.

In at least one implementation, connection components 104 can be inverted, interchanged, etc. However, in other implementations, connection components 104 are designated, configured, and/or designed to be assembled, attached, connected, and/or applied as an upper, lower, and/or other connection components 104. For instance, in at least one implementation, connection component 104*c* illustrated in FIG. 8 is configured for implementation as an upper connection component 104*c*, while the connection component 104*b* illustrated in FIG. 9 is configured for implementation as a lower connection component 104*b* (e.g., as illustrated in FIG. 7).

Figure 10:
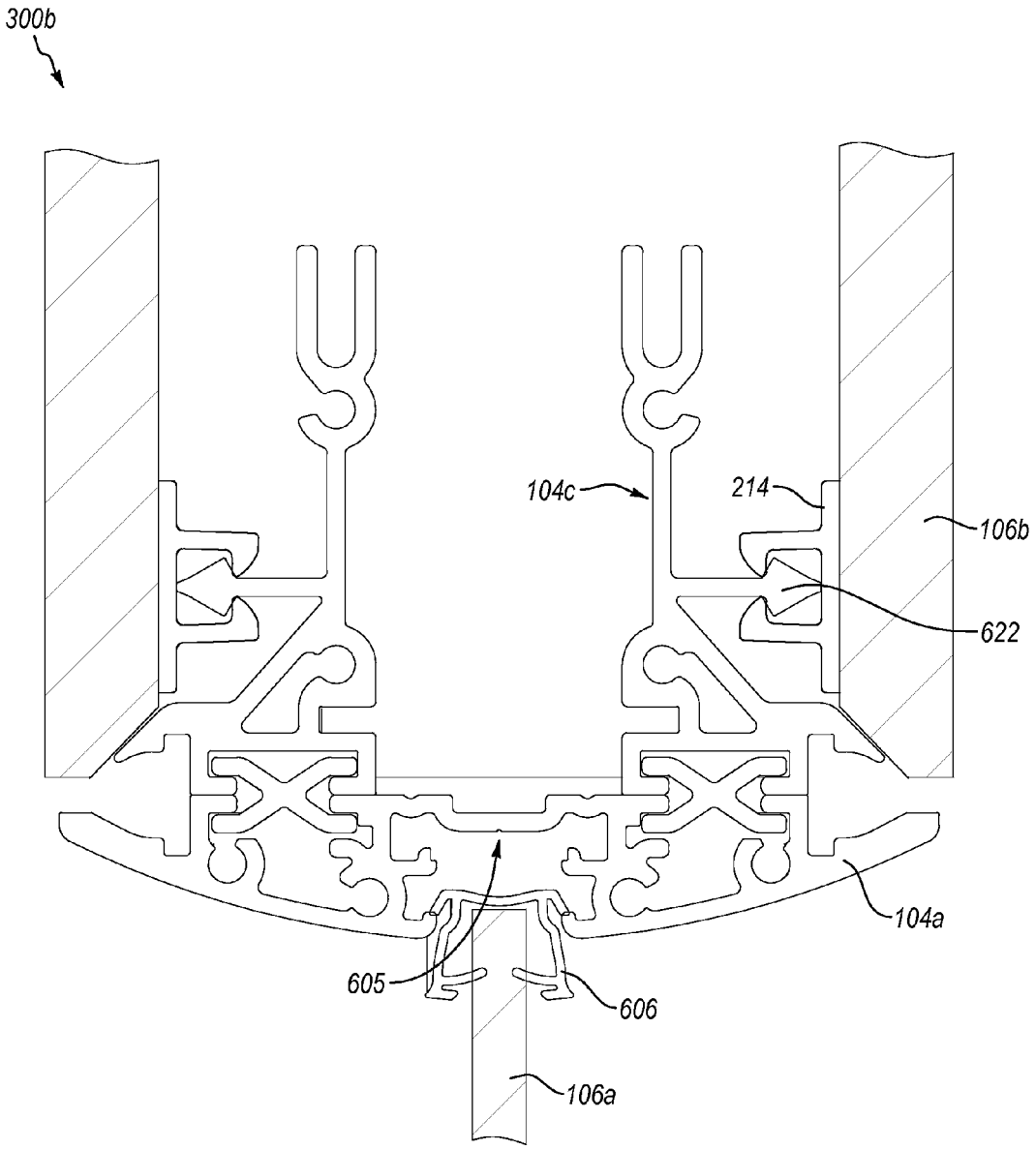
FIG. 10 illustrates a cross-sectional view of another assembly of components of an exemplary system according to one or more implementations of the present disclosure.

FIG. 10 illustrates an alternative assembly 300*b* comprising opposing upper connection components 104*c* attached to opposing sides of lower connection component 104*a*. Assembly 300*b* is configured to receive a lower, centrally-mounted tile 106*a* in tile receiving member 605 (via tile securing or attachment member 606 mounted therein) and opposing upper, exterior-mounted tiles 106*b* (via tile attachment members 622, respectively, having a tile attachment element 214 connected thereto). Thus, certain implementations can include one or more connection components 104 configured to receive one or more tiles 106 in a central- and/or exterior-mounted configuration, oriented as upper and/or lower connection components 104 without departing from the scope of this disclosure.

Furthermore, implementations of the present disclosure can relate to, include, and/or comprise interchangeable details, parts, and/or components designed and/or configured to allow versatility, configurability, and/or universality among such components. In at least one implementation, any such universally-configured connection or other component described and/or disclosed herein can be interchangeably attached and/or connected to any other such component (e.g., to form a module, subunit, frame, assembly, wall, and/or system as described herein or known in the art). It will also be apparent to one of skill in the art that the assembly 300*b* of FIG. 10 is substantially similar to an inverted-version of assembly 300 of FIG. 6C. It will be noted however, that while the respective center-mounted, interior-mounted, and/or glass tile-receiving connection components 104*a* of assembly 300 and assembly 300*b* are substantially similar and/or identical, that the respective side-mounted, exterior-mounted, and/or wall tile-receiving connection components 104*b* of assembly 300 and 104*c* of assembly 300*b* can be different in certain respects, features, and/or elements.

Figure 11:
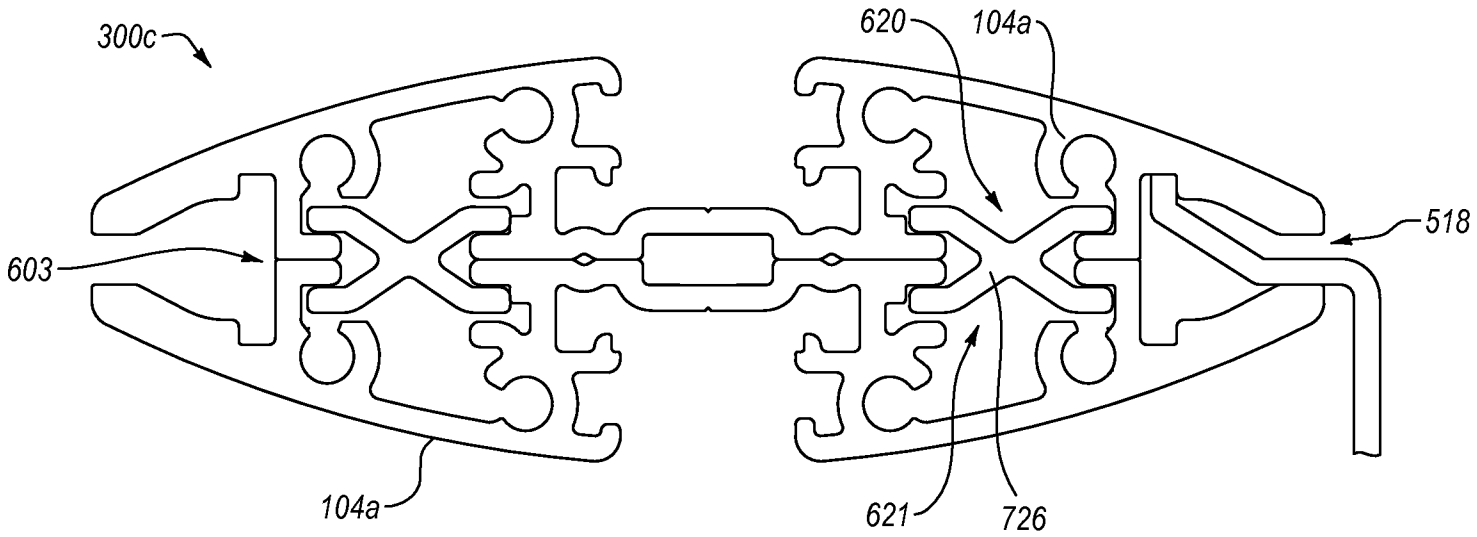
FIG. 11 illustrates a cross-sectional view of another assembly of components of an exemplary system according to one or more implementations of the present disclosure.

FIG. 11 illustrates another assembly 300*c* of components of an exemplary system according to one or more implementations of the present disclosure. In particular, first and second center-mounting connection components 104*a* can also be coupled together at an interface 603 via one or more connection interface components 726 secured within channel 620 (or channels 621 thereof) in certain implementations.

Figure 12:
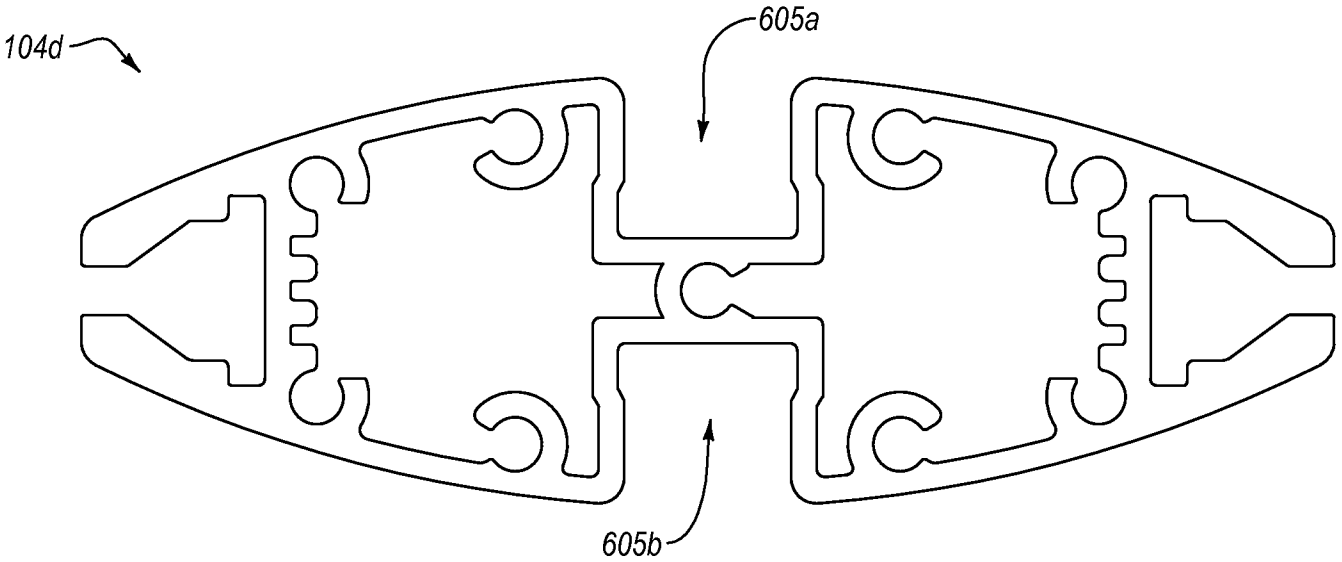
FIG. 12 illustrates a cross-sectional view of another component of an exemplary system according to one or more implementations of the present disclosure.

FIG. 12 illustrates an alternatively-designed connection component 104*d* according to one or more implementations of the present disclosure. In particular, a single, unitary, extruded, and/or manufactured connection component 104*d* can be provided in the place of two of more connection components 104 connected at an interface via one or more connection interface components. In contrast to other implementations described herein, connection component 104*d* does not include a universal interface between upper and lower connection components 104. Accordingly, removal and/or replacement of upper tile receiving element 605*a* can occur simultaneously with removal and/or replacement of lower tile receiving element 605*b*. However, upper tile receiving element 605*a* may not be removable and/or replaceable without simultaneous removal and/or replacement of lower tile receiving element 605*b* in such an implementation.

Figure 13A:
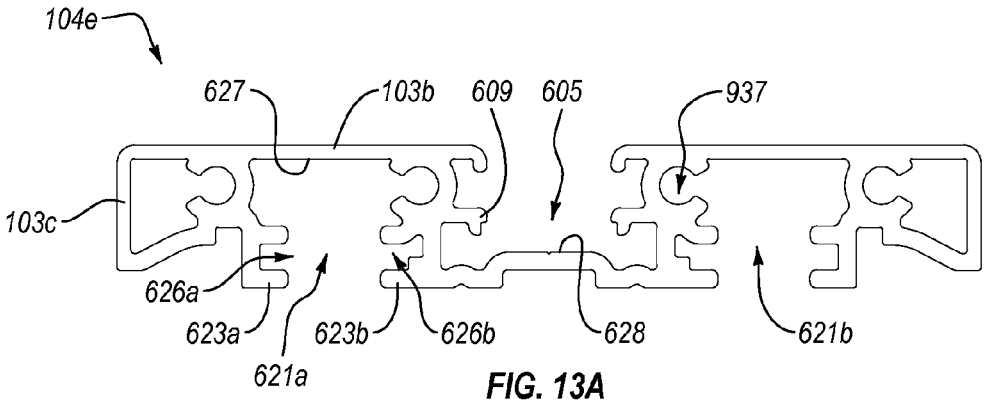
FIG. 13A illustrates a cross-sectional view of another component of an exemplary system according to one or more implementations of the present disclosure.

In addition to the above described connection components 104, FIGS. 13A-13E illustrate a variety of connection components 104 according to exemplary implementations of the present disclosure. It will be appreciated that connection components 104 can comprise various shapes, sizes, and/or configurations without departing from the scope of this disclosure. For instance, as illustrated in FIG. 13A, an illustrative connection component 104*e* can comprise a rectilinear and/or squared-edge shape and center-mounting tile receiving element 605. Tile receiving elements 605 can include a plurality of inwardly extending tile securing members 609 and/or an end wall 628. Connection component 104*e* can comprise a substantially flat and/or linear upper surface 103*b* and substantially flat, opposing outer side surface 103*c*. Thus, in various implementations, connection component(s) 104 can comprise rectilinear, straight, rounded, curved, angled, sharp, smooth, and/or various combinations of shapes, edges, and/or surfaces. It will be appreciated that while reference is made to upper surfaces, surfaces and other components or features can be inverted so change the orientation of the module 102, connection component 104, channel, or other component thereof (e.g., to face up or down or sideways).

Connection component 104*e* can also comprise one or more interface channels 621 (e.g., opposing interface channels 621*a*, 621*b*). Interface channels 621 can include one or more interface component attachment members 623 (e.g., opposing interface component attachment members 623*a* and 623*b*) and/or recessed portion(s) 226 (e.g., opposing recessed portions 226*a*, 226*b*). Interface channel 621 can also include an end wall 627 in certain implementations. Connection component 104*e* can also comprise one or more attachment openings 937. Attachment openings 937 can be configured to receive one or more fasteners and/or other securing members (not shown). As discussed in further detail below, attachment openings 937 can be adapted for having one or more frame elements (see e.g., frame elements 108*a* of FIG. 4) secured and/or reversibly secured thereto.

Figure 13B:
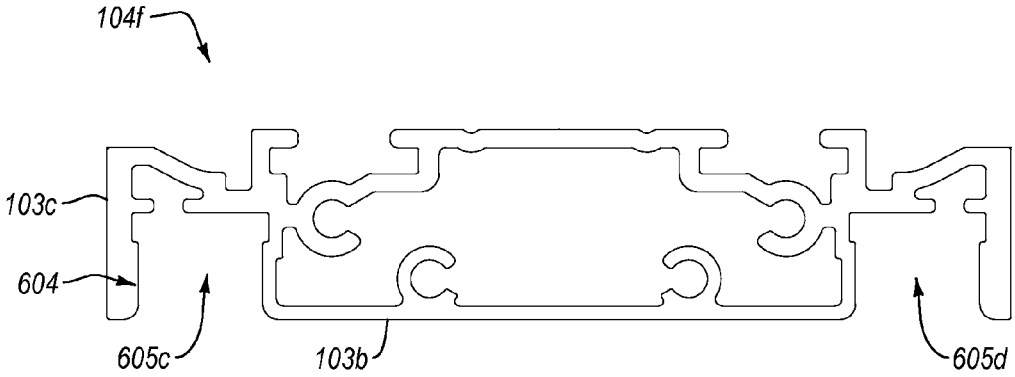
FIG. 13B illustrates a cross-sectional view of another component of an exemplary system according to one or more implementations of the present disclosure.

FIG. 13B illustrates a connection component 104*f* having a similar rectilinear and/or squared-edge profile and comprising a substantially flat and/or linear upper surface 103*b* and substantially flat, opposing outer side surfaces 103*c*. However, connection component 104*f* comprises opposing tile receiving elements 605*c* and 605*d*. In at least one implementation, one or more tile receiving elements 605 (e.g., opposing tile receiving elements 605*c* and 605*d*) can comprise and/or be formed by one or more channel walls 604. In addition, opposing tile receiving elements 605*c* and 605*d* can permit, allow, and/or be configured for mounting at least two tiles (peripherally) at opposite ends or edges of connection component 104*f*.

Figure 13C:
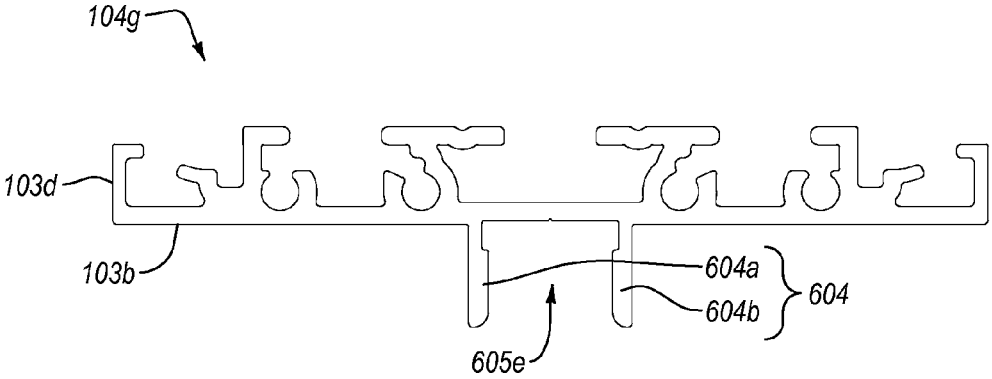
FIG. 13C illustrates a cross-sectional view of another component of an exemplary system according to one or more implementations of the present disclosure.

FIG. 13C illustrates a connection component 104*g* having a shortened and/or narrowed rectilinear and/or squared-edge profile and comprising a substantially flat and/or linear upper surface 103*b* and substantially flat, opposing outer side surfaces 103*d*. Connection component 104*g* also comprises a center-mounting, protruding tile receiving element 605*e*. Protruding tile receiving elements 605*e* can comprise opposing sidewalls 604*a* and 604*b*. Accordingly, tile receiving elements 605*e* can extend above upper surface 103*b*, as opposed to being recessed therein. One will appreciate, however, that a recessed tile receiving elements 605*e* is also contemplated herein. Opposing outer side surfaces 103*d* can be substantially shorter than opposing outer side surfaces 103*c*.

Those skilled in the art will appreciate that shorter outer side surfaces 103*d* can provide an aesthetic advantage in certain implementations. For instance, shorter outer side surfaces 103*d* can be less visible then longer outer side surfaces 103*c*, from at least one vantage point. In addition, shorter outer side surfaces 103*d* can accommodate the universally interchangeability of connection components 104 by allowing a tile 106*a* (see FIG. 10) to be mounted within tile receiving elements 605*d* while maintaining a similar and/or same distance from interface channel 621 (e.g., as compared to connection component 104*a*, 104*e*, etc.). In certain implementations, tile securing or attachment element 606 (see e.g., FIGS. 6B and 6C) can accommodate, permit, and/or allow for variability and/or adjustment in the position of tile 106*a*. Accordingly, a received end of a tile 106*a* can be disposed in a similar and/or identical position relative to interface channel 621 in connection components 104*a*, 104*e*, 104*g*, etc. (e.g., regardless of the configuration thereof). In addition, tile 106*a* can be adjusted relative to end wall 628 of channel 605 in certain implementations.

Figure 13D:
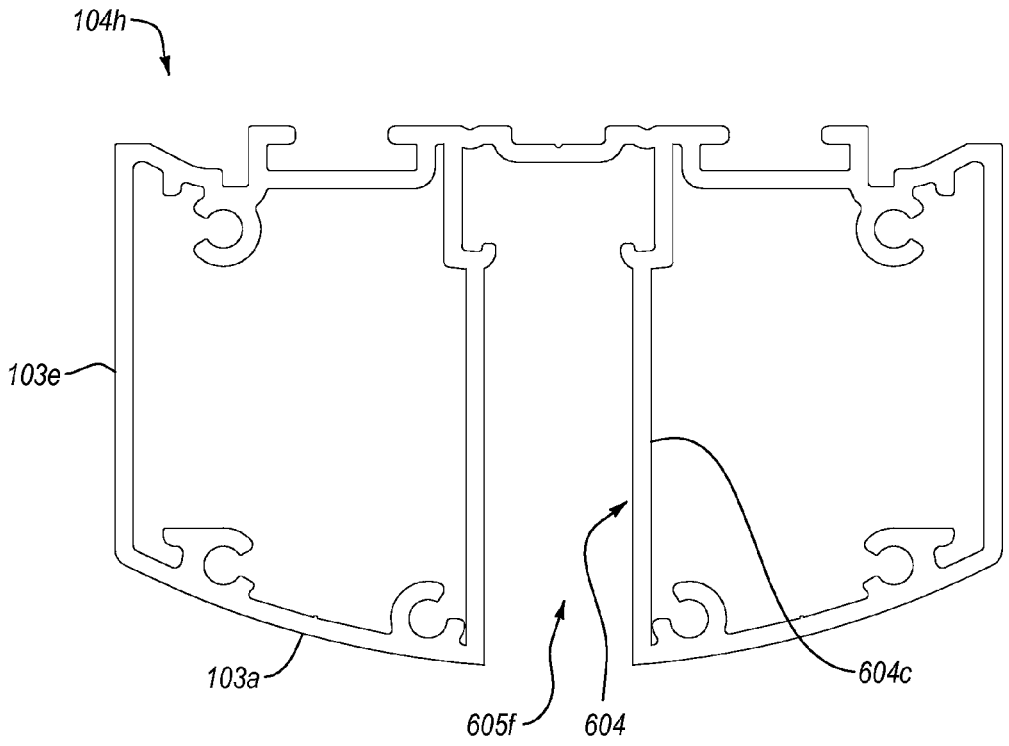
FIG. 13D illustrates a cross-sectional view of another component of an exemplary system according to one or more implementations of the present disclosure.

In at least one implementation, a connection component 104*h* can have extended, opposing outer side surfaces 103*e*. For instance, as illustrated in FIG. 13D, connection component 104*h* comprises a curved upper surface 103*a*, substantially flat, extended, opposing outer side surface 103*e*, and a recessed tile receiving element 605*f* having extended sidewalls 604. It will be appreciated that recessed tile receiving element 605*f* comprises a channel 605*f* that is substantially longer and/or deeper than that of tile receiving elements 605*a*. Accordingly, a received end of a tile 106*a* (see FIG. 10), can be disposed in a similar position relative to interface channel 621 in connection components 104*a*, 104*e*, 104*g*, 104*h*, etc. Indeed, in at least one implementation, tiles 106*a* can be mounted in similar and/or identical positions relative to interface channel 621 regardless of the exact configuration of connection component 104. Connection component 104*h* and/or tile receiving element 605*f* thereof can also be configured to receive and/or accommodate a tile securing or attachment element 606 (not shown).

Figure 13E:
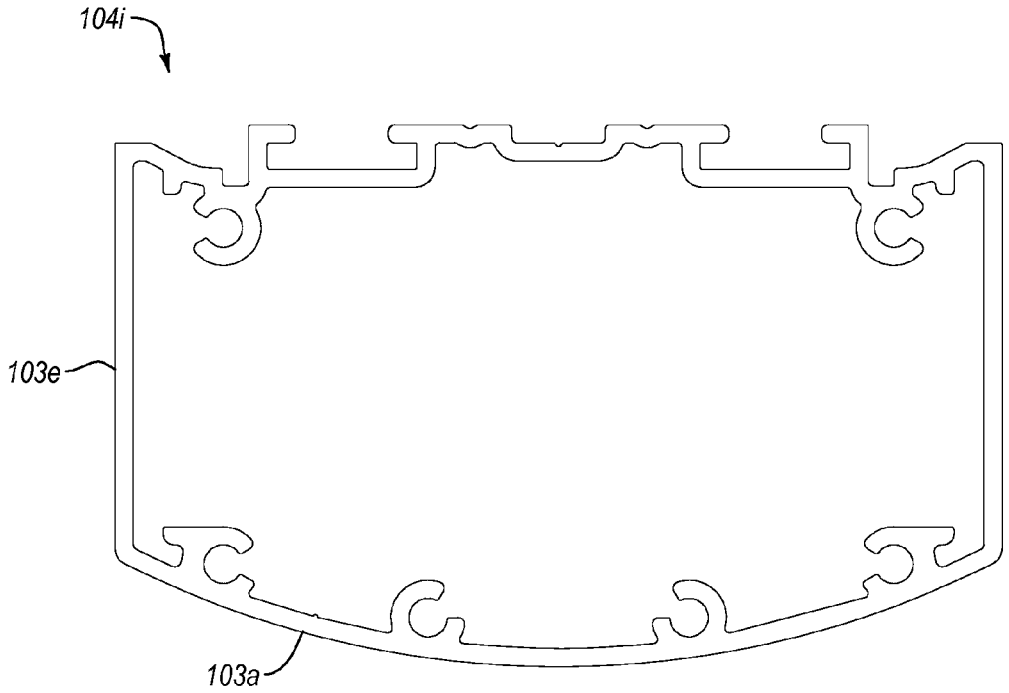
FIG. 13E illustrates a cross-sectional view of another component of an exemplary system according to one or more implementations of the present disclosure.

In certain implementations, connection component 104*i* can be configured without a tile receiving element 605. For instance, as illustrated in FIG. 13E, connection component 104*i* comprises a curved upper surface 103*a*, substantially flat, extended, opposing outer side surface 103*e*, and no tile receiving element 605 (recessed into upper surface 103*a* and/or extending therefrom). In at least one implementation, the foregoing or other connection components 104 can be designed and/or configured to be universally, completely, and/or partially compatible with any other connection component 104.

Figure 14A:
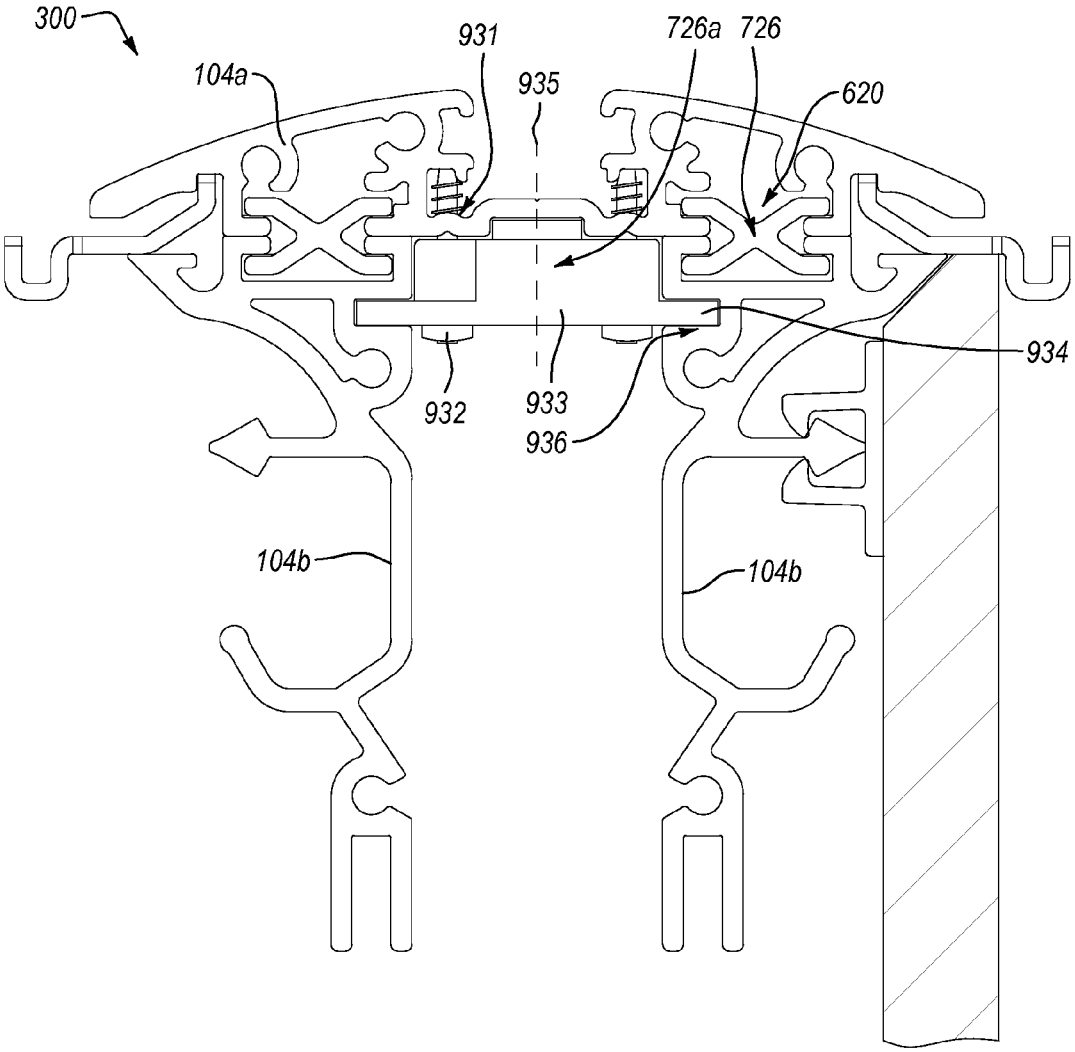
FIG. 14A illustrates a cross-sectional view of the assembly shown in FIG. 6A having additional components according to one or more implementations of the present disclosure.

FIG. 14A illustrates additional, optional components of assembly 300 as previously described. In particular, FIG. 14A illustrates connection interface components 726 and 726*a* securing together upper connection component 104*a* and opposing lower connection components 104*b*. Specifically, first (opposing) connection interface components 726 are positioned within respective channels 620 on opposing sides of assembly 300. Furthermore, connection interface component 726*a* is securely (and centrally) attached to upper connection component 104*a* via one or more fasteners 932 secured through one or more openings 931 in upper connection component 104*a*. Connection interface component 726*a* can comprise a body 933 and one or more tabs, arms, feet, protrusions, and/or other securing members 934 configured to secure together connection component 104*a* and connection components 104*b*. For instance, securing member 934 can engage a slot, recess, and/or channel 936 in one or more connection components 104*b* when securing member 934 is place in an engaged configuration, as illustrated in FIG. 14A. In at least one implementation, connection interface component 726*a* can be at least partially rotatable around an axis of rotation 935.

Figure 14B:
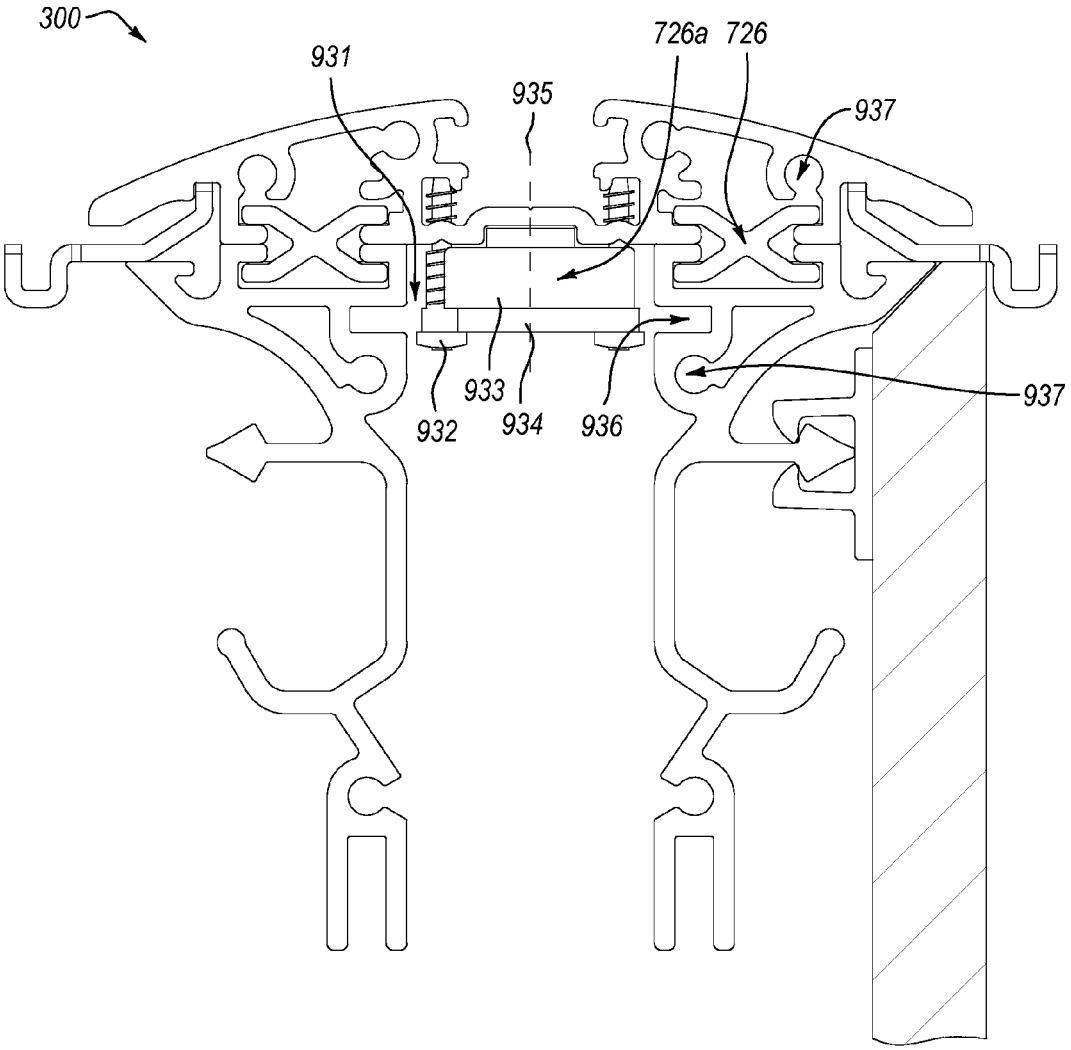
FIG. 14B illustrates an alternative configuration of the assembly shown in FIG. 14A.

FIG. 14B illustrates an alternative, disengaged configuration of the assembly 300 shown in FIG. 14A and, in particular, of connection interface component 726*a*. For instance, rotation (e.g., quarter-turn or 90 degree rotation) of connection interface component 726*a* (e.g., in a first direction around axis of rotation 935) or other alteration and/or detachment of connection interface component 726*a*, can cause disengagement thereof. Securing member(s) 934 can thereby be removed from slots 936 by such an alteration in configuration, allowing for the dissociation of connection component 104*a* and connection components 104*b* in some implementations. Connection interface component 726*a* can also be used to secure together adjacent frame elements 108. Rotation of connection interface component 726*a* (e.g., in an opposite direction around axis of rotation 935) can re-engage securing member(s) 934 in slot(s) 936 and/or can engage a reversible locking mechanism to prevent unintentional rotation of connection interface component 726*a* (e.g., in the first direction around axis of rotation 935).

Figure 15A:
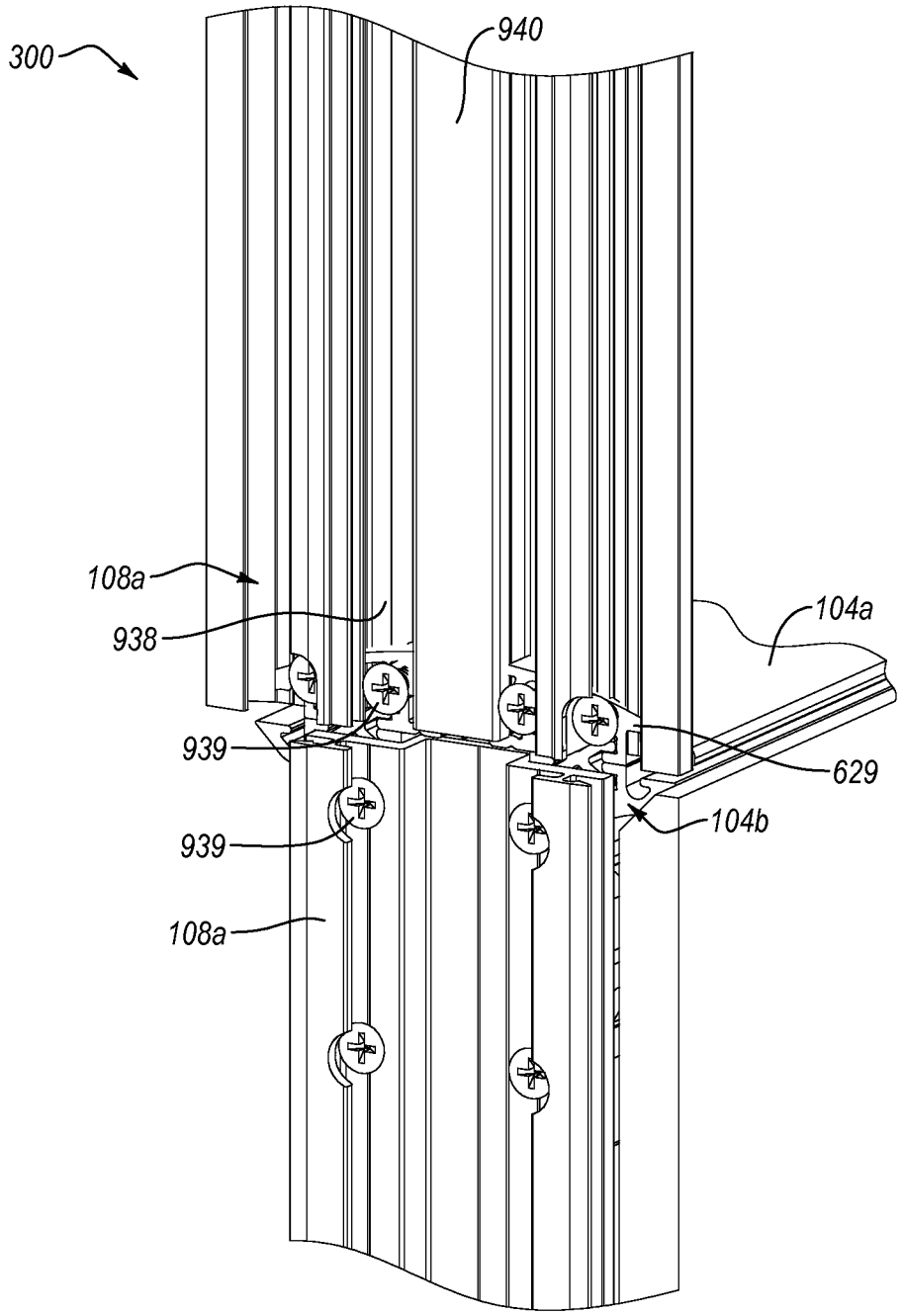
FIG. 15A illustrates a first perspective view of the assembly shown in FIG. 6A having additional components according to one or more implementations of the present disclosure.

As indicated above, in at least some implementations, connection components 104 can comprise one or more attachment openings 937. Attachment openings 937 can be configured to receive one or more fasteners and/or other securing members (not shown). In particular, attachment openings 937 can be adapted for having one or more frame elements 108*a* secured and/or reversibly secured thereto. For instance, as illustrated in FIG. 15A, one or more inner frame elements 108*a* can be attached, connected, and/or secured to the outer edge 629 of upper connection component 104*a* and/or lower connection component 104*b* by means of one or more fasteners 939 (e.g., to provide structure, stability, rigidity, and/or separation of or between modules, subunits, and/or components described herein. Frame elements 108 can also be attached to other component described herein.

Figure 15B:
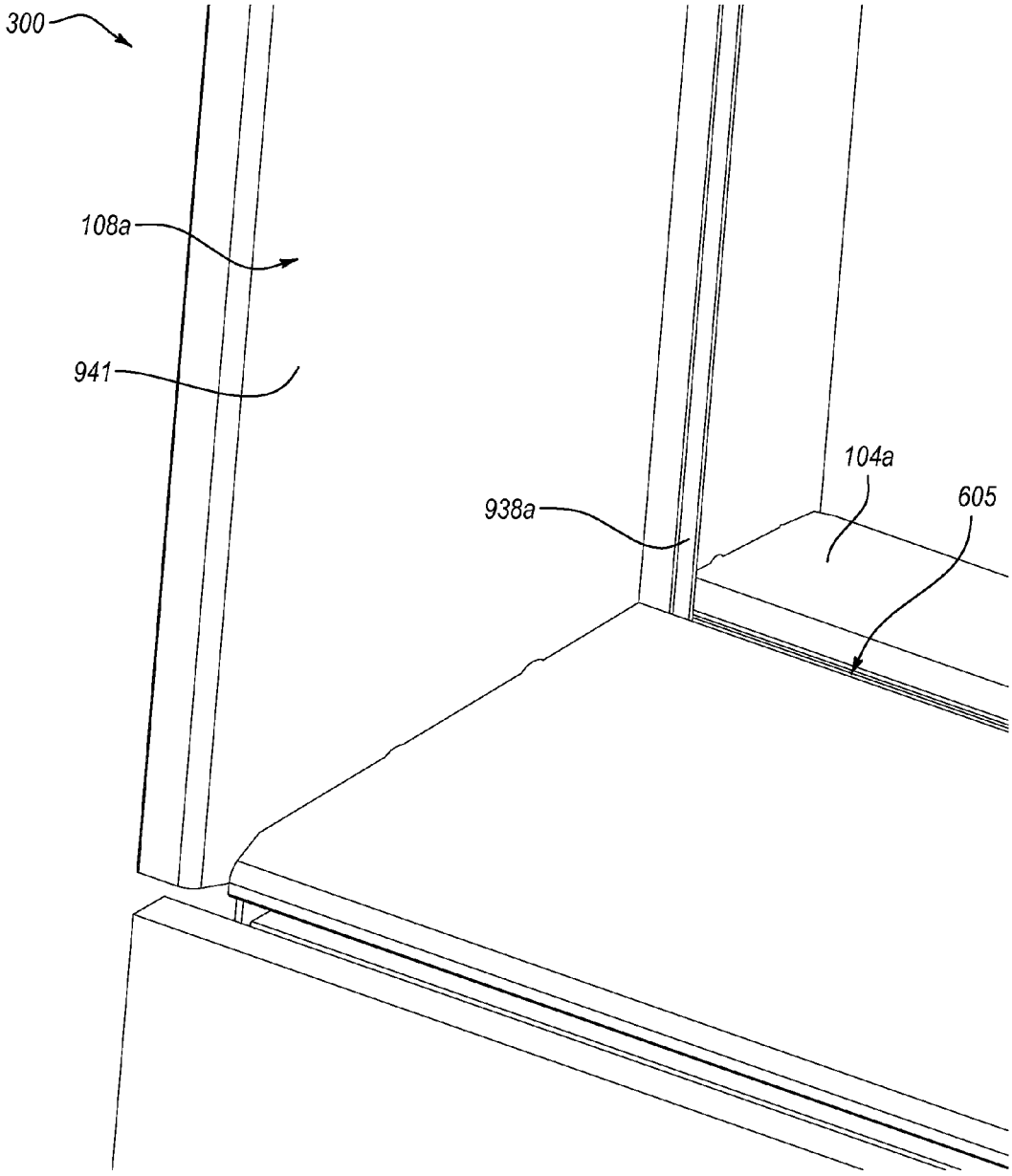
FIG. 15B illustrates a second perspective view of the assembly shown in FIG. 15A.

As described in further detail below, frame element(s) 108 can be shaped and/or formed to fit securely within the shape and/or form of the various connection components 104 and/or other components described herein. For instance, frame element(s) 108 can comprise one or more structural feature 938 (e.g., channel, protrusion, and/or other element) configured to engage a portion, element, member, and/or structural feature of another component of assembly 300, or any system, wall, subunit, module, and/or component thereof described and/or disclosed herein. Structural features 938 can be formed on outer surface 940 and/or inner surface 941 (see FIG. 15B) of frame element 108*a*. As illustrated in FIG. 15B, for example, frame element 108*a* can includes a (central) tile receiving element 938*a* (e.g., protruding and/or extending from inner surface 9041 thereof). Tile receiving element 938*a* can be configured to align with tile receiving member 605 of upper connection component 104*a*. Accordingly, tile receiving element 938*a* and tile receiving member 605 can operate to secure one or more tiles 106*a* (not shown).

Figure 16A:
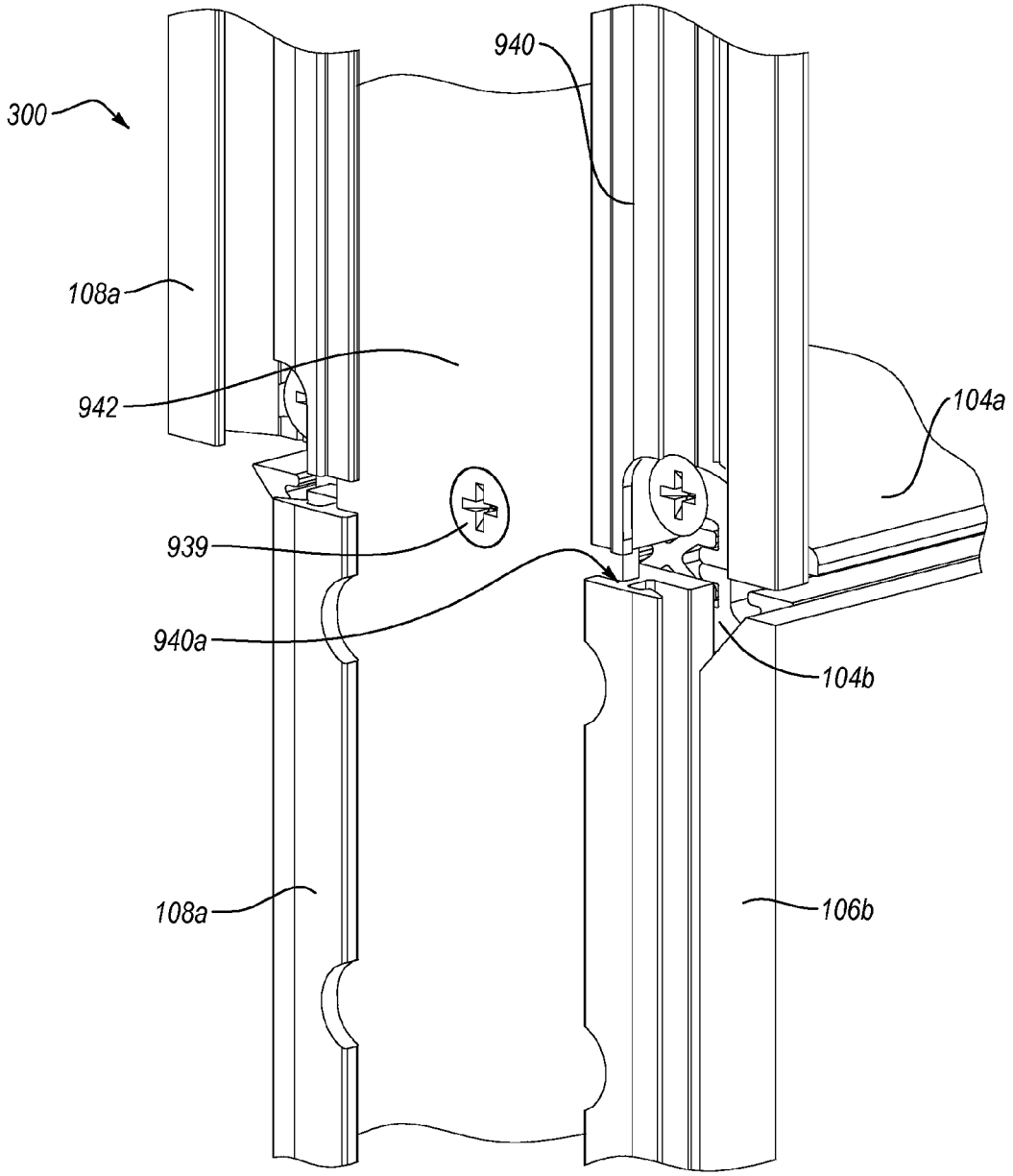
FIG. 16A illustrates a first perspective view of the assembly shown in FIG. 15A having additional components according to one or more implementations of the present disclosure.
Figure 16B:
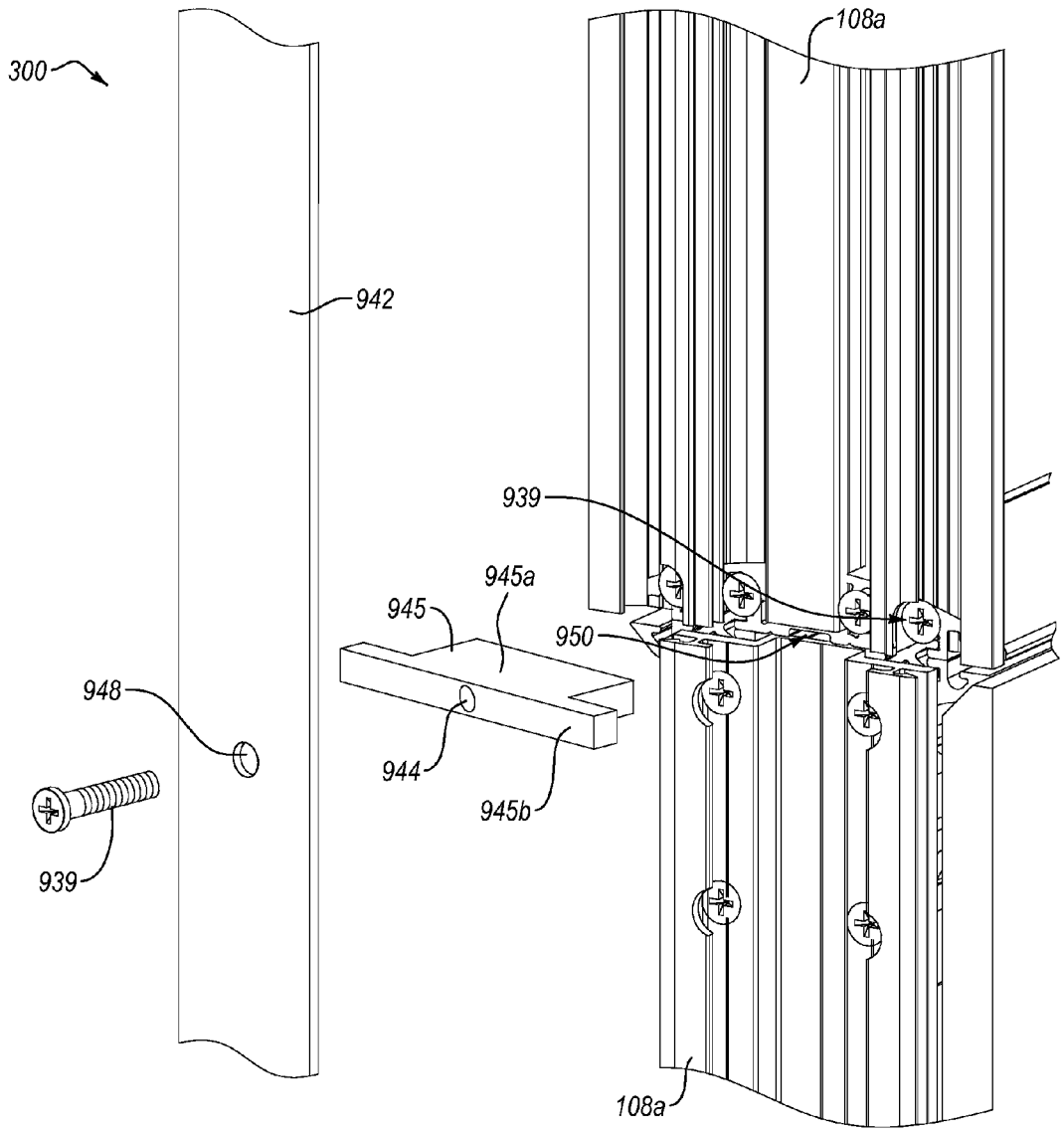
FIG. 16B illustrates an exploded view of the assembly shown in FIG. 16A.

As illustrated in FIGS. 16A-16B, assembly 300 can also include one or more components adapted for reinforcing frame elements 108. For instance, as illustrated in FIG. 16A, a spline 942 or other reinforcing member can be attached to, between, and/or about one or more inner frame elements 108*a* (e.g., within a recess and/or channel 940*a* in outer surface 940 thereof) via one or more fastener(s) 939. Spline 942 can provide support against lateral and/or other forces, and/or to hold modules, subunits, and/or components thereof together.

As illustrated in FIG. 16B, assembly 300 can also include one or more attachment members 945. In at least one implementation, attachment member 945 can fit securely between upper and lower frame elements 108*a* (e.g., within a gap 950 therebetween) such that spline 942 can be secured to attachment members 945 and/or other components of assembly 300 using a single fastener 939 through a single opening 948 in spline 942. For instance, in certain implementations, attachment member 945 can fit securely within gap 950 between upper and lower frame elements 108*a*. Spline 942 can then be aligned with frame elements 108*a* such that opening 948 of spline 942 aligns with (threaded) opening 944 of attachment members 945. Fastener 939 can then be inserted through opening 948 of spline 942 and (threadedly) received into (threaded) opening 944 of attachment members 945, thereby securing spline 942 to assembly 300 by means of attachment members 945.

In at least one implementation, minimizing the number of openings 948 in spline 942 can significantly increase and/or enhance the effectiveness and/or strength of spline 942. Similarly, minimizing the number of openings in frame element(s) 108 can significantly increase and/or enhance the effectiveness and/or strength thereof. Accordingly, attachment of spline 942 to frame element(s) 108 may not require any (additional) openings or other holes in frame element(s) 108 in some implementations. In addition, attachment members 945 can comprise a body portion 945*a* and (opposing) arm(s) or other support member(s) 945*b*. Such a configuration can substantially prevent lateral load (from adjacent assemblies, subunits, modules, etc.) from transferring to assembly 300 and/or frame elements 108*a* thereof.

Figure 17:
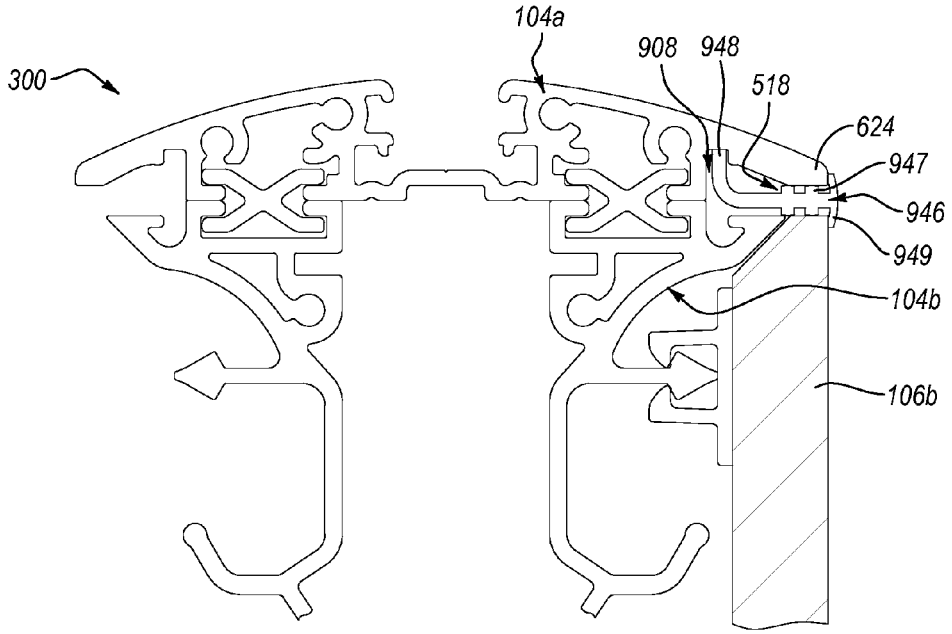
FIG. 17 illustrates a cross-sectional view of the assembly shown in FIG. 6A having additional components according to one or more implementations of the present disclosure.

FIG. 17 illustrates one or more additional, optional components of assembly 300 as previously described. For instance, assembly 300 includes a channel cap or other seal 946 inserted into and sealing off channel 518 from at least one side, edge, and/or opening. In particular, seal 946 closes the (horizontally-extending) gap between upper connection component 104*a* and the lower connection component 104*b* (and/or tile 106*b* connected thereto). Seal 946 can include one or more feet 947 configured to engage one or more of connection components 104 and/or tiles 106 such that seal 946 is positioned, held, and/or secured within channel 518. Seal 946 can also include a capping element 949 adapted for ceiling and/or covering at least a portion of channel 518. Seal 946 can further include one or more tail, foot, or other locking elements 948 configured to fit securely within slot or channel 908 of connection component 104 such that seal 946 is retained within channel 518.

Figure 18:
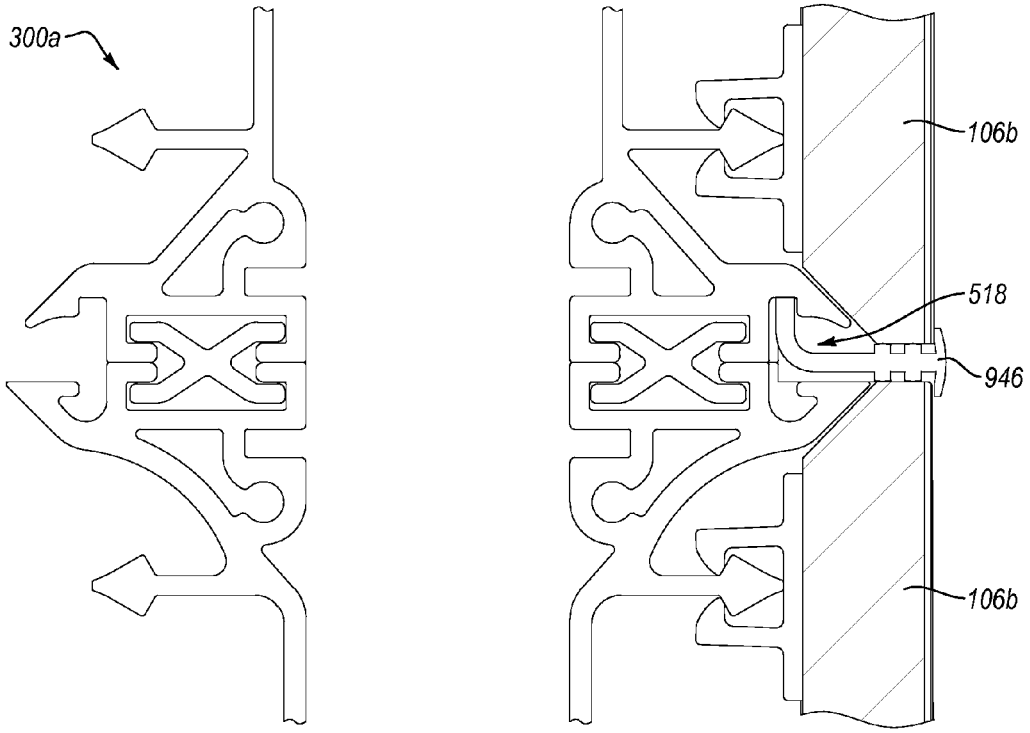
FIG. 18 illustrates a cross-sectional view of the assembly shown in FIG. 7 having additional components according to one or more implementations of the present disclosure.

Seal(s) 946 can be especially important and/or useful where a wall system is constructed and/or used in a hospital, healthcare, and/or other facility where dust, debris, and microbes retained within channel 518 is undesirable. Furthermore, as illustrated in FIG. 18, seal 946 can be positioned within channel 518 and secured to upper and lower tiles 106*b* in certain implementations. Seal(s) 946 can also be incorporated (vertically) between frame elements 108 of adjacent modules and/or subunits described herein. Thus, seal(s) 946 can be applicable and/or incorporated into any suitable assembly, subunit, wall, system, and/or other structure or configuration described and/or disclosed herein.

Figure 19A:
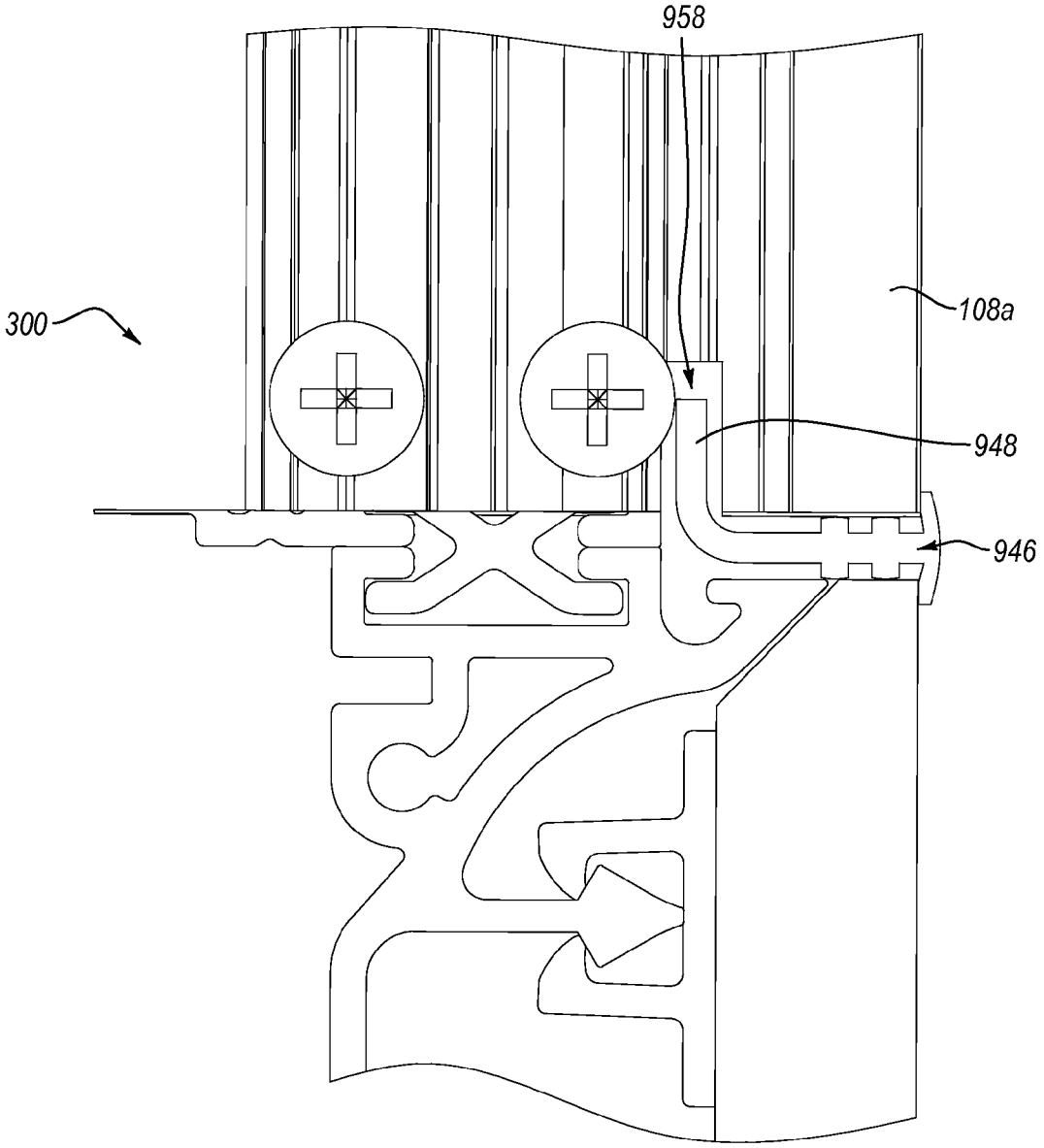
FIG. 19A illustrates a cross-sectional view of the assembly shown in FIG. 6A having additional components according to one or more implementations of the present disclosure.
Figure 19B:
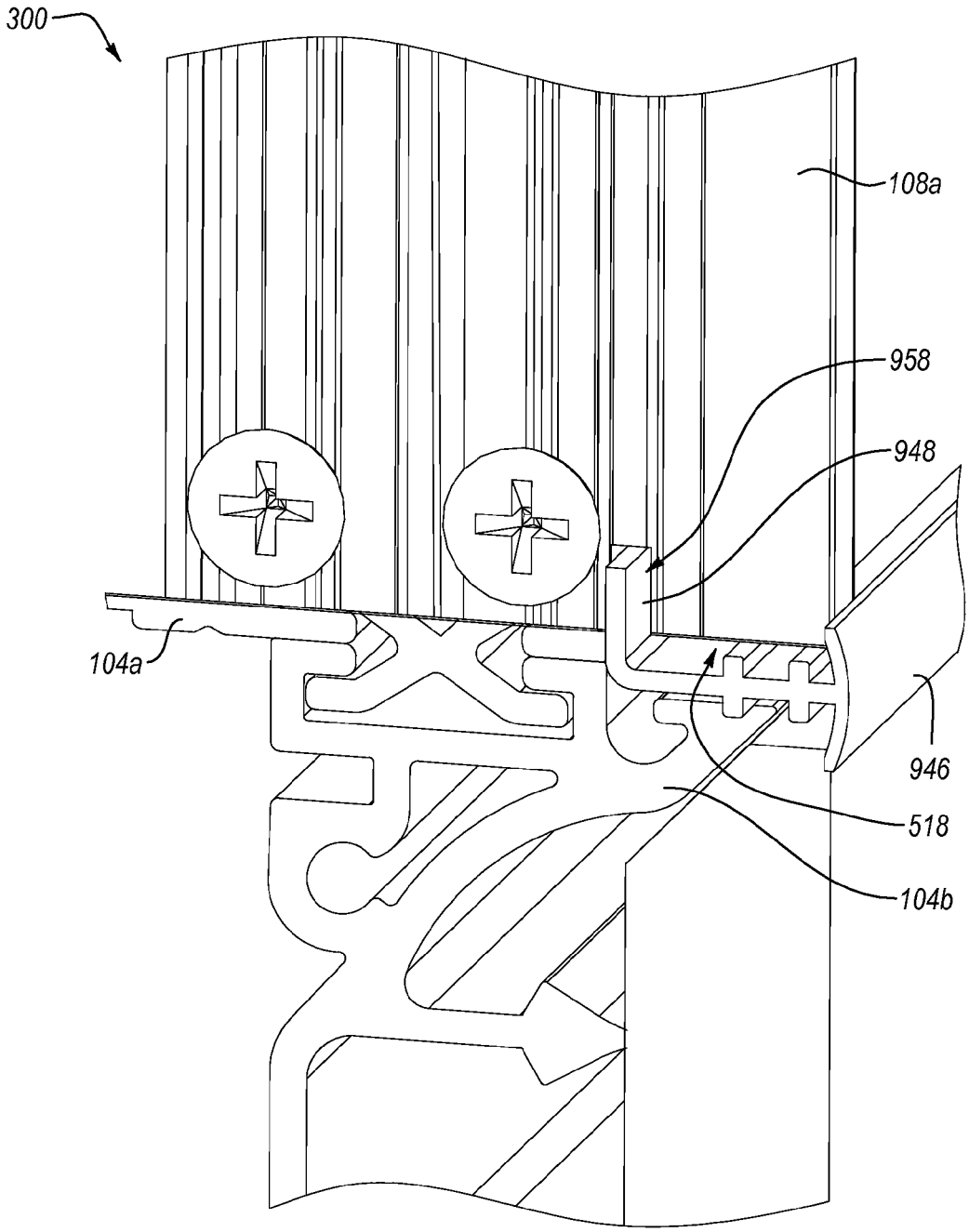
FIG. 19B illustrates a perspective detailed view of the assembly shown in FIG. 19A.
Figure 19C:
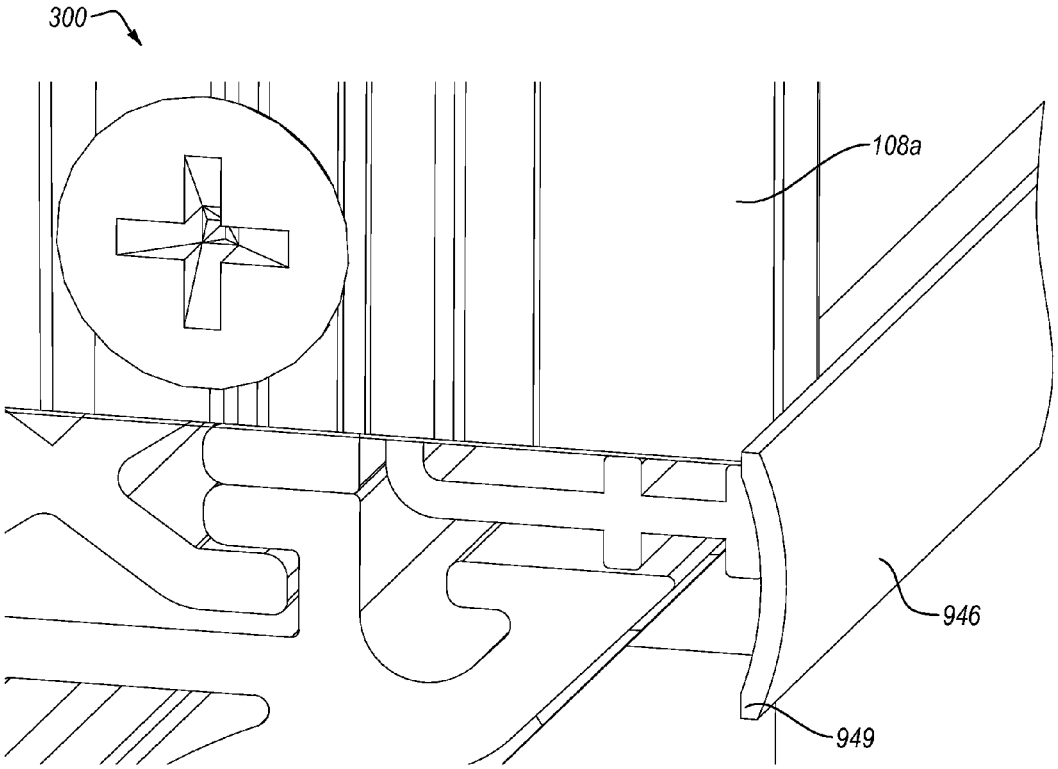
FIG. 19C illustrates a perspective detailed view of the assembly shown in FIG. 6A having additional components according to one or more implementations of the present disclosure.

As illustrated in FIG. 19A-19C, frame element 108 can also be configured to receive seal 946 and/or locking element 948 thereof. For instance, as illustrated in FIG. 19A, frame element 108*a* can have a slot, channel, or other receiving element 958 configured to accommodate and/or receive seal 946 and/or locking element 948 thereof. As illustrated in FIG. 19B, seal 946 can comprise an elongated, extruded, and/or extended cap-and-tail structure, member, and/or element configured to close and/or seal off at least a portion, segment, and/or section of channel 518. In at least one implementation, seal 946 spans substantially the entire length, height, distance, and/or other measurement or parameter of channel 518 in a system, wall, subunit, module, and/or component. For instance, seal 946 can seal the gap or opening of channel 518 from a first end of a wall (system) 100 to a second and/or opposite end of the wall (system) 100. In addition, seal 946 can extend between two adjacent modules 102 and/or subunits 112 in at least one implementation.

In an alternative implementation, seal 946 can be confined to a single module 102 and/or subunit 112. For instance, as illustrated in FIG. 19C, some frame elements 108*a* can lack a vertical slot, channel, or other receiving element. Accordingly, frame element 108 is not configured to receive seal 946 and/or locking element 948 thereof.

Figure 20A:
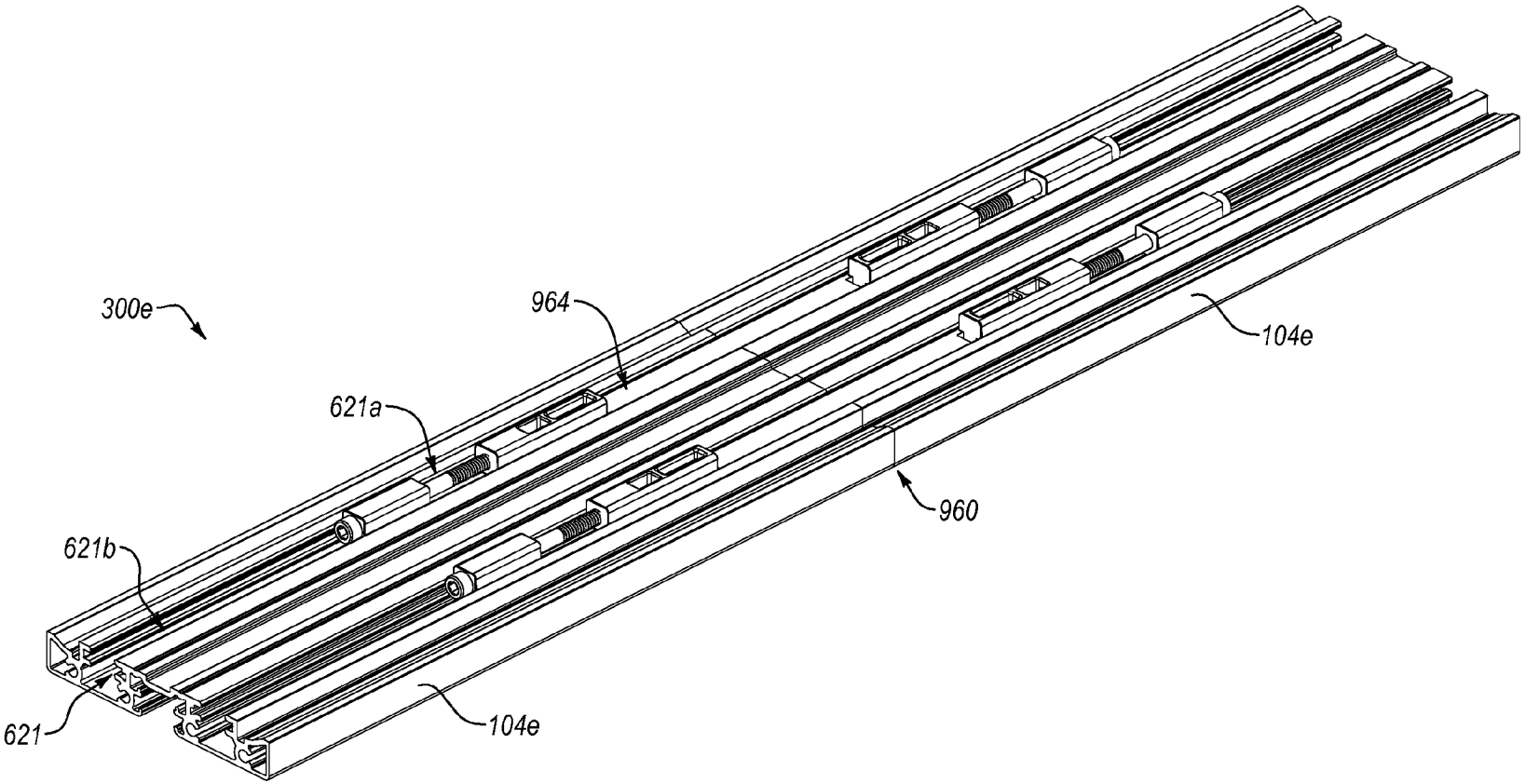
FIG. 20A illustrates a perspective view of an assembly of components of an exemplary wall system according to one or more implementations of the present disclosure.

In addition to (vertical) attachment of upper and lower connection components 104, certain implementations of the present disclosure include means for (horizontally) connecting two or more connection components 104, side-by-side. For instance, FIG. 20A illustrates an assembly 300*e* having two connection components 104*e* connected and/or aligned (e.g., linearly and/or horizontally) at an interface 960 by means of one or more alignment elements 964. Alignment element 964 can be configured to align two or more (laterally adjacent) connection components 104 in one or more directions and/or planes and can comprise one or more elements configured to align and/or secure connection components 104 together in a selective and/or reversible manner.

Alignment element 964 (or one or more components thereof) can be disposed at least partially within interface channel 621 of connection component 104*e* or a first portion 621*a* thereof. Accordingly, connection components 104*e* having two interface channels 621 can receive two alignment elements 964. A plurality of alignment elements 964 can also be received into a single interface channel 621 in some implementations. It will be appreciated that a second portion 621*b* of interface channel 621 can be configured to receive a connection interface component 726 (not shown) in certain implementations. In at least one implementation, alignment element 964 can be disposed in another suitable region, area, portion, and/or element of connection component(s) 104*e* and/or assembly 300*e*. In addition, as discussed in further detail below, alignment element 964 can be positioned or disposed within attachment interface channel(s) 620 of or formed by upper and lower connection components 104 (or respective interface channels 621 thereof).

Figure 20B:
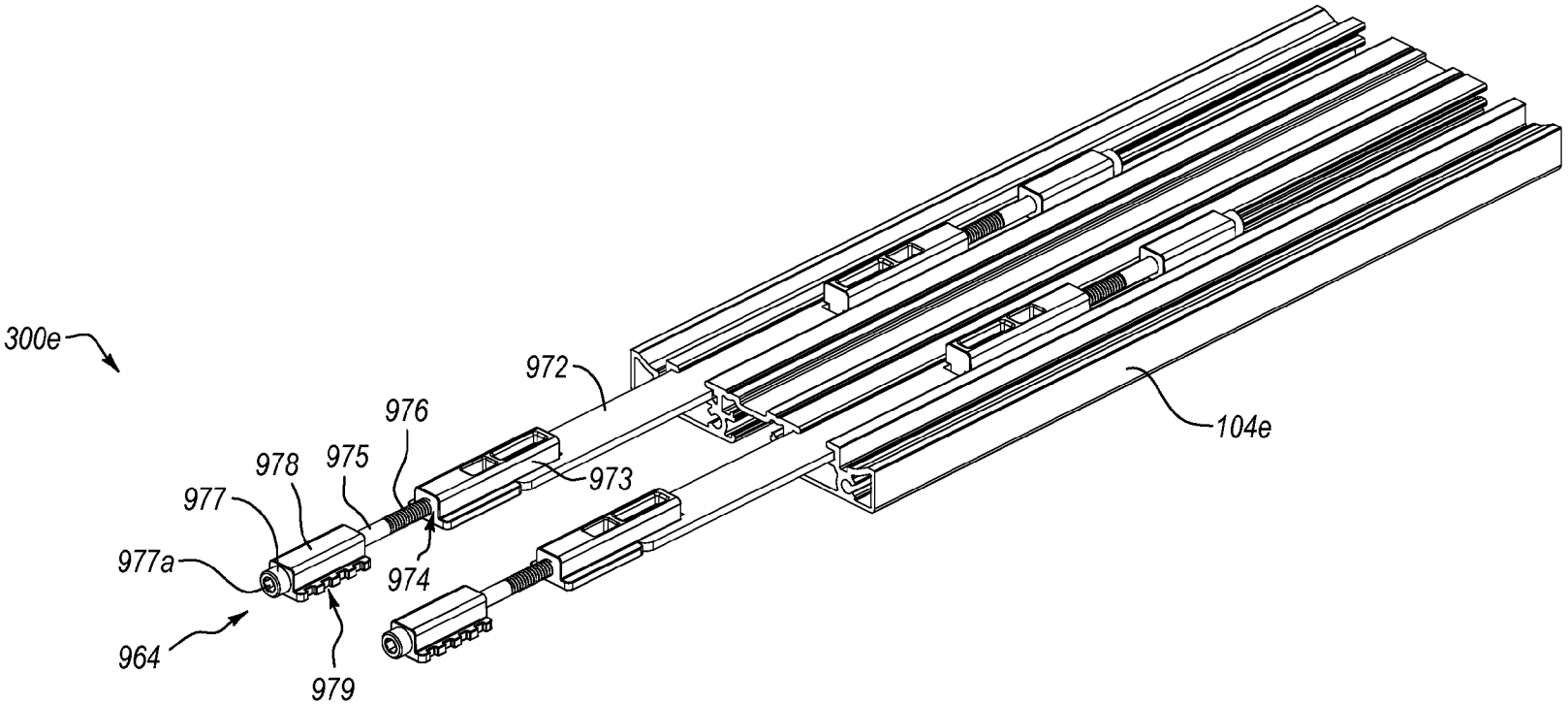
FIG. 20B illustrates a perspective view of an assembly of some of components shown in FIG. 20A.

Alignment element 964 can be configured to properly align adjacent connection components 104. For instance, as illustrated in FIG. 20B, alignment element 964 can comprise at least one translational member 972. Translational member 972 can extend at least partially between adjacent connection components 104*e* and/or provide a (direct or indirect) physical connection between other components of alignment element 964 attached or connected, respectively, to adjacent connection components 104*e*. Alignment element 964 can also include one or more alignment element attachment members 973 (e.g., connected to opposing ends of translational member 972), one or more gripping and/or channel attachment members 978 (e.g., secured to or within interface channel 621; see FIG. 20A), and/or one or more aligning members 975 disposed therebetween.

In at least one implementation, channel attachment member 978 can include one or more gripping elements 979. For instance, as illustrated in FIG. 20B, channel attachment member 978 includes a plurality of channel gripping teeth 979. In addition, aligning member 975 can be or comprise a threaded, rotatable, tension or pulling rod (e.g., extending at least partially through channel attachment member 978. For instance, as illustrated in FIG. 20B, aligning member 975 includes one or more threads 976 disposed at a first end thereof and configured to be threadedly received within a corresponding threaded opening 974 of alignment element attachment member 973. Aligning member 975 can also include an operating end 977 disposed on a second end thereof (e.g., opposite alignment element attachment members 973 and/or threads 976). Operating end 977 can include a tool receiving element 977*a* in some implementations. In other implementations, operating end 977 can be hand-operated.

With reference to FIGS. 20A and 20B, opposing channel attachment members 978 can be secured within respective channels 621 of adjacent connection components 104*e*. Respective aligning members 975 can be inserted through the secured channel attachment members 978 and threadedly received within threaded openings 974 of respective alignment element attachment members 973. The alignment element attachment members 973 can be secured to opposing ends of translational member 972. Accordingly, rotation of one or more of the aligning member 975 (e.g., about the axis of rotation thereof) can cause threads 976 to be received further into threaded opening 974 of alignment element attachment member 973. However, because the respective channel attachment members 978 are secured (substantially stationary) within respective channels 621, rotation of an aligning member 975 pulls the associated alignment element attachment member 973 (and translational member 972 attached thereto) toward channel attachment member 978. Pulling of translational member 972 can thereby cause alignment of the adjacent connection components 104*e* by cinching together one or more components connected and/or secured thereto.

Figure 21A:
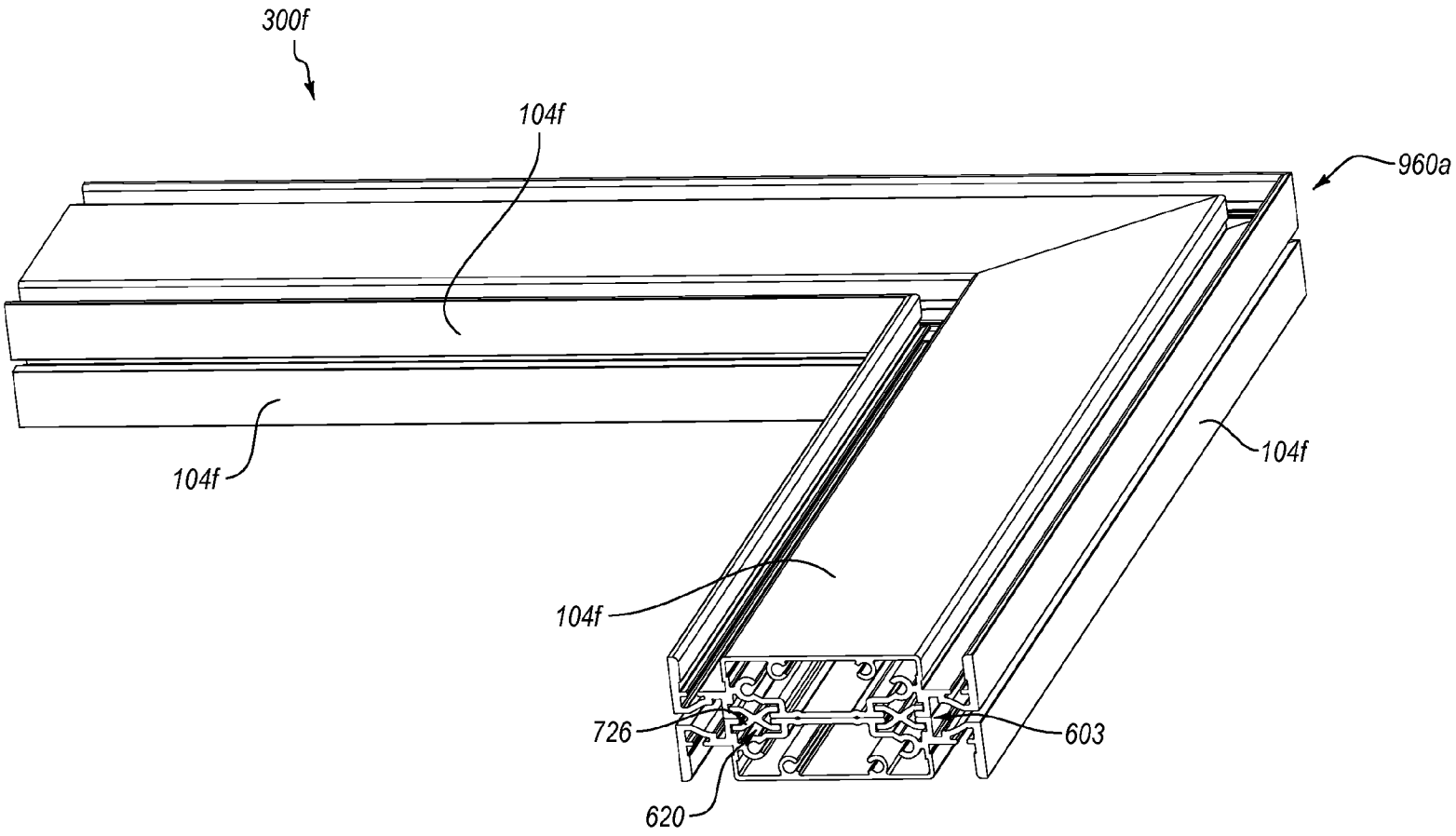
FIG. 21A illustrates a perspective view of an assembly of components of an exemplary wall system according to one or more implementations of the present disclosure.

FIG. 21A illustrates an assembly 300*f* having four connection components 104*f* attached, connected, and/or secured at a 90 degree, angled intersection or interface 960*a*. Those skilled in the art will appreciate that in certain implementations, connection components 104 can be attached, connected, and/or secured at any suitable angle. In at least one implementation, interface 960*a* comprises a corner of a wall system 100. Thus, connection components 104 can be configured, extruded, and/or mitered to accommodate a change in latitudinal direction of wall system 100. For instance, a wall system 100 can require a directional change of less than, up to, greater than, equal to, between, or about 30 degrees, 45 degrees, 60 degrees, 90 degrees, 120 degrees, 135 degrees, and/or other angled (sharp or smooth/curved) configuration. Accordingly, connection components 104 and/or other components of wall system 100 can be configured to accommodate such angular and/or curved changes in direction.

Figure 21B:
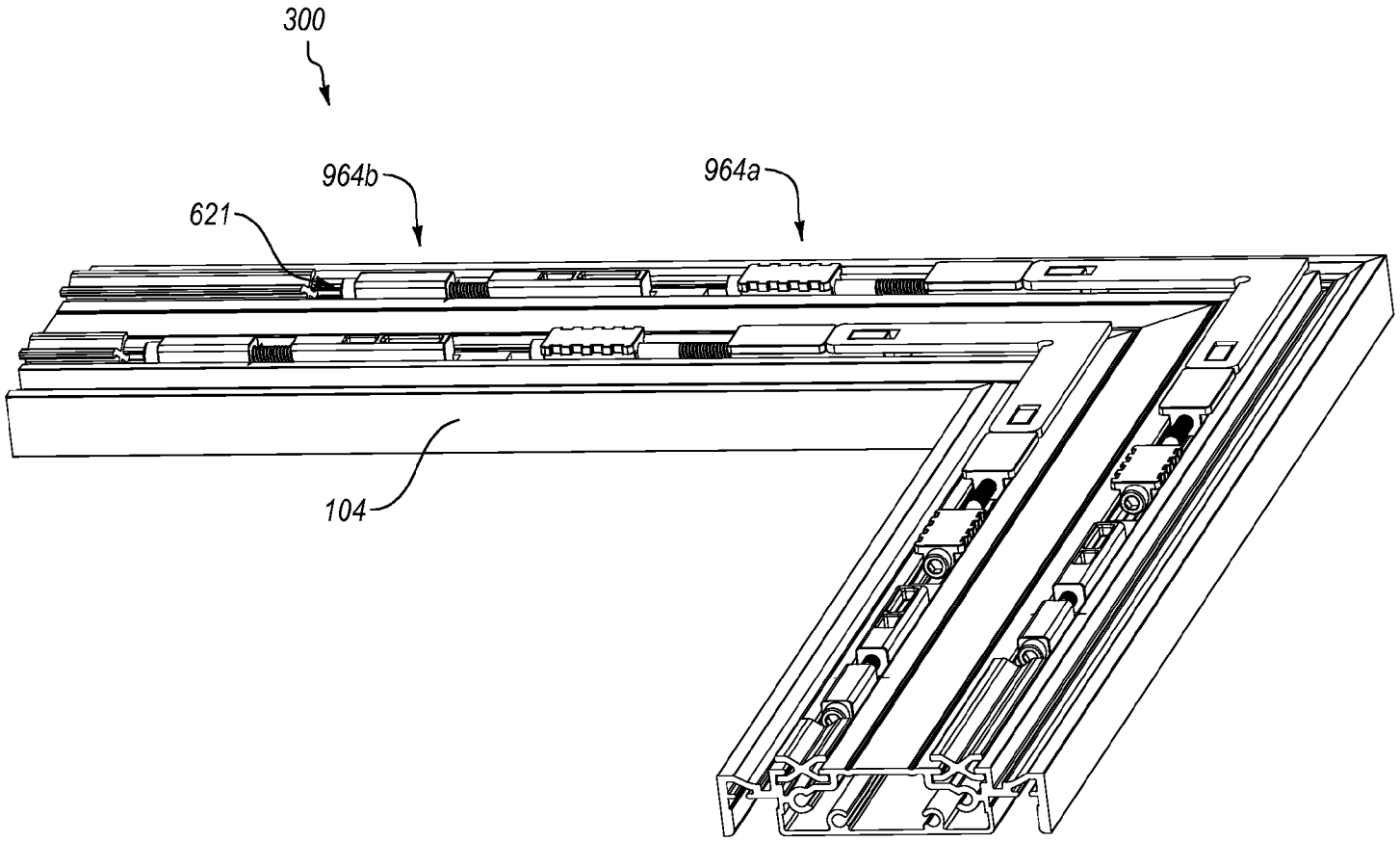
FIG. 21B illustrates a perspective view of an assembly of some of components shown in FIG. 21A.
Figure 21C:
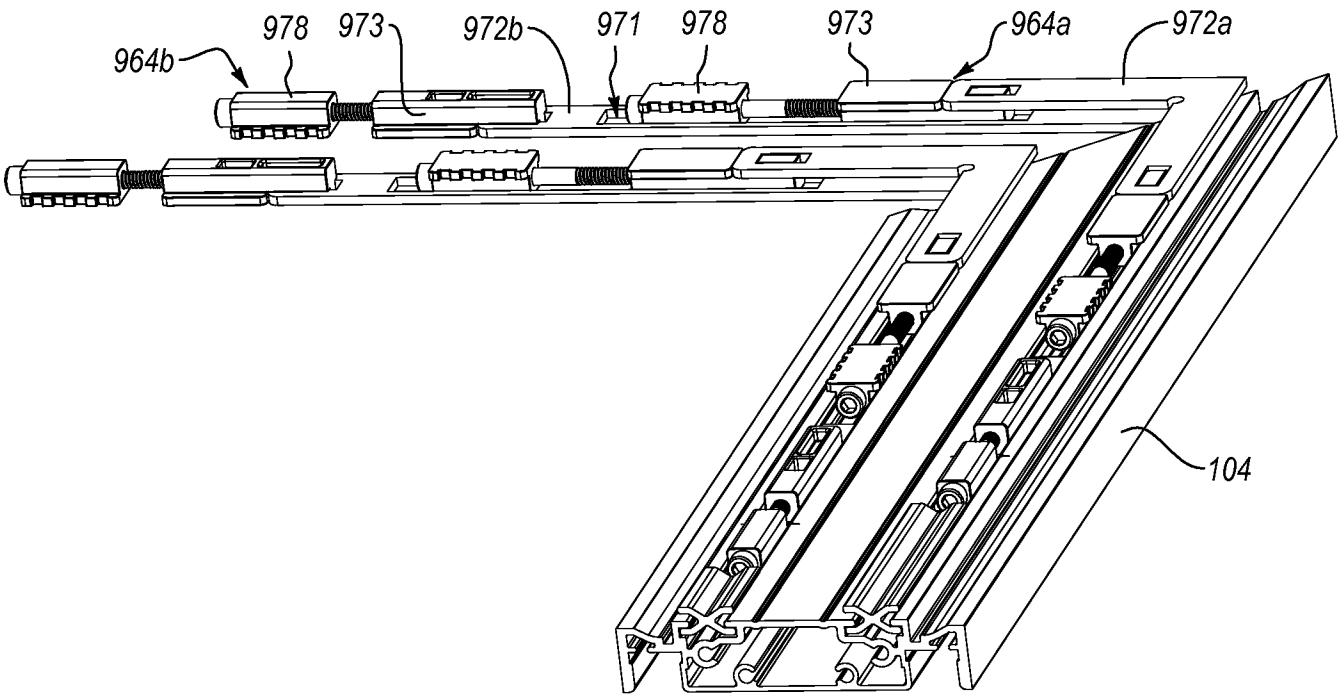
FIG. 21C illustrates a perspective view of an assembly of some of components shown in FIG. 21B.

Unlike assembly 300*e* of FIG. 20A, assembly 300*f* of FIG. 21A includes four connection components 104*f* arranged and secured together in a horizontally-adjacent and vertically-adjacent, angled configuration. As discussed above, connection interface component 726 can be positioned or disposed at least partially within attachment interface channel(s) 620 of or formed by at least one upper and at least one lower connection components 104*f* (or respective interface channels 621 thereof), securing vertically-adjacent upper and lower connection components 104*f* together. FIGS. 21B and 21C further illustrate an exemplary mechanism of securing horizontally-adjacent (upper or lower) connection components 104*f* together at an angle while still allowing, permitting, and/or accommodating connection interface component 726 to be positioned or disposed at least partially within attachment interface channel(s) 620.

FIG. 21B illustrates assembly 300*f* having both upper connection components 104*f* removed therefrom, exposing alignment elements 964*a* and 964*b* disposed within channel 621 of connection components 104*f*. Alignment elements 964*a* and 964*b* can at least partially occupy a shared space within channel(s) 621. Alignment elements 964*a* and 964*b* can be substantially similar (in structure and function) to alignment element 964 with one or more significant differences. For instance, alignment elements 964*a* and 964*b* can include angled translational members 972*a* and 972*b* (see FIG. 21C), respectively.

As illustrated in FIGS. 21B and 21C, angled translational members 972*a* and 972*b* can be configured to fit within the angled transition between channel(s) 620 of assembly 300*f* (or 621 of connection components 104*f* thereof). Angled translational members 972*a* can accommodate the angled alignment of connection components 104*f* in a manner similar to the linear alignment described above in reference to FIG. 20A and alignment element 964. For instance, similar to the mechanism of operation for alignment element 964, operation of alignment elements 964*a* and 964*b* can pull or draw certain (alignment) components together, thereby drawing horizontally-adjacent connection components 104*f* toward one another. Such pulling motion can continue until connection components 104*f* are aligned in proper fashion (e.g., as illustrated in FIG. 21A).

In addition, as illustrated in FIG. 21C, which illustrates assembly 300*f* having an additional (lower) connection component 104*f* removed therefrom, translational member 972*b* of alignment element 964*b* can have an opening 971 disposed therein. Opening 971 can be configured to receive and/or accommodate one or more components of alignment element 964*a* therein. Thus, alignment elements 964*a* and 964*b* can be at least partially superimposable within channel 620, in at least one plane or dimension. Because alignment elements 964*a* and 964*b* each comprise channel attachment member 978 (oriented in opposite directions), alignment elements 964*a* and 964*b* can be disposed at least partially within (and secured to) respective channels 621 of opposing (upper and lower, respectively) connection components 104*f*.

Furthermore, one or more arms of translational member 972*b* can be substantially longer than one or more arms of translational member 972*a*. Accordingly, channel attachment member 978 of alignment element 964*b* can be positioned, disposed, secured, and/or attached further from interface 960*a* than channel attachment member 978 of alignment element 964*a* in some implementations. Similarly, alignment element attachment members 973 of alignment element 964*b* can be positioned, disposed, secured, and/or attached further from interface 960*a* than alignment element attachment members 973 of alignment element 964*a* in some implementations.

In at least one implementation, alignment elements 964*a* and 964*b* can be independently operated to fine-tune the attachment of connection components 104*f*. For instance, in at least one implementation, alignment element 964*a* can be placed and/or positioned at least partially within aligned channels 621 of horizontally-adjacent (lower) connection components 104*f*. Alignment element 964*a* can then be operated to secure together the horizontally-adjacent connection components 104*f*. Alignment element 964*b* can be placed and/or positioned (e.g., over-laid) atop alignment element 964*a*. Specifically, opening 971 can be disposed over or about one or more components (e.g., alignment element attachment members 973, aligning member 975, channel attachment member 978, etc. see FIG. 20B) of alignment element 964*a* (at least partially within aligned channels 621 of horizontally-adjacent connection components 104*f*). Additional horizontally-adjacent (upper) connection components 104*f* can be attached to positioned alignment element 964*b*, which can then be operated to secure together the additional horizontally-adjacent (upper) connection components 104*f*.

Those skilled in the art will appreciate that in certain implementations, the linear and/or corner-implementing and/or accommodating features and/or components described herein can also be implemented to adjoin corners of other components, including frame elements and/or tiles, etc.

Figure 22A:
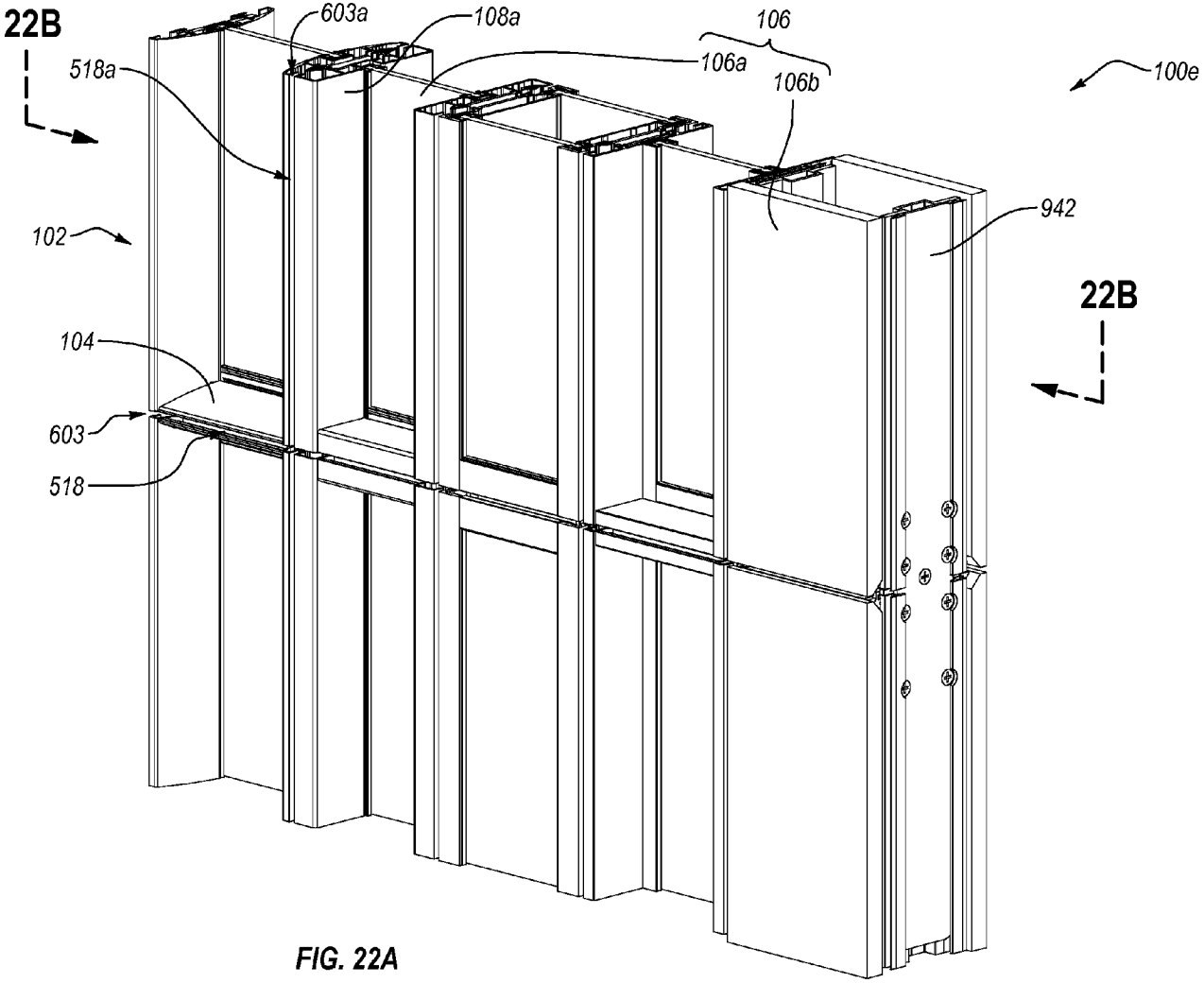
FIG. 22A illustrates a perspective view of one of the wall systems shown in FIG. 5.

FIG. 22A illustrates a perspective view of a modular wall 100*e* (see also FIG. 5) according to an implementation of the present disclosure. Like other modular walls described herein, modular wall 100*e* comprises a plurality of modules 102 connected (vertically) at an interface 603 and/or (horizontally) at an interface 603*a*. In particular, each module 102 can have at least one connection component 104 connected (vertically) to an adjacent connection component 104 of an adjacent module 102 and/or at least one frame element 108*a* connected (horizontally) to adjacent frame elements 108*a* of an adjacent module 102. Adjacent modules 102 can form a horizontally extending channel 518 and/or a vertically extending channel 518*a*. In addition, each module 102 can have one or more tiles 106 connected thereto. Furthermore, adjacent modules 102 can have one or more splines 942 disposed therebetween.

Figure 22B:
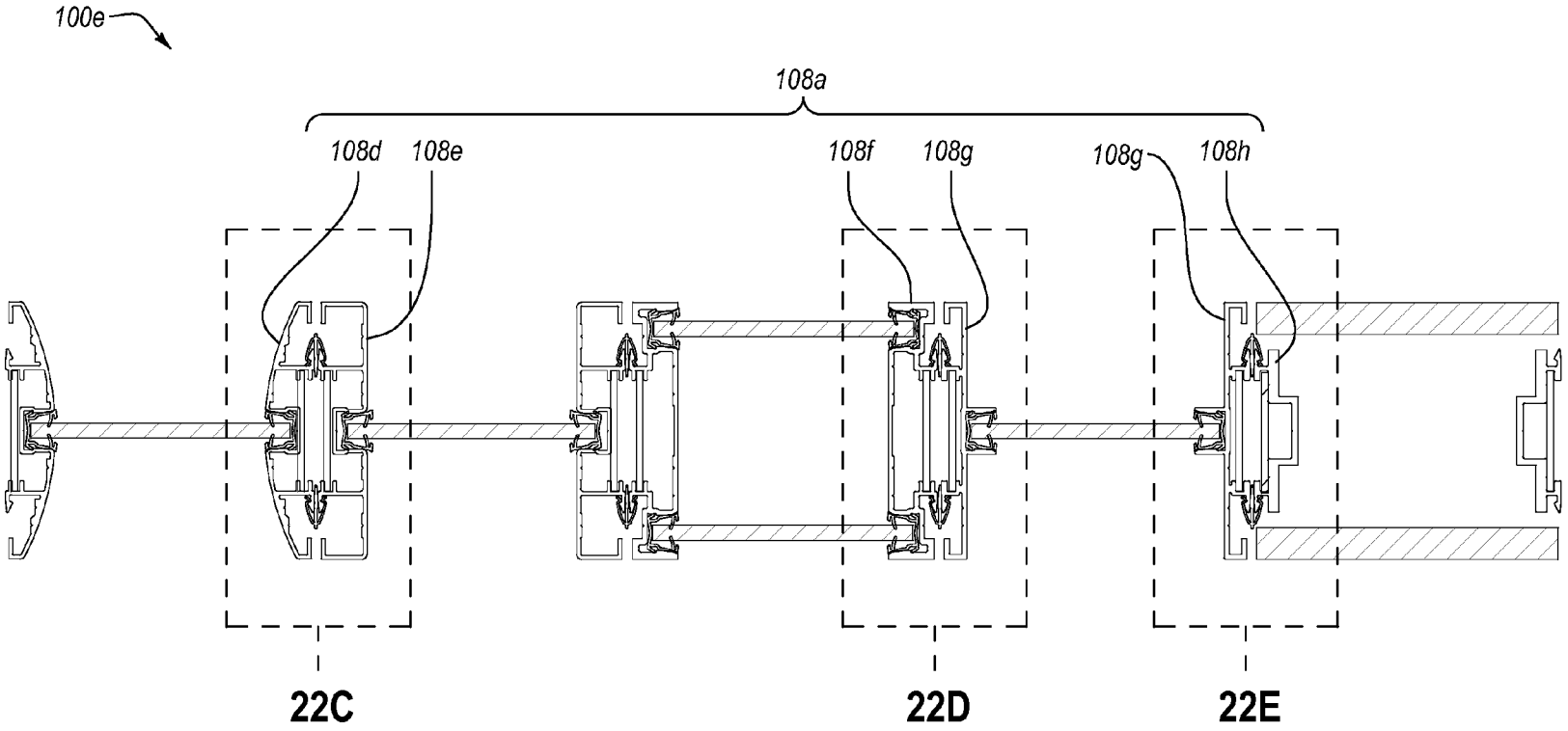
FIG. 22B illustrates a cross-sectional view of the wall system shown in FIG. 22A.
Figure 22C:
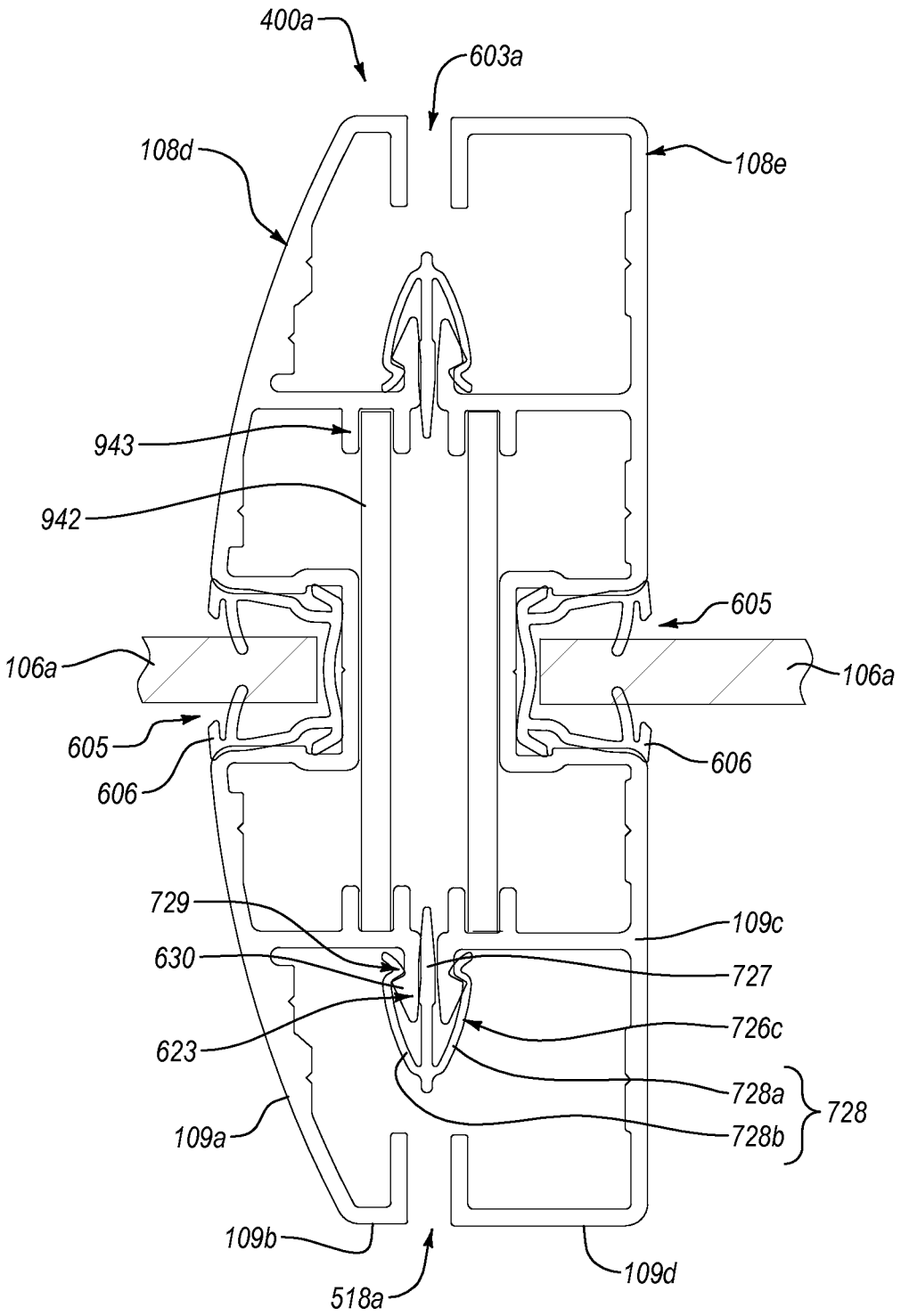
FIG. 22C illustrates a cross-sectional detailed view of a portion of the wall system shown in FIG. 22A.
Figure 22D:
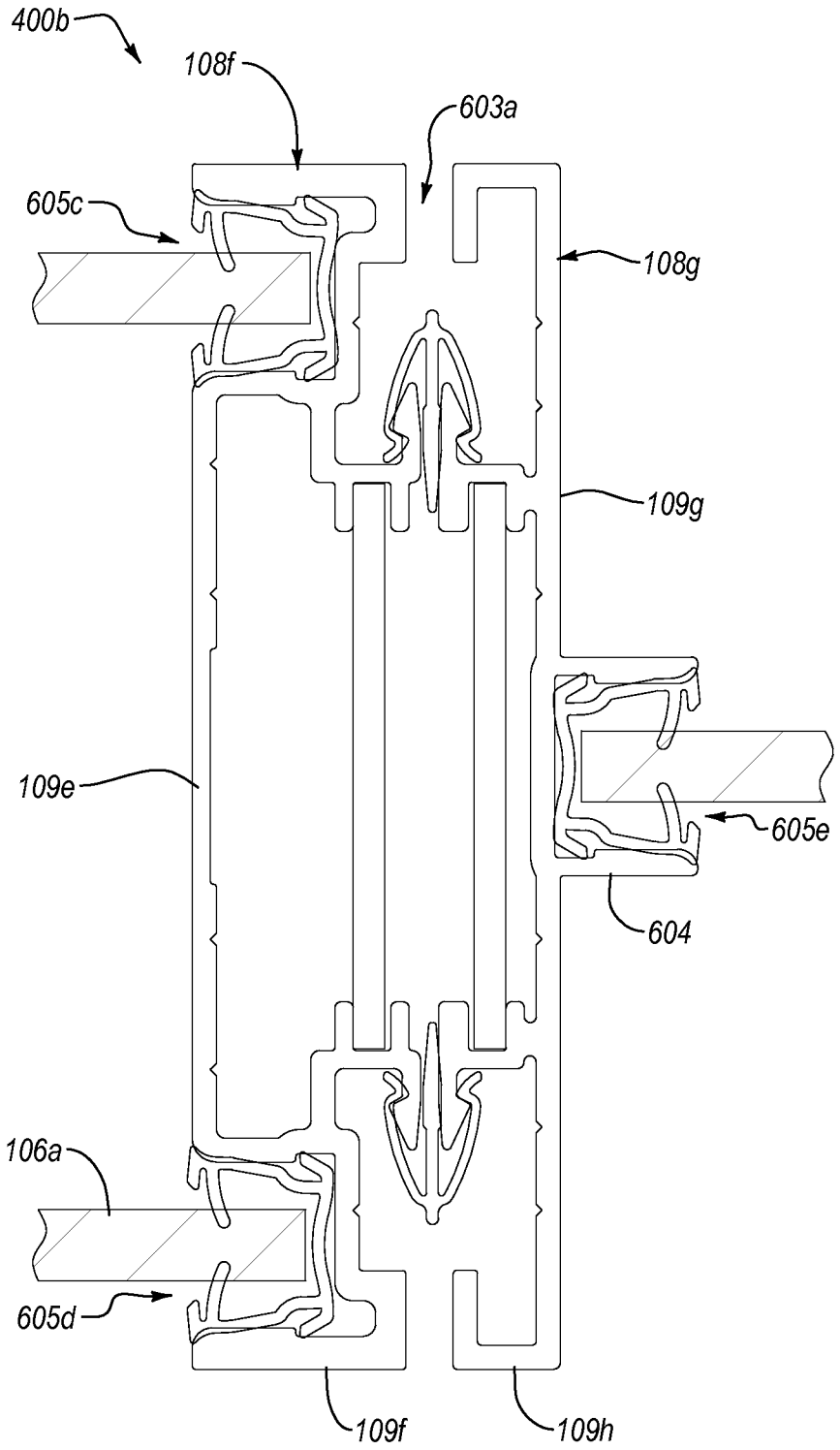
FIG. 22D illustrates a cross-sectional detailed view of another portion of the wall system shown in FIG. 22A.
Figure 22E:
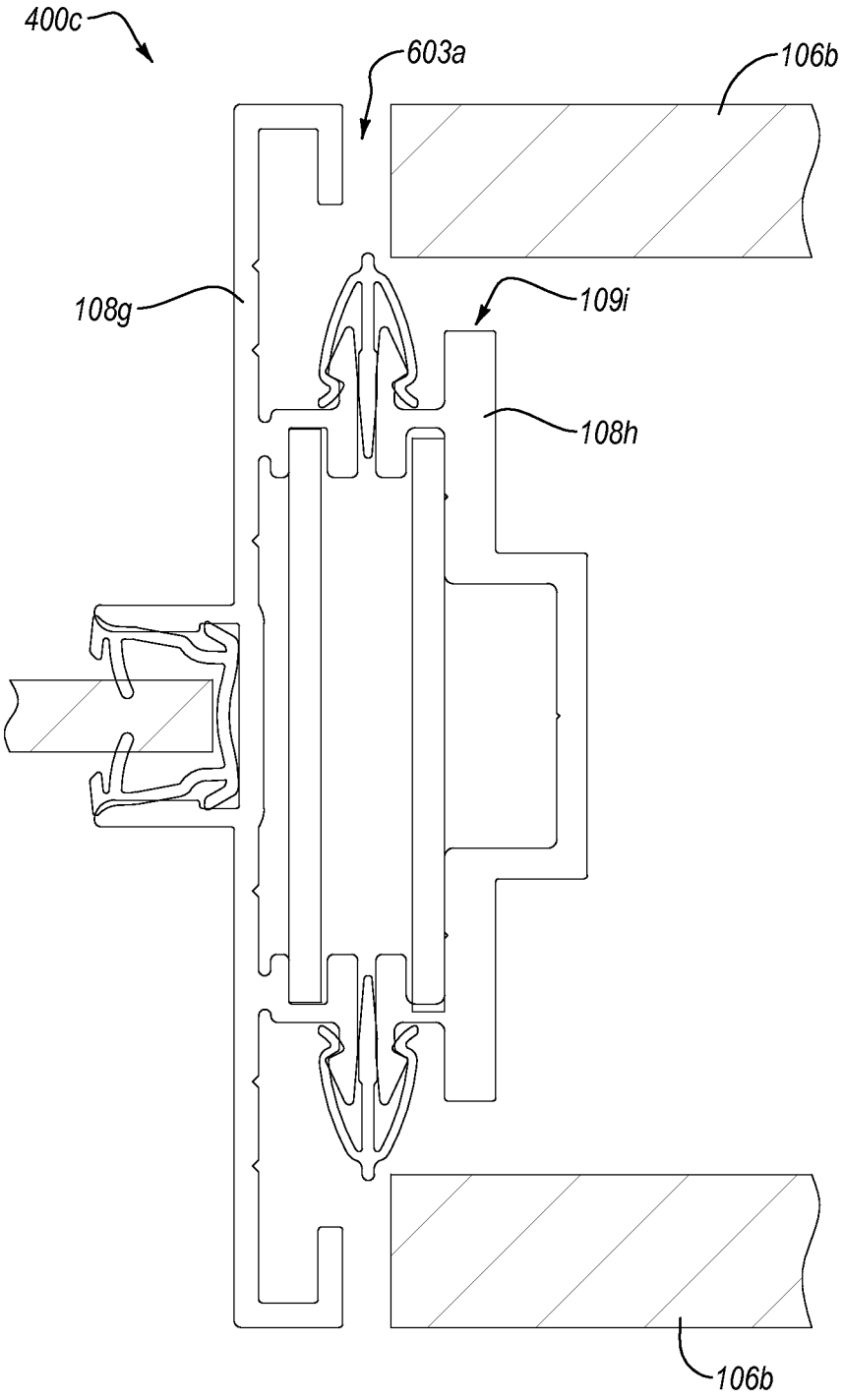
FIG. 22E illustrates a cross-sectional detailed view of another portion of the wall system shown in FIG. 22A.

FIG. 22B illustrates a cross-sectional view of modular wall 100*e* (along line 22B of FIG. 22A). Specifically, FIG. 22B illustrates exemplary connections and/or interactions between the various frame elements 108*a*. As discussed in further detail below, frame elements 108*a* can have certain features and/or components that are similar and/or identical to those found in connection components 104. Each exemplary connection and/or interaction is designated by the numbering of the specific figure in which it appears. For instance, the connection and/or interaction between frame elements 108*d* and 108*e* is illustrated in FIG. 22C, the connection and/or interaction between frame elements 108*f* and 108*g* is illustrated in FIG. 22D, and the connection and/or interaction between frame elements 108*g* and 108*h* is illustrated in FIG. 22E. Accordingly, inner frame elements 108*a* can have a variety of configurations, shapes, and/or sizes, as illustrated in FIGS. 22A-22E.

As indicated above, FIG. 22C illustrates the connection and/or interaction between frame elements 108*d* and 108*e* at interface 603*a* to form an assembly 400*a*. Assembly 400*a* can have a channel 518*a* disposed between frame elements 108*d* and 108*e*. Frame element 108*d* can have a curved or curvilinear configuration, with a curved outer surface 109*a* and substantially linear opposing side surfaces 109*b*. Frame element 108*e* can have a linear or rectilinear configuration, with a linear outer surface 109*c* and substantially linear opposing side surfaces 109*d*. In at least one implementation, side portions 109*d* can be substantially longer than side portions 109*b*.

Frame elements 108*d* and 108*e* can each have a centrally disposed channel or tile receiving element 605 recessed into outer surface 109*a*, 109*c*. Channel 605 can have a tile securing or attachment element 606 disposed therein and configured to receive a tile 106*a*. In addition, frame elements 108*d* and 108*e* can each have one or more interface components 623. Interface components 623 can be configured to be secured together by means of connection interface member 726*c*. Connection interface member 726*c* can comprise a body portion 727 and one or more arms 728 extending therefrom. For instance, connection interface member 726*c* can comprise opposing arms 728*a* and 728*b*, extending from the body portion 727.

In at least one implementation, connection interface member 726*c* can secure frame elements 108*d* and 108*e* together at interface 603*a* by attachment to respective interface components 623 thereof. For instance, body portion 727 of connection interface member 726*c* can be inserted between respective interface components 623 of connection components 108*d* and 108*e*. In addition, arms 728 can secure connection interface member 726*c* to interface components 623 via locking mechanism 729. For instance, locking mechanism 729 can comprise one or more protrusions and/or extensions configured to interact with one or more ledges or recesses 630 of interface component 623.

As illustrated in FIG. 22C, arms 728 can form a substantially V-shaped structure with body portion 727 extending therebetween. However, other configurations of connection interface member 726*c* are also contemplated herein. For example, connection interface member 726*c* can comprise a C-shaped, U-shaped, W-shaped, Y-shaped, T-shaped, E-shaped, or other configuration. Indeed, connection interface member 726*c* can comprise any means for securing frame elements 108 and/or interface components 623 thereof together at interface 603*a*.

In at least one implementation, a spline 942 can be disposed and/or inserted into spline receiving element(s) 943. For instance, a spline 942 can be disposed within opposing spline receiving element 943 between opposing interface components 623 of each frame element 108. In an alternative implementation, a single spline 942 can be disposed between adjacent and/or attached frame elements 108. In certain implementations, spline receiving element 943 can comprise a recess or channel configured to receive spline 942.

FIG. 22D illustrates the connection and/or interaction between frame elements 108*f* and 108*g* at interface 603*a* to form an assembly 400*b*. Assembly 400*b* can be configured substantially similar to assembly 400*a* above, with one or more notable differences. For instance, frame element 108*f* can comprise opposing channels or tile receiving elements 605*c* and 605*d* disposed between a substantially linear outer surface 109*e* and substantially linear side portions 109*f*. Frame element 108*g*, on the other hand, can comprise at least one channel or tile receiving element 605*e* extending outwardly from substantially linear outer surface 109*g*. For instance, channel 605*e* can comprise opposing channel walls 604 in certain implementations. Opposing channel walls 604 can extend outwardly from surface 109*g*. Frame element 108*g* can also include substantially linear side portions 109*h*.

FIG. 22E illustrates the connection and/or interaction between frame elements 108*g* and 108*h* at interface 603*a* to form an assembly 400*c*. In at least one implementation, frame element 108*h* can be configured to accommodate one or more (e.g., opposing) tiles 106*b*. Frame element 108*h* can have a thinner and/or shorter profile (e.g., between the opposing side portions 109*i*) than frame elements 108*g* configured to receive one or more tiles 106*a*. In at least one implementation, tile(s) 106*a* can be connected to connection component 104 (see FIG. 22A) and/or not directly and/or indirectly attached to frame element 108*h*. One will appreciate, however, that direct and/or indirect attachment of tile(s) 106*a* to frame element 108*h* is also contemplated herein.

Furthermore, the implementation of additional components and/or features known in the art and/or desirable in certain implementations of the present invention will be apparent to those skilled in the art and/or in light of the present disclosure or become apparent through the practice thereof. For instance, certain implementations may include acoustic and/or other tiles or panels mounted to, about, and/or within components, modules, subunits, walls, and/or systems disclosed herein. Furthermore, the absence of such known or apparent features should not be construed as restricting the scope or application of the present disclosure to the exclusion of such features.

Reconfigurable Curved Partition Systems

The systems and components of FIGS. 1-22E are illustrated as forming generally planar or straight partitions (e.g., walls, ceilings, etc.). However, as indicated above, certain implementations of the present disclosure can include angled and/or curved partitions. For instance, as described below in connection with FIGS. 23-25, implementations of the present disclosure allow for the formation of curved, arched, or other non-planar partitions. Many of the same or similar components described above may be used in the systems described in connection with FIGS. 23-25. Accordingly, in describing the systems of FIGS. 23-25, attention will be directed primarily to those components and features that are different or differently configured from the components, elements, members, and/or features described in connection with FIGS. 1-22E.

Figure 23:
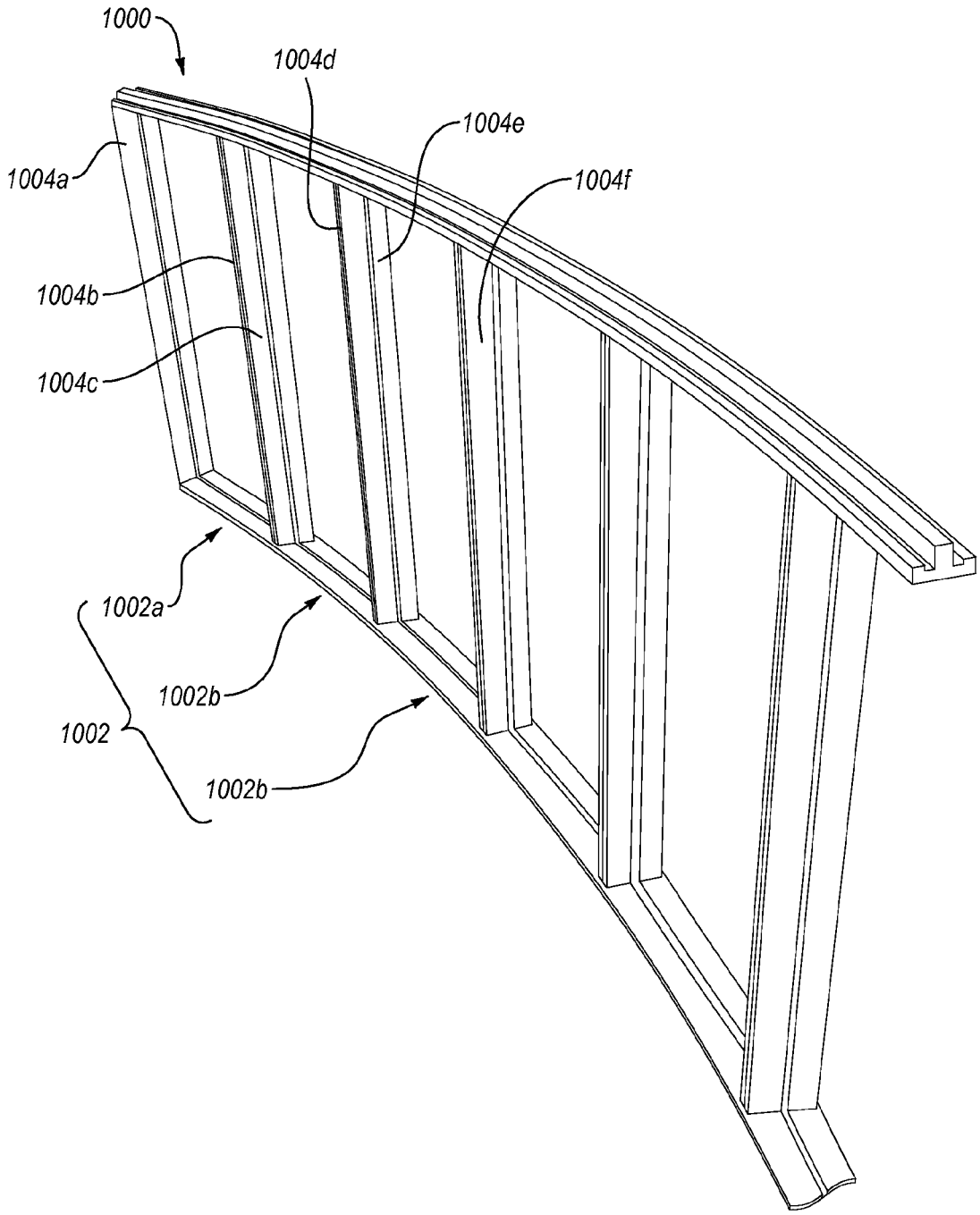
FIG. 23 illustrates a perspective view of a frame of a curved partition system according to one or more implementations of the present invention.

FIG. 23 illustrates a frame 1000 that is formed in a curved or arched configuration. The frame 1000 may be used to form a curved wall or the frame 1000 may be reoriented and used to form a curved or arched ceiling. As can be seen, the frame 1000 is formed of a plurality of modules 1002 (e.g., 1002*a*, 1002*b*, 1002*c*) that are connected together. The modules 1002 may be similar or identical to the modules described elsewhere herein (e.g., modules 102, 102', etc.). For instance, each module 1002 may include one or more connection components 1004 (e.g., 1004*a*, 1004*b*, 1004*c*, 1004*d*, 1004*e*, 1004*f*), which may be similar or identical to the connection components described elsewhere herein (e.g., connection components 104, 104', etc.). The one or more connection components 1004 of each module 1002 may be connected and/or attached to the one or more connection components 1004 of another module 1002 to connect the modules 1002 together. While not illustrated, one or more tiles (e.g., tiles 106) may be attached or attachable to the connection components 1004 on one, both, or more sides of the frame 1000.

Figure 24A:
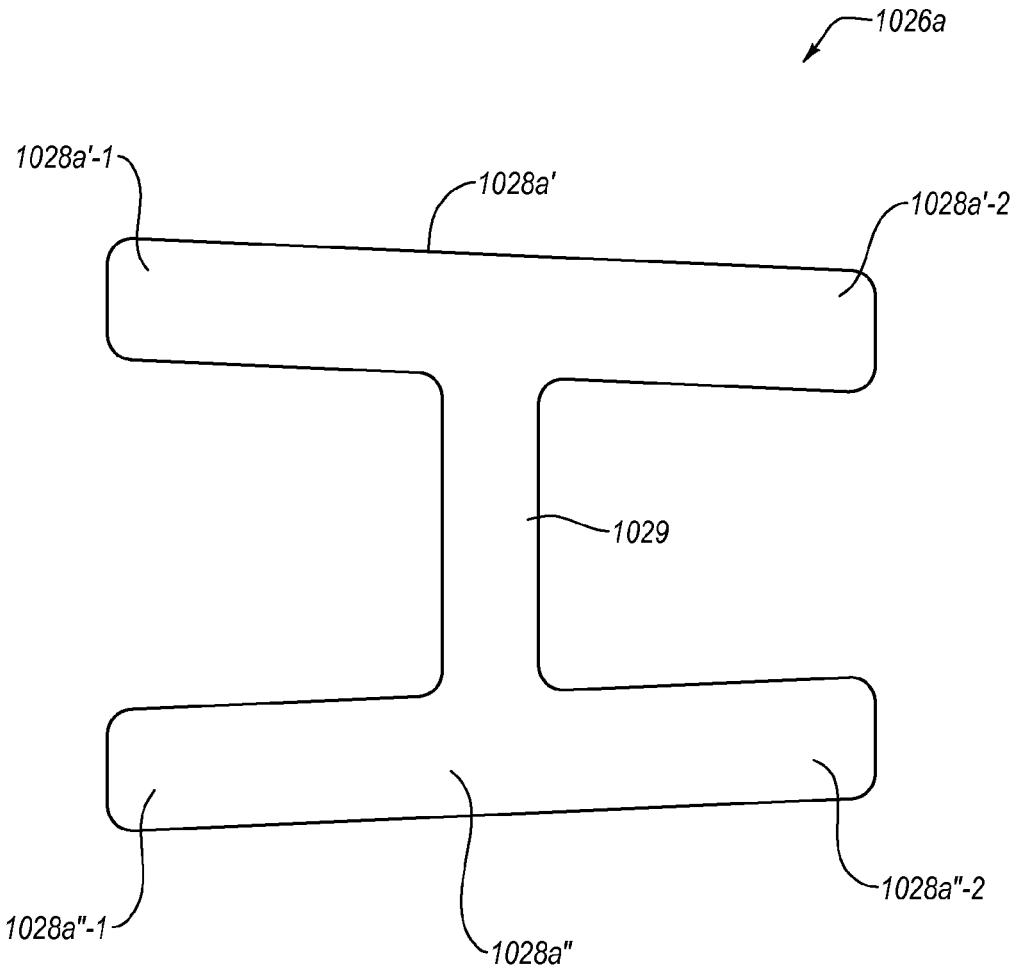
FIG. 24A illustrates an end view of an example connection interface components for use in the curved partition system of FIG. 23.
Figure 24B:
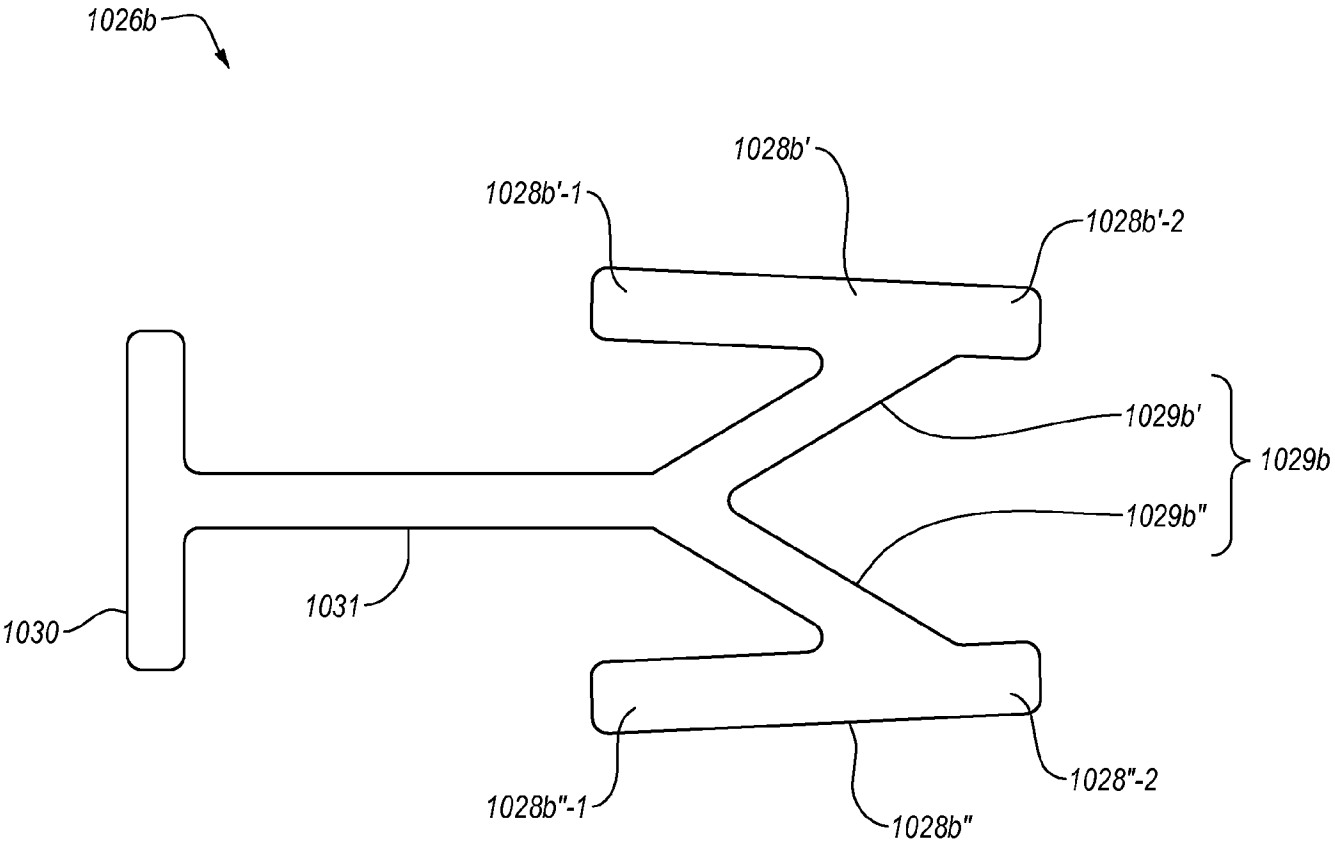
FIG. 24B illustrates an end view of another example connection interface components for use in the curved partition system of FIG. 23.

The one or more connection components 1004 may be connected and/or attached to one another in a manner similar to that described above in connection with connection components 104, 104', etc. More specifically, the connection components 1004 may be connected and/or attached to one another with a connection interface component. FIGS. 24A-24B illustrate example implementations of connection interface components that enable connection components 1004 to be connected together in an angled, non-planar, or non-parallel configuration such that modules 1002 may form a curved, arched, or other non-planar partition.

FIG. 24A illustrates a connection interface component 1026*a* that has first and second channel engagement elements 1028*a'*, 1028*a"* connected by an intermediate member 1029*a*. The first channel engagement element 1028*a'* has a first end 1028*a'*-1 and an opposing second end 1028*a'*-2. Similarly, the second channel engagement element 1028*a"* has a first end 1028*a'*-1 and an opposing second end 1028*a"*-2. In the illustrated implementation, the intermediate member 1029*a* is connected to the first channel engagement element 1028*a'* between the first and second ends 1028*a'*-1, 1028*a'*-2 thereof. Likewise, the intermediate member 1029*a* is connected to the second channel engagement element 1028*a"* between the first and second ends 1028*a"*-1, 1028*a"*-2 thereof.

In some implementations, the first and second channel engagement elements 1028*a'*, 1028*a"* may be angled relative to one another or be arranged in a non-parallel configuration. For instance, as shown in FIG. 24A, the first and second channel engagement elements 1028*a'*, 1028*a"* may be angled relative to one another such that first ends 1028*a'*-1, 1028*a"*-1 are spaced further apart from one another than second ends 1028*a"*-1, 1028*a"*-2. As will be described in greater detail below, the angled or non-parallel configuration of first and second channel engagement elements 1028*a'*, 1028*a"* may allow the connection interface component 1026*a* to connect the connection components 1004 together in an angled, non-planar, or non-parallel manner.

FIG. 24B illustrates a connection interface component 1026*b* that has first and second channel engagement elements 1028*b'*, 1028*b"* connected by an intermediate member 1029*b*. The first channel engagement element 1028*b'* has a first end 1028*b'*-1 and an opposing second end 1028*b'*-2. Similarly, the second channel engagement element 1028*b"* has a first end 1028*b'*-1 and an opposing second end 1028*b"*-2. In the illustrated implementation, the intermediate member 1029*b* is connected to the first channel engagement element 1028*b'* between the first and second ends 1028*b'*-1, 1028*b'*-2 thereof. Likewise, the intermediate member 1029*b* is connected to the second channel engagement element 1028*b"* between the first and second ends 1028*b"*-1, 1028*b"*-2 thereof.

In the illustrated implementation, the intermediate member 1029*b* is formed of a first part 1029*b'* and a second part 1029*b"* that form an angle relative to one another. In some implementations, the first and second parts 1029*b'*, 1029*b"* form an acute angle, while in other implementations the first and second parts 1029*b'*, 1029*b"* for a right angle or an obtuse angle. While the angle formed by the first and second parts 1029*b'*, 1029*b"* opens towards the second ends 1028*b'*-2, 1028*b"*-2 in the illustrated implementation, the first and second parts 1029*b'*, 1029*b"* may be oriented so that the angle formed by the first and second parts 1029*b'*, 1029*b"* opens towards the first ends 1028*b'*-1, 1028*b"*-1. In still other implementations, the intermediate member 1029*b* may be formed of a straight member, similar to intermediate member 1029*a*.

In some implementations, the first and second channel engagement elements 1028*b'*, 1028*b"* may be angled relative to one another or be arranged in a non-parallel configuration. For instance, as shown in FIG. 24B, the first and second channel engagement elements 1028*b*', 1028*b*" may be angled relative to one another such that first ends 1028*b*'-1, 1028*b*"-1 are spaced further apart from one another than second ends 1028*b*"-1, 1028*b*"-2. As will be described in greater detail below, the angled or non-parallel configuration of first and second channel engagement elements 1028*b*', 1028*b*" may allow the connection interface component 1026*b* to connect the connection components 1004 together in an angled, non-planar, or non-parallel manner.

As illustrated in FIG. 24B, the connection interface component 1026*b* may also include a trim element 1030 connected to the intermediate member 1029*b* by an extension member 1031. In the illustrated implementation, the extension member 1031 extends from the apex of the angle formed by the first and second parts 1029*b*', 1029*b*" of the intermediate member 1029*b*. As discussed below, the trim element 1030 may cover, close, or seal a gap formed between connection components 1004 connected together with the connection interface component 1026*b*.

Figure 25:
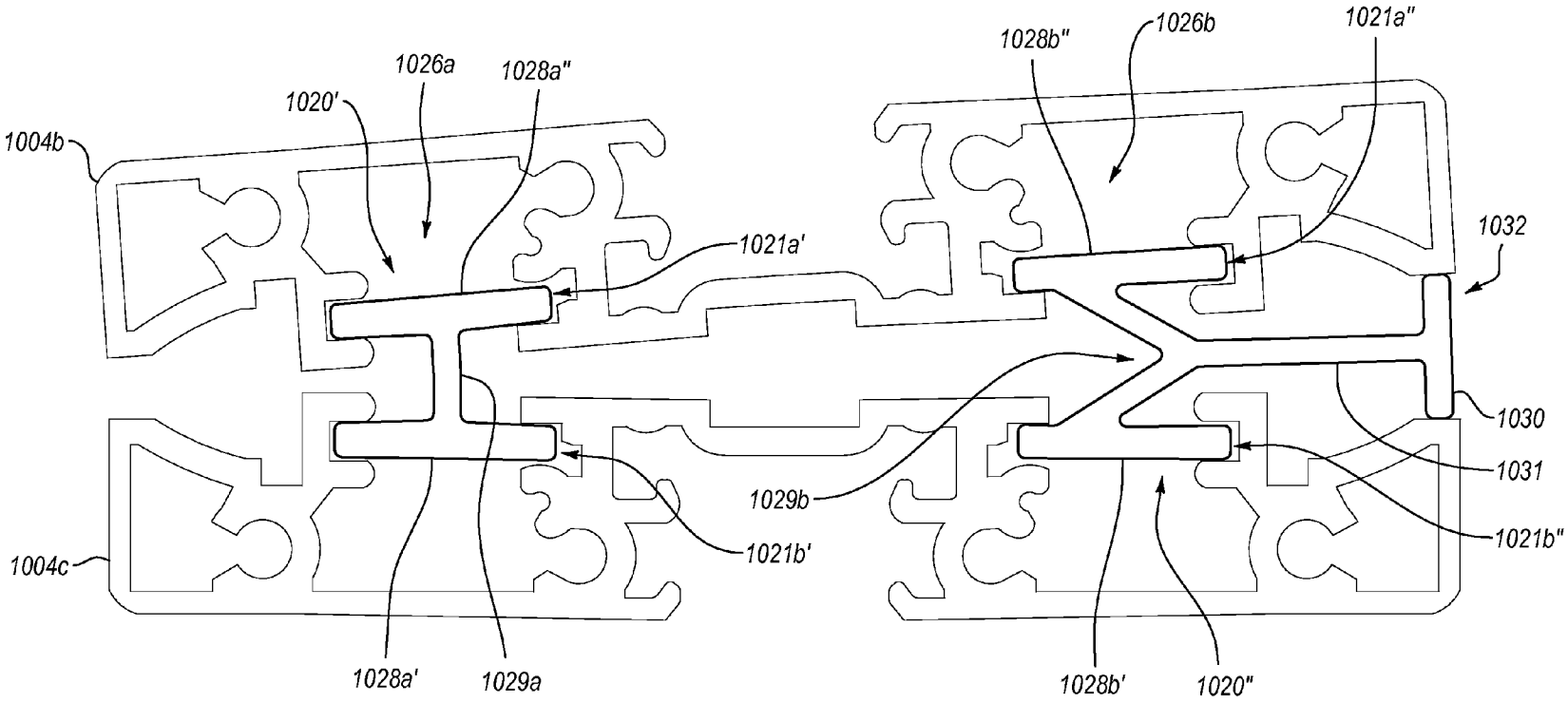
FIG. 25 illustrates a partial cross-sectional view of the frame of FIG. 23 showing the connection interface components of FIGS. 24A-24B connecting adjacent connection components.

As noted above, the connection interface components 1026*a*, 1026*b* can secure a plurality of connection components 1004 together. FIG. 25 illustrates one example manner of the connection interface components 1026*a*, 1026*b* connecting together the connection components 1004*b*, 1004*c* of modules 1002*a*, 1002*b* (FIG. 23). As with the other connection components described herein, the connection components 1004*b*, 1004*c* cooperate to form one or more attachment interface channels 1020 (e.g., 1020', 1020"). For instance, the connection component 1004*b* may include first and second interface channels 1021*a*', 1021*a*" and the connection component 1004*c* may include first and second interface channels 1021*b*', 1021*b*". The first interface channels 1021*a*', 1021*b*' may cooperate to form a first attachment interface channel 1020' and the second interface channels 1021*a*", 1021*b*" may cooperate to form a second attachment interface channel 1020".

The connection interface components 1026*a*, 1026*b* may be inserted and/or otherwise positioned within the attachment interface channels 1020 to secure the connection components 1004*b*, 1004*c* together. For instance, as illustrated in FIG. 25, the connection interface component 1026*a* is inserted and/or otherwise positioned within the attachment interface channel 1020'. In particular, the first channel engagement element 1028*a*' (or a portion thereof) of connection interface component 1026*a* is engaged within the first interface channel 1021*b*' (or a portion thereof) of the connection component 1004*c*. Likewise, the second channel engagement element 1028*a*" (or a portion thereof) of connection interface component 1026*a* may engage the second interface channel 1021*a*' (or a portion thereof) of the connection component 1004*b*, thereby securing, coupling, connecting, and/or attaching the connection components 1004*b*, 1004*c*. Notably, because the first and second channel engagement elements 1028*a*', 1028*a*" are angled relative to one another, the connection interface component 1026*a* connects the connection components 1004*b*, 1004*c* together at an angle or in a non-planar or non-parallel manner.

Similarly, the connection interface component 1026*b* is inserted and/or otherwise positioned within the attachment interface channel 1020". In particular, the first channel engagement element 1028*b*' (or a portion thereof) of connection interface component 1026*b* is engaged within the first interface channel 1021*b*" (or a portion thereof) of the connection component 1004*c*. Likewise, the second channel engagement element 1028*b*" (or a portion thereof) of connection interface component 1026*b* may engage the second interface channel 1021*b*' (or a portion thereof) of the connection component 1004*b*, thereby securing, coupling, connecting, and/or attaching the connection components 1004*b*, 1004*c*. Notably, because the first and second channel engagement elements 1028*b*', 1028*b*" are angled relative to one another, the connection interface component 1026*b* connects the connection components 1004*b*, 1004*c* together at an angle or in a non-planar or non-parallel manner.

When the connection components 1004*b*, 1004*c* are connected together at an angle or in a non-planar or non-parallel manner, as shown in FIG. 25, a gap 1032 may be formed between adjacent ends of the connection components 1004*b*, 1004*c*. The trim element 1030 of connection interface component 1026*b* may be positioned adjacent to or within the gap 1032 so as to cover, close, or seal the gap 1032. In the illustrated implementation, the trim element 1030 is positioned within the gap 1032 (i.e., between the connection components 1004*b*, 1004*c*) so that opposing ends thereof contact the surfaces of the connection components 1004*b*, 1004*c*. In other implementations, the extension member 1031 is long enough to position the trim element 1030 outside of the gap 1032. In such implementations, the trim element 1030 may be long enough to span the gap 1032 so as to cover or otherwise conceal the gap 1032.

In the illustrated implementation, the first and second channel engagement elements 1028*a*', 1028*a*" form an angle of about 5°. Similarly, the first and second channel engagement elements 1028*b*', 1028*b*" for an angle of about 5°. As a result, the connection components 1004*b*, 1004*c* form an angle of about 5°. The result of the connection components 1004*b*, 1004*c* forming an angle of about 5° is that the modules 1002*a*, 1002*b* (of which the connection components 1004*b*, 1004*c* are a part) are oriented at an angle of about 5° relative to one another. When additional modules 1002 are connected to the modules 1002*a* and/or 1002*b* at angles in a similar manner, the resulting frames (and partition) form a curved, angled, non-planar, or non-parallel configuration.

It will be appreciated that connection interface components may be formed with channel engagement elements that are oriented at various angles relative to one another. For instance, while the channel engagement elements 1028 are illustrated at approximately 5°, channel engagement elements may be oriented at a variety of different angles (e.g., 2.5°, 10°, 15°, 30°, 45°, etc.). Moreover, two modules (e.g., 1002*a*, 1002*b*) may be connected together with connection interface components having channel engagement elements oriented at a first angle while two other modules (e.g., 1002*b*, 1002*c*) may be connected together with connection interface components having channel engagement elements oriented at a second angle that is different than the first angle. Furthermore, the angles between adjacent modules 1002 may open in different directions. For instance, modules 1002*a*, 1002*b* may form an angle that opens to a first side of the frame while modules 1002*b*, 1002*c* form an angle that opens to a second side of the frame. Thus, in some implementations the angled connection interface components may allow for a frame to have a curved or arched configuration when the angled connection interface components are oriented in a similar manner. In other implementations, the angled connection interface components may allow for a frame to have a zig-zag or wave configuration when the angled connection interface components are oriented in dissimilar manners. Accordingly, various combinations of curved and straight walls, ceilings, or other partitions can be connected in some embodiments. Likewise, various combinations of curved and straight walls, ceilings, or other partitions can be connected to form unique design features.

Methods of Configuring Wall Systems

In at least one implementation, a method of assembling a wall system comprises providing a plurality of modules 102 configured to be arranged into a modular structure, wherein each module 102 comprises at least one connection component 104 configured to be attached to a connection component 104 of another module 102. A variety of methods related to assembling a wall system have already been described above. For instance, some methods can include aligning a connection component 104 of a first module 102 with a connection component 104 of a second module 102 at a connection interface 603. In one or more implementations, the connection interface 603 can be universal among modules 102 (or connection components 104 thereof) of the wall system. Furthermore, implementations can include reversibly securing the first module 102 to the second module 102 by means of a connection interface member 726.

In some implementations, the connection component 104 of the first module 102 comprises an interface channel 621 that aligns at the connection interface 603 with a corresponding interface channel 621 of the connection component 104 of the second module 102 (e.g., to form a connection interface channel 620). The method can also include reversibly securing the first module 102 to the second module 102 by inserting or otherwise attaching the connection interface member 726 into the connection interface channel 620 and/or the respective interface channels 621 of the respective connection components 104 of the first and second modules 102 such that the respective interface channels 621 remain aligned while the connection interface member 726 is at least partially positioned therein.

In an implementation, at least the first module 102 comprises first and second connection components 104 positioned on opposite ends of the first module 102. Moreover, at least the first module 102 can include a tile 106 attached to the opposing connection components 104 of the first module 102, wherein the tile 106 comprises at least one of a transparent material, a translucent material, and an opaque material. In addition, the first module 102 can comprise one or more frame elements 108 attached to one or more of the connection component 104, the tile 106, and/or a tile attachment member 622, 214, 605, 606. In at least one implementation, the tile 106 is attached to and/or positioned between first and second connection components 104 positioned on opposite ends of the module 102. The method can also include attaching one or more frame elements 108 to the first module 102, wherein the one or more frame elements 108 are configured to support the modules 102.

In at least one implementation, the module 102 can comprise a rectangular or square shaped configuration, with opposing frame elements 108 extending between opposing connection components 104, and on opposing ends thereof. In other implementations, one or more sides of the rectangle or square shaped module can be devoid of a frame element 108 and/or connection component 104. In addition, in certain implementations, the module 102 can be devoid of tile(s) 106 and/or tile attachment member(s) 622, 214, 605, 606.

In some implementations, modules 102 can be secured together (vertically) by means of the connection interface members 726 secured within respective interface channels 621 of adjacent connection components 104 and/or (horizontally) by means of connection interface members 726 secured to respective interface components 623 of adjacent frame elements 108. In addition, modules 102 can be secured together through other mechanisms as described herein. For instance, modules 102 can be secured together through the use of connection interface components 726 attached to or within other than interface channels or to other interface components. Modules 102 can also be secured together with the use of alignment members as described herein.

Certain methods can also include connecting an assembled wall system comprising a plurality of modules 102 to an existing structural wall or wall system. In other implementations, an assembled wall system comprising a plurality of modules 102 can be a freestanding structure. Assembled wall systems can also be attached to floors, subfloors, ceilings, and/or suspended ceilings in some implementations.

In some implementations, the method of assembling a wall system can include assembling a frame 200. The frame 200 can comprise a plurality of connection components 104 and/or frame elements 108. The plurality of connection components 104 and/or frame elements 108 can be assembled into modules 102 within the frame 200 and/or can be connected one to another as described above. One or more tiles 106 can also be attached to the frame 200 and/or modules 102 thereof.

In another implementation, a method of reconfiguring an assembled wall system comprises disabling a module securing mechanism 726 such that first and second modules 102 of a modular structure are unsecured one from another. The method can also include altering the configuration of the modular structure and/or enabling a module securing mechanism 726 such that modules 102 of the modular structure are secured one to another. In at least one implementation, enabling a module securing mechanism 726 comprises (re) enabling the disabled module securing mechanism 726.

Furthermore, altering the configuration of the modular structure can comprise at least one of removing the first module 102, replacing the first module 102 with a second module 102, adding one or more new modules 102, shuffling the respective positions of two or more modules 102, and changing the orientation of at least one module 102. Disabling a module securing mechanism 726 can comprise disengaging a connection interface member 726 that secures the first module 102 to the second module 102. In particular, disengaging a module securing mechanism 726 can comprise removing a connection interface member 726 that secures the first module 102 to the second module 102 (e.g., from an interface channel 620, 621) and/or rotating a connection interface member 726 from an engaged position to a disengaged position, wherein the connection interface member 726 secures the first module 102 to the second module 102 when engaged.

Likewise, enabling a module securing mechanism 726 can include attaching, connecting, securing and/or inserting a connection interface member 726 that secures the first module 102 to the second module 102 (e.g., within the interface channel 620, 621). Alternatively and/or additionally, enabling a module securing mechanism 726 can include rotating a connection interface member 726 from a disengaged position to an engaged position, wherein the connection interface member secures the first module to the second module when engaged.

The systems and components described in connection with FIGS. 1-22E can be used to provide great versatility in the configuration and reconfiguration of modular walls and wall systems. As discussed above, the various connection components 104 and connection interface components 726 can allow for a wide variety of wall configurations and ready assembly, disassembly, and/or reconfiguration. By way of example, the connection components 104 shown in FIG. 6C can be readily connected and/or disconnected from one another by inserting or removing connection interface component 726 therefrom (see FIG. 6D). Similarly, connection components having any of a variety of profiles (e.g., the connection components illustrated in FIGS. 1, 2, 5, 8, 9, 11, 13A-13D, and so forth) can be connected together to form a modular wall.

Furthermore, as discussed above, the various frame elements 108 described herein can likewise allow for a wide variety of wall configurations and ready assembly, disassembly, and/or reconfiguration by means of one or more connection interface components 726, thereby providing great versatility in the configuration and reconfiguration of modular walls and wall systems. By way of example, the frame elements 108 shown in FIG. 22B can be readily connected and/or disconnected from one another by inserting or removing (e.g., by sliding, clipping, attaching, etc.) connection interface component 726 therefrom. Similarly, frame elements 108 having any of a variety of profiles (e.g., the frame elements illustrated in FIGS. 1, 2, 5, 16A-17B, and 23A-23E, and so forth) can be connected together in forming a modular wall.

In light of the disclosure herein, it will be appreciated that the ability to readily connect and disconnect the connection components 104 and/or frame elements 108 from one another provides for ready assembly, disassembly, and reconfiguration of modular walls and wall systems. For instance, the simple connection between two connection components 104 and/or frame elements 108 with a connection interface component 726, as described herein, allows for a modular wall to be assembled in relative short period of time and with minimal effort. Similarly, a modular wall can be disassembled relatively quickly and with minimal effort due to the simplicity of the connection between the connection components 104 and/or frame elements 108.

Moreover, the connection between two connection components 104 and/or frame elements 108 with a connection interface component 726, as described herein, also provides for ready reconfiguration of a modular wall. For instance, in order to reorder two modules 102 (e.g., modules 102*b*, 102*c*, FIG. 1), the connection interface component 726 connecting the adjacent connection components 104 can be removed and the modules 102 can be removed from the modular wall, reordered, inserted back into the modular wall, and connected together again with the connection interface component 726.

Notably, a modular wall can be reconfigured as described without having to disassemble the entire modular wall. Rather, only the modules 102 that are being reordered or replaced need to be disconnection from the modular wall. In addition, the modular wall can provide support for the adjacent modules 102 remaining connected thereto after removal of the modules 102 to be reordered (or removed). Accordingly, external support mechanism(s) (e.g., additional personnel or equipment) may not be required to quickly reorder modules 102 of the module wall. Instead, a single user can perform the reconfiguration. In some implementations, one or more tools can be used to assist in the removal of connection interface component(s) 726, connection component(s) 104, frame element(s) 108, module(s) 102, subunit(s) 112, etc., without departing from the scope of the present disclosure.

Similarly, the connection system described herein enables the height and/or width of the modular wall to be readily adjusted without having to disassemble the entire modular wall. For instance, to increase to the height of a modular wall (e.g., wall 100, FIG. 1), one or more additional modules 102 can be connected to the top (or bottom) of the wall in the same manner that the other (existing) modules of the wall are connected together (e.g., with connection components 104 and a connection interface components 726). In the event that the height of the modular wall needs to be decreased, one or more of the modules 102 can be removed from the wall. For instance, one or more of the modules 102 that form the top row of the modular wall can be disconnected and removed from the modular wall. Alternatively, bottom modules can be removed and the wall can optionally be shifted downward to contact the floor.

In some implementations, one or more of the modules 102 in the middle rows (i.e., rows between the top and bottom rows) of the modular wall can be removed. As discussed herein, the modules 102, regardless of what row they are in, can be removed by removing the connection interface component(s) 726 that connect the modules 102 to the surrounding modules 102. Once the connection interface component(s) 726 are removed and/or disengaged, the module(s) 102 can be removed from the modular wall, without having to disassembly the entire modular wall. In some instances, when a module 102 is removed from one of the middle rows of the modular wall, the module(s) 102 above the removed module 102 can be lowered down into the place of the removed module 102, thereby reducing the height of the modular wall. Once lowered into place, the lowered modules 102 can then be secured to the surrounding modules 102 (e.g., with connection interface component(s) 726). Alternatively, the module(s) 102 above the removed module 102 can optionally remain un-lowered such that a gap or void in the wall persists. Such an aesthetic design feature can be desirable in certain implementations.

Thus, implementations of the present disclosure include reconfigurable, (elastically) interchangeable, (universally) compatible, and/or otherwise customizable systems and apparatus for modular structures, such as walls, and methods related to the same. Such systems and apparatus can avoid issues related to interdependence of components by including a common, universal, and/or elastic interface that provides and/or accepts components described and/or disclosed herein regardless of shape and/or size thereof. Therefore, the present disclosure relates to systems, methods, and apparatus that provide ultimate design control over modular systems implementing the same.

The above-described implementations of the present disclosure are meant to be illustrative of exemplary and/or preferred implementations and are not intended to limit the scope of the present disclosure. The only limitations to the scope of the present invention are set forth in the following claims appended hereto. While various aspects and implementations have been disclosed herein, other aspects and implementations are contemplated. Thus, while the foregoing is directed to certain implementations of the present disclosure, other and further implementations of the disclosure can be devised without departing from the basic scope thereof. Various modifications, which would be readily apparent to one skilled in the art, are intended to be within the scope of the present disclosure. In addition, implementations of the present disclosure are further scalable to allow for additional components, modules, subunits, systems, elements, members, and/or users, etc., as particular applications can require.

The present disclosure can be embodied in other specific forms without departing from its spirit or essential characteristics. The described implementations are to be considered in all respects only as illustrative and not restrictive. The scope of the invention is, therefore, indicated by the appended claims rather than by the foregoing description. While certain implementations and details have been included herein and in the attached invention disclosure for purposes of illustrating the invention, it will be apparent to those skilled in the art that various changes in the methods and apparatus disclosed herein can be made without departing from the scope of the invention, which is defined in the appended claims. All changes which come within the meaning and range of equivalency of the claims are to be embraced within their scope.

What is claimed is:

1. A reconfigurable partition system comprising:

a plurality of modules configured to be arranged into a modular structure, wherein each module comprises a connection component configured to be attached to a connection component of another module;

a first connection interface components configured to reversibly attach first and second connection components together at an attachment interface, the first connection interface component comprising first and second channel engagement elements that are oriented in a non-parallel arrangement relative to one another; and a second connection interface component separate and distinct from the first connection interface component and configured to reversibly attach the first and second connection components together at the attachment interface, the second connection interface component comprising first and second channel engagement elements that are oriented in a non-parallel arrangement relative to one another, wherein the first connection interface component connects the first and second connection components together so that corresponding first sides of the first and second connection components are secured to one another at a fixed first distance from one another and the second connection interface component connects the first and second connection components together so that corresponding second sides of the first and second connection components are secured to one another at a fixed second distance from one another that is greater than the first distance such that the first and second connection interface components attach the first and second connection components together in aft fixed and angled arrangement.

2. The reconfigurable partition system of claim 1, wherein each of the first and second connection interface components is configured to be inserted into an attachment interface channel of one or more connection components.

3. The reconfigurable partition system of claim 1, wherein each of the connection interface components comprises an elongated member configured to be removably secured within respective attachment interface channels of the first and second connection components.

4. The reconfigurable partition system of claim 1, wherein each of the connection interface components comprises an intermediate member that is connected between the corresponding first and second channel engagement elements.

5. The reconfigurable partition system of claim 4, wherein the intermediate member of the second connection interface component comprises a first part and a second part that form a non-planar angle.

6. The reconfigurable partition system of claim 1, wherein at least one of the connection interface components comprises a trim element.

7. The reconfigurable partition system of claim 6, wherein the trim element is linked to the first and second channel engagement elements by an extension member.

8. The reconfigurable partition system of claim 1, wherein each channel engagement element comprises a first end and a second end, wherein the first ends of the first and second channel engagement elements of the first connection interface component are positioned closer together than the second ends of the first and second channel engagement elements of the second connection interface component.

9. A reconfigurable partition system comprising:

a first module comprising:

a first connection components configured to be attached to a connection component of another module, the first connection component comprising two first interface channels; and a first tile connected to the first connection component;

a second module comprising:

a second connection component configured to be attached to the first connection component of the first module, the second connection components comprising two second interface channels; and a second tiles connected to the second connection component; and first and second connection interface components that are separate and distinct from one another and that are configured to reversibly attach the first connection component to the second connection component in a fixed, non-parallel configuration, wherein:

the first connection interface component comprises first and second channel engagement elements that are oriented in a fixed non-parallel arrangement relative to one another, the first channel engagement element being configured for insertion into one of the two first interface channels and the second channel engagement element being configured for insertion into one of the two second interface channels;

the second connection interface component comprises first and second channel engagement elements that are oriented in a fixed non-parallel arrangement relative to one another, the first channel engagement element being configured for insertion into the other of the two first interface channels and the second channel engagement element being configured for insertion into the other of the two second interface channels.

10. The reconfigurable partition system of claim 9, wherein the first and second channel engagement elements form an angle of between about 2.5° and about 15°.

11. The reconfigurable partition system of claim 9, wherein at least one of the first and second connection interface components comprises an intermediate member extending between the first and second channel engagement elements.

12. The reconfigurable partition system of claim 11, wherein the intermediate member comprises a first part and a second part, the first and second parts forming a fixed angle.

13. The reconfigurable partition system of claim 11, wherein the intermediate member maintains the first and second channel engagement elements in the fixed non-parallel arrangement.

14. The reconfigurable partition system of claim 13, wherein.

15. The reconfigurable partition system of claim 11, wherein the at least one of the first and second connection interface components comprises an extension member extending from the intermediate member.

16. The reconfigurable partition system of claim 15, wherein the at least one of the first and second connection interface components further comprises a trim element connected to the extension member opposite the intermediate member.

17. The reconfigurable partition system of claim 16, wherein the trim element is configured to seal a gap formed between the attached connection components.

18. The reconfigurable partition system of claim 9, wherein the first and second connection interface components attach the first connection components to the second connection component such that the first and second modules form a first angle that is fixed and opens to a first side of the reconfigurable partition system.

19. The reconfigurable partition system of claim 18, further comprising:

a third module comprising:

a third connection components configured to be attached to a connection component of another module, the third connection components comprising two third interface channels; and a third tiles connected to the third connection component; and third and fourth connection interface components configured to reversibly attach the third connection component to a connection component of the second module in a non-parallel configuration.

20. The reconfigurable partition system of claim 19, wherein the third and fourth connection interface components attach the third connection component to a connection component of the second module such that the second and third modules form a second angle.

21. The reconfigurable partition system of claim 20, wherein the second angle opens to a second side of the reconfigurable partition system.

22. The reconfigurable partition system of claim 20, wherein the first and second angles are different from one another.

23. A method of assembling a reconfigurable partition system, the method comprising:

providing a first partition module and a second partition module, the first partition module comprising a first connection component, the first connection component comprising first and second first interface channels, the second partition module comprising a second connection component, the second connection component comprising a-first and second second interface channels;

aligning the first and second first interface channels with the first and second second interface channels such that the first partition module is oriented in a non-parallel configuration relative to the second partition module, the aligned first first interface channel and the first second interface channel forming a first attachment channel and the second first interface channel and the second second interface channel forming an second attachment channel; and reversibly attaching the first partition module to the second partition module by inserting a first connection interface component into the first attachment channel and a second connection interface component into the second attachment channel, the second connection interface component being separate and distinct from the first connection interface component, the attached first and second partition modules being oriented in a fixed and non-parallel configuration, each of the first and second connection interface components comprising first and second channel engagement elements oriented in a nonparallel arrangement relative to one another such that the first channel engagement element is disposed in the first interface channel and the second channel engagement element is disposed in the second interface channel.

* * * * *